US010486416B2

(12) United States Patent
Reinsch et al.

(10) Patent No.: US 10,486,416 B2
(45) Date of Patent: Nov. 26, 2019

(54) DEVICE FOR OVERLAPPING SHEETS

(71) Applicant: KOENIG & BAUER AG, Würzburg (DE)

(72) Inventors: Carsten Reinsch, Radebeul (DE); Michael Koch, Dresden-Cossebaude (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 16/080,316

(22) PCT Filed: Apr. 26, 2017

(86) PCT No.: PCT/EP2017/059890

§ 371 (c)(1),
(2) Date: Aug. 28, 2018

(87) PCT Pub. No.: WO2017/186772

PCT Pub. Date: Nov. 2, 2017

(65) Prior Publication Data

US 2019/0070846 A1 Mar. 7, 2019

(30) Foreign Application Priority Data

Apr. 29, 2016 (DE) ..... 10 2016 207 397

(51) Int. Cl.
*B41F 21/00* (2006.01)
*B65H 11/00* (2006.01)
(Continued)

(52) U.S. Cl.
CPC ..... *B41F 21/00* (2013.01); *B65H 5/22* (2013.01); *B65H 5/228* (2013.01); *B65H 5/24* (2013.01);
(Continued)

(58) Field of Classification Search
CPC ..... B65H 11/00; B65H 29/6636; B65H 5/22; B65H 5/228; B65H 5/24; B41F 21/00; B41F 21/05; B41F 1/32
See application file for complete search history.

(56) References Cited

U.S. PATENT DOCUMENTS 2,198,385 A 4/1940 Harrold
3,730,515 A 5/1973 Spiess
(Continued)

FOREIGN PATENT DOCUMENTS

DE 1033225 B 7/1958
DE 2010467 B2 11/1971
(Continued)

OTHER PUBLICATIONS

International Search Report of PCT/EP2017/059890 dated Aug. 8, 2017.

*Primary Examiner* — David H Bollinger
(74) *Attorney, Agent, or Firm* — Mattingly & Malur, PC

(57) ABSTRACT

A device for overlapping sheets includes at least one blower box and a supply table. Multiple sheets are guided into a region of the blower box consecutively, in the same transport direction, and are arranged at a distance from one another on the supply table. A blower nozzle is arranged in the blower box, on the side thereof facing the supply table. A blowing direction of the blower nozzle is oriented and parallel to the supply table and against the transport direction of the sheets. The supply table is arranged below the blower box and multiple blower nozzles are arranged in the blower box, one after the other, in the transport direction of the sheets, on the side thereof facing the supply table. A respective blowing direction of the blower nozzles is oriented in parallel to the supply table, and against the transport direction of the sheets.

14 Claims, 30 Drawing Sheets

(51) Int. Cl.

| | |
|---|---|
| ***B65H 5/22*** | (2006.01) |
| ***B65H 29/66*** | (2006.01) |
| ***B65H 5/24*** | (2006.01) |
| ***B65H 29/24*** | (2006.01) |
| ***B65H 29/52*** | (2006.01) |
| *B65H 7/02* | (2006.01) |
| *B65H 9/06* | (2006.01) |

(52) U.S. Cl.

CPC ..... *B65H 11/00* (2013.01); *B65H 11/005* (2013.01); *B65H 29/243* (2013.01); *B65H 29/52* (2013.01); *B65H 29/6636* (2013.01); *B65H 5/226* (2013.01); *B65H 7/02* (2013.01); *B65H 9/06* (2013.01); *B65H 2220/01* (2013.01); *B65H 2220/02* (2013.01); *B65H 2220/11* (2013.01); *B65H 2301/4461* (2013.01); *B65H 2301/44712* (2013.01); *B65H 2301/44735* (2013.01); *B65H 2403/51* (2013.01); *B65H 2403/53* (2013.01); *B65H 2404/1523* (2013.01); *B65H 2406/1132* (2013.01); *B65H 2406/362* (2013.01); *B65H 2406/3661* (2013.01); *B65H 2513/53* (2013.01); *B65H 2515/212* (2013.01); *B65H 2601/21* (2013.01); *B65H 2801/15* (2013.01); *B65H 2801/21* (2013.01); *B65H 2801/31* (2013.01)

(56) References Cited

U.S. PATENT DOCUMENTS

| | | | | |
|---|---|---|---|---|
| 5,139,253 | A | 8/1992 | Bohme et al. | |
| 5,275,394 | A * | 1/1994 | Mank | B65H 29/6636 271/183 |
| 5,636,833 | A | 6/1997 | Maier et al. | |
| 5,797,327 | A | 8/1998 | Gieser et al. | |
| 5,927,203 | A | 7/1999 | Gieser et al. | |
| 7,665,722 | B2 | 2/2010 | Edinger | |
| 9,422,126 | B2 | 8/2016 | Kondo et al. | |
| 9,440,427 | B2 | 9/2016 | Schmidt | |
| 2010/0148428 | A1* | 6/2010 | Kagi | B65H 5/085 271/227 |
| 2012/0314013 | A1 | 12/2012 | Takemoto et al. | |
| 2013/0300057 | A1 | 11/2013 | Kondo et al. | |
| 2016/0023479 | A1 | 1/2016 | Schmidt | |

FOREIGN PATENT DOCUMENTS

| | | | |
|---|---|---|---|
| DE | 4012948 | A | 10/1991 |
| DE | 4413089 | A1 | 10/1995 |
| DE | 19643600 | A | 4/1998 |
| DE | 10157118 | A1 | 5/2003 |
| DE | 10312870 | A1 | 2/2004 |
| DE | 202004006615 | U1 | 8/2004 |
| DE | 102004007404 | A1 | 9/2004 |
| DE | 102004014521 | B3 | 11/2005 |
| DE | 102005021185 | A1 | 11/2005 |
| DE | 202008010256 | U1 | 11/2008 |
| DE | 102009000518 | A1 | 8/2010 |
| DE | 102009048928 | A1 | 4/2011 |
| DE | 102010041453 | A | 3/2012 |
| DE | 102014010904 | B3 | 1/2015 |
| DE | 10141589 | B4 | 3/2015 |
| EP | 0792742 | A | 9/1997 |
| EP | 1757450 | A2 | 2/2007 |
| EP | 2540513 | A1 | 1/2013 |
| EP | 2657025 | A | 10/2013 |
| GB | 472020 | A | 9/1937 |
| JP | 2001-039604 | A | 2/2001 |

* cited by examiner

DEVICE FOR OVERLAPPING SHEETS

CROSS REFERENCE TO RELATED APPLICATIONS

This application is the U.S. National Stage, under 35 U.S.C. 371, of PCT/EP2017/059890, filed Apr. 26, 2017; published as WO 2017/186772A1 on Nov. 2, 2017, and claiming priority to DE 10 2016 207 397.4, filed Apr. 29, 2016, the disclosures of which are expressly incorporated herein by reference in their entireties.

FIELD OF THE INVENTION

The present invention relates to a device for overlapping sheets. The device utilizes at least one blower module and one infeed table. A plurality of sheets are guided, in succession, and are spaced from one another on the infeed table, in the same direction of transport, into a region of the blower module. A blower nozzle is arranged in the blower module on the side thereof facing the infeed table. A blowing direction of the blower nozzle is oriented parallel to the infeed table and is opposite to the transport direction of the sheets.

BACKGROUND OF THE INVENTION

From JP 2001-39 604 A, a device for overlapping sheets, having at least one blower module and one infeed table, is known, wherein a plurality of sheets are fed on the infeed table in succession, spaced from one another and in the same direction of transport, into the region of the blower module, wherein a blower nozzle is arranged in the blower module, on the side thereof that faces the infeed table, and the blowing direction of the blower nozzle is aligned parallel to the infeed table, opposite the direction of transport of the sheets.

From DE 196 43 600 A1, a method for influencing sheets that are being conveyed overlapping one another to a printing machine is known, wherein the sheets are transported by means of conveyor belts into the region of front and/or side lay marks, and each sheet to be aligned is held by additional means, which act on the region in which the sheet to be aligned overlaps with next sheet in the sequence, in an operative connection with the next sheet in the sequence, which is forcibly guided by conveyor belts, in such a way that a movement with at least three degrees of freedom of the sheet to be aligned can be realized.

From DE 10 2004 007 404 A1, a method for guiding sheets to a sheet-processing machine is known, in which the adhesive force between two successive sheets in an overlapping stream is reduced by lifting the trailing edge of the first sheet.

Known from DE 10 2010 041 453 A1 is a sheet-fed printing machine having an infeed table for conveying sheets in an overlapping sequence to a first printing mechanism of the sheet-fed printing machine, wherein a sheet to be aligned can be placed on the infeed table on feed marks, and above the overlapping sequence, a sheet guidance mechanism is provided, which has at least one blower unit, by means of which an air flow onto the trailing edge of the sheet to be aligned can be generated, wherein at least one device for lifting the trailing edge of the sheet to be aligned is assigned to the infeed table, said device being located beneath the overlapping sequence of sheets.

From EP 0 792 742 A1, a device for guiding sheet-type material within a printing machine is known, having a guide surface arranged beneath the sheet-type material and having nozzles arranged in zones within the guide surface, wherein a first zone extends along the longitudinal axis of the guide surface and a second and a third zone are each arranged to the side of the first zone, wherein the nozzles arranged in the first zone are in the form of blower nozzles, the blowing direction of which is directed substantially in the sheet transport direction, and wherein the nozzles arranged in the second and third zones are in the form of blower nozzles, the blowing direction of which is directed substantially away from the longitudinal axis of the guide surface toward the lateral edges of the guide surface, wherein blower air can be supplied to the nozzles of the first zone separately from the nozzles of the second and third zones.

From EP 1 757 450 A2, a sheet-fed printing machine is known, having a feeder for printing sheets to be printed, in which case the feeder removes sheets from a feed pile, and having at least one printing unit and/or varnishing unit for printing the printing sheets, and having a delivery for discharging printed sheets, and having at least one device for corona treatment of the printed sheets, to increase the surface tension of the printed sheets and thus the wettability of the same with printing ink and/or varnish, wherein a) the feeder is embodied as a single-sheet feeder, which separates the printing sheets removed from the feed pile in such a way that said sheets can be conveyed without overlap in the region of a conveyor table located downstream of the single-sheet feeder as viewed in the direction of conveyance of the printing sheets, b) the conveyor table comprises at least two conveyor systems arranged one behind the other as viewed in the direction of conveyance of the printed sheets, wherein a plurality of corona treatment devices are arranged in the region of the conveyor table and can be used to subject the printing sheets to a full-surface corona treatment on the upper side and the underside of each, c) as viewed in the direction of conveyance of the printing sheets, downstream of the conveyor table, an overlapping device is positioned, which generates an overlapping stream of partially overlapping printing sheets from the printing sheets being conveyed without overlap in the region of the conveyor table, and d) the printing sheets can be fed in the form of an overlapping stream across a feed table positioned downstream of the overlapping device as viewed in the direction of conveyance of the printing sheets, to a printing unit or varnishing unit.

From EP 2 540 513 A1, a machine arrangement for the sequential processing of a plurality of sheet-type substrates each having a front side and a reverse side is known, said machine arrangement including a first printing cylinder and a second printing cylinder, wherein on the periphery of the first printing cylinder, at least one first non-impact printing unit for printing the front side of the substrate in question is provided, and downstream of the first non-impact printing unit in the direction of rotation of the first printing cylinder, a dryer for drying the front side of the substrate in question, which has been printed by the first non-impact printing unit, is provided, and wherein on the periphery of the second printing cylinder, at least one second non-impact printing unit for printing the reverse side of the substrate in question is provided, and downstream of the second non-impact printing unit in the direction of rotation of the second printing cylinder, a dryer for drying the reverse side of the substrate in question, which has been printed by the second non-impact printing unit, is provided; the first printing cylinder and the second printing cylinder are arranged forming a common roller nip, and in this common roller nip, the first printing cylinder transfers the substrate in question, which has been printed and dried on its front side, directly to the second printing cylinder.

From DE 103 12 870 A1, a digital printing machine for sheet-fed printing is known, having a digital printing couple with free format in the peripheral direction, an intermediate cylinder which is at least partially coated with an elastic material and is connected downstream of the digital printing couple, and an impression cylinder connected downstream of the intermediate cylinder, wherein the impression cylinder has sheet-holding grippers, and the intermediate cylinder has recesses for receiving the grippers, arranged on its periphery.

From DE 10 2014 010 904 B3, a device for printing on both sides of sheet-type printing substrates is known, in which the printing substrate is guided through more than 360° on an impression cylinder, with the printing substrate arriving with its reverse side in the operative region of an ink application unit, by which the printing substrate has already been printed on its front side on an impression cylinder upstream, the ink application unit preferably being pivotable between two successive impression cylinders, and the pivotable ink application unit being, e.g. an inkjet print head.

From DE 10 2005 021 185 A1, a device for applying opaque white or an effect coating layer is known, wherein the effect coating layer is dried or cured after application and is subsequently overprinted; one or more inkjet print heads are provided within a printing machine, the one or more inkjet print heads for applying the opaque white or the effect coating layer directly onto the printing substrate or indirectly onto the substrate with an intermediate layer therebetween being arranged or arrangeable upstream of the infeed to or within the printing machine along the transport path of the printing substrate.

From DE 10 2009 000 518 A1, a sheet-fed printing machine is known, which comprises a feeder for loading sheets to be printed into the sheet-fed printing machine, at least one printing unit and/or coating unit for printing the sheet with a static print image which is identical for all the sheets, a delivery for channeling printed sheets out of the sheet-fed printing machine, and at least one printing unit that operates without a printing form, integrated into the sheet-fed printing machine, for printing the sheets with a variable, in particular dynamic print image, wherein the or each form-free printing unit is integrated into the sheet-fed printing machine such that it can be controlled dependent upon process parameters or operating parameters or print order parameters or quality parameters.

From EP 2 657 025 A1, a sheet conveying device is known, which comprises the following components: a first conveyance unit comprising a first holder, which holds one edge of a sheet and conveys the sheet held by the first holder; a second conveyance unit comprising a second holder, which holds the one edge of the sheet and conveys the sheet held by the second holder; a third conveyance unit, wherein the third conveyance unit comprises a third holder that holds the other edge of the sheet being conveyed by the first conveyance unit, and conveys the sheet being held by the third holder; an independent drive unit that independently drives the first conveyance unit; a device drive unit that drives the entire device including the second conveyance unit and the third conveyance unit; and a control unit that controls the independent drive unit to adjust the speed at which the third conveyance unit conveys the sheet in one direction, based on the dimensions of the sheet, wherein the first conveyance unit comprises a rotatably mounted transport cylinder, and the independent drive unit comprises an independent drive motor that drives the transport cylinder independently of a device drive system, wherein the third conveyance unit is mounted so as to be pivotable between a receiving position, in which the third conveyance unit receives the sheet from the first conveyance unit, and a transfer position, in which the third conveyance unit transfers the sheet to the second conveyance unit, and with a further inclusion of a fourth conveyance unit, located on an upstream side of the transport cylinder in a sheet conveyance direction, comprises a fourth holder, which holds one edge of the sheet and transfers the sheet held by the fourth holder to the first holder of the transport cylinder, wherein the control unit controls the independent drive motor to adjust the rotational speed of the transport cylinder to coincide with the dimensions of the sheet in the direction of conveyance, so that the other edge of the sheet being conveyed by the transport cylinder is opposite the third holder when the third conveyance unit is detected in the sheet receiving position, and the fourth holder of the fourth conveyance unit is opposite the first holder of the first conveyance unit once the sheet has been transferred to the third holder.

From DE 10 33 225 A, a sheet feeder for printing machines is known, in which continuous belts travel above a vacuum space, said space being closed off and the vacuum being active only in openings (suckers) in the belt opposite the paper pile or individual paper sheets, so that the sheet is carried along by the belts, wherein the belts are made of wear-resistant steel, wherein adjacent to and behind the sucker points, blower openings (chambers, tubes, slots) are preferably located, which cause the sheets to separate and to float by means of blower air.

From DE 44 13 089 A1, a method for the overlapped feeding of sheet-type printing substrates into a printing machine using a conveyor table is known, in which compressed air flows continuously underneath the overlapped stream, opposite the direction of conveyance of the printing substrate being fed in over the conveyance table.

From DE 40 12 948 A1, a conveyor table for guiding sheets to a printing machine is known, having at least one suction chamber to which an axial fan is attached, along with perforated suction belts circulating about said fan over suction openings in the conveyor table, wherein parallel to the suction belts, openings are provided in the conveyor table which are separated from the suction chamber and are connected to the surrounding environment.

From DE 20 2004 006 615 U1, a device on a conveyor table, preferably on a suction belt table, is known, for transporting sheet-type material in a stream of sheets lying in an overlapping arrangement from a sheet feeder to a sheet processing machine, in particular to a rotary sheet-fed printing machine, having one or more conveyor belts, for example suction belts to which suction air can be applied, which are drivable and are guided continuously about the conveyor table, and having a blower device, which blows air underneath the stream of sheets, outside of the guide region of the conveyor belts, and in the area where guide regions of the conveyor table are located laterally and parallel to the conveyor belts, wherein, at least in the guide regions on the outer side of the conveyor belts, a plurality of individual ventilation openings distributed substantially over the entire surface of the guide regions is provided, and wherein a blower air infeed is provided, such that it is at least partially coupled for ventilation openings in such a way that blower air can be applied essentially to partial areas or to the entire surface of the guide regions, wherein the ventilation openings, preferably in the region of the outlet-side end of the conveyor table, are embodied as nozzles, each aligned from the center of the conveyor table toward the lateral edges.

From DE 101 57 118 A1, a device for braking printed sheets in the delivery of a sheet-fed printing machine and having a sheet brake that operates using suction air is known, wherein the sheet brake is connected via a system of lines and at least one valve to a vacuum generator, so that at the outer radius of the sheet brake, vacuum pressure can be applied to the suction area, wherein at least one sensor for determining the position of the printed sheet and a control device connected downstream are provided, and the valve can be actuated by the control device in response to signals from the at least one sensor.

From DE 10 2009 048 928 A1, an inkjet printer for printing on sheet-type substrates is known, the printer having the following components: a) a printing unit transport device which has at least one revolving printing unit conveyor belt, guided over rollers and having openings, and a suction chamber device, located beneath the printing unit conveyor belt, wherein the printing unit conveyor belt or the printing unit conveyor belts has/have a dedicated drive unit, which impresses/impress a speed on the conveyor belt(s), b) an inkjet printing device located above the upper drum of the printing unit conveyor belt, which is guided approximately horizontally, c) a transport device having at least one revolving belt, disposed upstream of the printing unit transport device in the direction of transport of the printing sheets/printing substrates, wherein the conveyor belt(s) has/have a dedicated drive unit that impress/impresses a speed upon the conveyor belt(s), wherein the ratio of the speed of the printing unit conveyor belt or printing unit conveyor belts of the printing unit transport device to the speed of the conveyor belt or conveyor belts of the transport device situated upstream of the printing unit transport device is selected such that the printing sheets or printing substrates for all sheet formats provided for the inkjet printer come to rest end to end or spaced by a slight distance of up to 10 mm on the printing unit conveyor belt or printing unit conveyor belts.

From DE 101 41 589 B4, a method for operating a sheet processing machine is known, in which the sheets are displaced in the direction of transport and are treated in multiple processing stations, wherein the speed of displacement of the sheets is individually adjustable, wherein the speed of a given sheet is adjusted to the processing step to be carried out in the respective processing station, and wherein the speed of the sheet is different in at least two of the processing stations. In this case, the processing output of the individual processing stations during a certain period of time may be the same, or the processing output of a first processing station may be higher or lower than the processing output of a second processing station upstream or downstream during a certain period of time.

From DE 10 2004 014 521 B3, a device for transporting sheets in printing machines from the printing couples to the sheet delivery pile is known, said device consisting of at least one gripper carriage guided bilaterally on chain tracks and having gripper systems for gripping and guiding the sheets, wherein the gripper carriage follows a rectilinear guide path above the sheet delivery pile, and after depositing a sheet onto a sheet pile is guided along a radius of curvature within a turning region, said device further consisting of leading edge grippers for gripping the leading edges of the sheets and for depositing the sheets onto the sheet delivery pile, wherein a gripper carriage support is provided only on the rectilinear guide path above the sheet delivery pile and in the turning region.

From U.S. Pat. No. 2,198,385 A, a gripper carriage is known, which is supported centrally via a cam follower on a cam disk in the area of transfer from the last sheet guiding cylinder to the gripper carriage, for the purpose of achieving a register-true transfer of the sheet.

SUMMARY OF THE INVENTION

The object of the invention is to provide a device for overlapping sheets.

The object is attained according to the invention by the positioning of the infeed table beneath the blower module. In the blower module, on the side thereof that faces the infeed table, a plurality of blower nozzles are arranged, one behind the other, in the transport direction of the sheets. The blowing direction of the each of the blower nozzles is oriented parallel to the infeed table and is opposite the transport direction of the sheets.

The advantages to be achieved with the invention will be apparent from the following explanations.

In addition, the described solution can be used in a hybrid machine arrangement for processing sheet-type substrates, preferably in a hybrid printing machine, which uses the high productivity of a conventional printing system, e.g. for printing in an offset printing process or in a flexographic printing process or in a screen printing process, or the high productivity of a coating device, in particular a coating unit, variably in combination with at least one non-impact printing unit, e.g. embodied as an inkjet printer, for flexible printing of variable print images, wherein both the conventional printing system or the coating unit and the non-impact printing unit are used in a running production operation inline, each at the operating speed that is optimal for it. A hybrid machine arrangement of this type is highly advantageous, in particular for the production of packaging materials, e.g. sheets for the production of folding cartons, because the strengths of each of the printing systems are utilized, resulting in a flexible and efficient production of packaging materials. For instance, rigid sheet-type substrates, in particular, can advantageously be printed in a flat state and a horizontal position in a non-impact printing unit. The length of a linear transport device can be adapted with less effort to a different number of printing couples or printing stations (color separations) and (intermediate) dryer configurations, e.g. for water-based or UV-curing printing inks or inks, than would be possible with a rotary transport device involving cylinders. Moreover, with a linear transport device, when sheet-type substrates of variable format lengths are used, a constant sheet gap between sheet-type substrates being transported in immediate succession and spaced from one another can be more easily realized. On the other hand, transporting sheet-type substrates by means of rotational bodies, in particular cylinders and gripper bars or gripper carriages, in each case with the sheet-type substrates being transferred in the gripper closure to the next processing station, as is known with sheet-fed offset printing machines, ensures the highest possible register accuracy.

BRIEF DESCRIPTION OF THE DRAWINGS

Exemplary embodiments of the invention are illustrated in the drawings and will be described in greater detail in the following.

Shown are.

DESCRIPTION OF PREFERRED EMBODIMENTS

Figure 1:
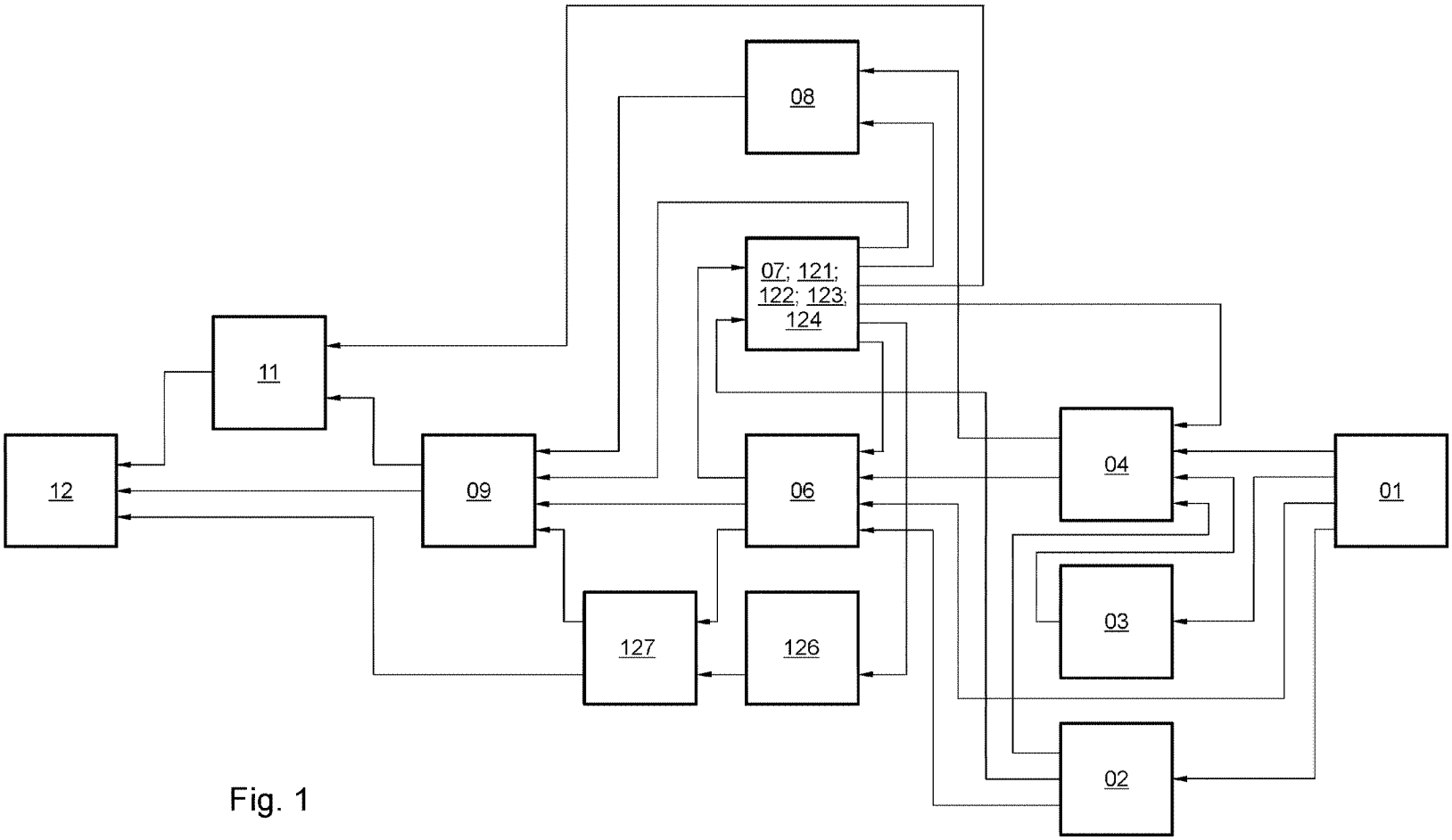
FIG. 1 a block diagram illustrating various production lines.

FIG. 1 is a block diagram illustrating various production lines, each of which can be achieved with a machine arrangement having a plurality of different processing stations 01; 02; 03; 04; 06; 07; 08; 09; 11; 12, in particular, for processing at least one sheet-type substrate, in particular a printing substrate, preferably a printing sheet which is rectangular, in particular, or simply a sheet, said at least one substrate being rigid or pliable, depending upon its material, material thickness and/or base weight. Preferably, each of these processing stations 01; 02; 03; 04; 06; 07; 08; 09; 11; 12 is embodied, e.g. as a functionally independent module, a module being understood as a machine unit or functional assembly which is typically produced independently or is at least assembled separately. Thus, each of the processing stations 01; 02; 03; 04; 06; 07; 08; 09; 11; 12 located in a given machine arrangement is preferably produced separately, and in a preferred embodiment the functioning of each processing station can be checked, e.g. individually. The given machine arrangement, formed in each case by the selection and assembly of at least three different processing stations 01; 02; 03; 04; 06; 07; 08; 09; 11; 12, each configured for processing sheets and for cooperating in a specific production operation, in each case embodies a specific production line. Each of the production lines shown, each embodied by a specific machine arrangement comprising a plurality of processing stations 01; 02; 03; 04; 06; 07; 08; 09; 11; 12, is configured, in particular, for the production of a packaging material formed from the printing substrate, preferably from the printed sheet. The packaging materials to be produced are, e.g. a folding carton, each being produced from printed sheets. The various production lines are therefore configured in particular for the production of various packaging materials. The processing of the printing substrate required during a specific production operation takes place in each case inline, i.e. the processing stations 01; 02; 03; 04; 06; 07; 08; 09; 11; 12 involved in a specific production operation are placed in use one after the other in an ordered sequence and synchronized with one another as the printing substrate travels through the machine arrangement containing the respective processing stations 01; 02; 03; 04; 06; 07; 08; 09; 11; 12, selected for the respective production operation, without intermediate storage being provided for the printing substrate, i.e. the processed sheets, during the production operation carried out with the machine arrangement in question.

Common to all of the production lines shown in FIG. 1 is that each cooperates with a processing station 06, which has at least one non-impact printing unit 06, preferably a plurality of non-impact printing units 06, e.g. four, five, six or seven, in particular each being individually controlled, these non-impact printing units 06 preferably being arranged one behind the other in the transport direction T of the printing substrate, and being embodied such that each is capable of printing onto the printing substrate over at least nearly its entire width directed transversely to the transport direction T. A non-impact printing unit 06 uses a printing method without a fixed printing form and in principle, can print on the printing substrate, e.g. the sheets that are fed to said printing unit 06, with a print image that differs from the print image preceding it, from print to print. Each non-impact printing unit 06 is implemented in particular as at least one inkjet printer or at least one laser printer. Inkjet printers are dot matrix printers that produce a print image by the selective shooting or deflection of small droplets of ink, with inkjet printers operating either as continuous inkjet (CIJ) devices or as individual drop-on-demand (DOD) devices. Laser printers generate a print image through an electrophotographic process. The non-impact printing unit 06 is also referred to, e.g. as a digital printing machine.

In the following, it will be assumed by way of example that in each machine arrangement having a plurality of processing stations 01; 02; 03; 04; 06; 07; 08; 09; 11; 12, a sequence of, in particular, rigid sheets, e.g. of a paper, a single-ply or multi-ply paperboard or a cardboard as printing substrate is processed, in particular to produce a packaging material. Paper, paperboard and cardboard as printing substrates differ from one another in terms of grammage, i.e. the weight in grams of one square meter of the printing substrate. In general, the aforementioned printing substrate having a grammage of between 7 $g/m^2$ and 150 $g/m^2$ is considered to be paper, substrate having a grammage of between 150 $g/m^2$ and 600 $g/m^2$ is considered to be paperboard and substrate having a grammage of more than 600 $g/m^2$ is considered to be cardboard. For producing cartons, paperboards are used in particular, as these are readily printable and are suitable for subsequent finishing or processing, such as varnishing and punching. In terms of fiber content, these paperboards are, e.g. pulp-free, contain small amounts of pulp, or are pulp-containing, or contain recycled paper. In terms of their structure, multi-ply paperboards have a cover layer, an inlay, and a backing on the reverse side. In terms of surface finish, paperboards may be, e.g. uncoated, pigmented, coated or cast-coated. The format of such sheets ranges, e.g. from 340 mm×480 mm to 740 mm×1060 mm, with the first number of the format specifications typically indicating the length of the sheet in the transport direction T and the second number indicating the width of the sheet, orthogonally to the transport direction T.

In the block diagram of FIG. 1, each production line, which can be formed from a plurality of processing stations 01; 02; 03; 04; 06; 07; 08; 09; 11; 12, extends substantially from right to left, with each of the directional arrows that interconnects two processing stations 01; 02; 03; 04; 06; 07; 08; 09; 11; 12 indicating the transport path to be traversed by the printing substrate, and the associated transport direction T, in traveling from one processing station 01; 02; 03; 04; 06; 07; 08; 09; 11; 12 to the next selected processing station 01; 02; 03; 04; 06; 07; 08; 09; 11; 12 in the machine arrangement designated for the respective production process. Each production operation begins with sheets being provided in processing station 01, the processing station 01 being embodied as a feeder 01, e.g. as a sheet feeder 01 or as a magazine feeder 01. A sheet feeder 01 typically accommodates a pile of sheets, e.g. stacked on a pallet, whereas a magazine feeder 01 has a plurality of compartments, in which sheets, in particular piles, e.g. of different types of sheets or sheets of different formats, are or at least can be placed. Feeder 01 separates the piled sheets, e.g. by means of a suction head 41, and feeds these in a sequence of mutually separated sheets or in an overlapped stream to the next processing station 02; 03; 04; 06 in the specific production process. The next processing station 02; 03; 04 is embodied, e.g. as a primer application unit 02 or as a cold foil application unit 03 or as an offset printing unit 04 or as a flexographic printing unit 04. The next processing station 06 may also simply be, e.g. the at least one non-impact printing unit 06. Offset printing unit 04 is preferably embodied as a sheet-fed offset printing machine, in particular as a sheet-fed printing machine having a plurality of printing couples 86 assembled as a unit structure. Offset printing unit 04 provides the sheets with at least one static print image, i.e. a print image that is invariable during the printing process due to its dependence upon the printing form that is used, whereas non-impact printing unit 06 provides the sheets with at least one varying or at least variable print image.

If the processing station 03 immediately following feeder 01 is the cold foil application unit 03, the sheet is then typically transported from there to the processing station 04 embodied as an offset printing unit 04. In cold foil application unit 03, a metallized coating layer, detached from a carrier film, is transferred to the substrate. By overprinting this coating layer, e.g. with an offset printing unit 04, a wide variety of metal effects can be achieved. Cold foil application unit 03 is advantageously embodied, e.g. as integrated into offset printing unit 04, with two additional printing couples 87; 88 being provided in offset printing unit 04. In the first printing couple 87 in transport direction T of the printing substrate, a special adhesive is applied to the printing substrate, i.e. to the sheet, by means of a standard printing form. A second printing couple 88 in transport direction T of the printing substrate is equipped with a film transfer device which has the coating layer to be transferred. The film bearing the coating layer is guided from an unrolling station into a printing nip between a transfer cylinder and a printing cylinder that cooperates with said transfer cylinder and is brought into contact with the printing substrate. Coloring in the coating layer is provided by an aluminum layer and a protective coating layer, the coloring of which influences the color effect. The transfer layers bond to the substrate by adhesion of a bonding layer onto which the adhesive layer is printed. The carrier film is then rolled up again. After the cold foil transfer, overprinting with conventional printing inks and with UV and hybrid inks is possible inline, in particular in offset printing unit 04, to produce various metallic color shades.

A printing substrate which is, e.g. particularly absorbent and/or which is to be prepared for printing with a non-impact printing unit 06 is fed from feeder 01 to the next processing station 02, embodied e.g. as a primer application unit 02, for coating at least one surface of this printing substrate with, e.g. a water-based primer, in particular to seal said substrate prior to printing or varnishing. This priming involves providing the printing substrate with a base coating or initial coating, in particular to improve or enable the bonding of a printing ink or ink that will subsequently be applied to the printing substrate. Primer application unit 02 is formed, e.g. in conjunction with a printing couple 86 of a rotary printing machine and has, e.g. a printing couple cylinder 82 cooperating with an impression cylinder 119 and having a form roller 83, preferably in the form of an anilox roller 83, that is or at least can be thrown onto said printing couple cylinder 82, along with at least one doctor blade 84, in particular a chamber doctor blade system 84, extending in the axial direction of the form roller 83 (FIGS. 3 to 5, 8, 27 and 28). The primer is applied by means of primer application unit 02 to the printing substrate, either over the entire surface thereof or only at certain, i.e. defined points, i.e. over a portion thereof. The printing substrate, e.g. sheet, processed in primer application unit 02, is fed, e.g. to an offset printing unit 04 and/or e.g. to a non-impact printing unit 06 as the next processing station.

The flexographic printing carried out by a processing station 04 embodied, e.g. as a flexographic printing unit 04 is a direct letterpress process, in which the raised areas of the printing form are image-bearing, and which is frequently used for printing packaging materials made from paper, paperboard or cardboard, metallized film, or a plastic, such as PE, PET, PVC, PS, PP or PC, for example. Flexographic printing uses low viscosity printing inks and flexible printing plates made of photopolymer or rubber. A flexographic printing unit 04 generally includes a) an anilox roller used for inking up the printing form, b) a printing cylinder, also called a form cylinder, on which the printing form is fixed, and c) an impression cylinder which guides the printing substrate.

Each processing station 04, embodied as a flexographic printing unit 04 or as an offset printing unit 04, which prints at least one static print image onto each of the sheets, preferably has a plurality of printing couples 86, e.g. at least four, each printing couple 86 preferably printing in a different printing ink, so that as the printing substrate passes through the flexographic printing unit 04 or the offset printing unit 04, it is printed in each case with a multicolor print, e.g. a four-color print. In particular, yellow, magenta, cyan and black inks are used as the printing inks. In an alternative embodiment of printing unit 04 for flexographic printing or offset printing, processing station 04, which prints each of the sheets with at least one static print image, is embodied as a printing unit 04 that prints in a screen printing process.

After the printing substrate has been processed in the at least one non-impact printing unit 06, said printing substrate is fed, e.g. to a processing station 07 embodied as an intermediate dryer 07, this intermediate dryer 07 being configured to dry the substrate in question, e.g. by irradiation with infrared or ultraviolet radiation, the type of radiation being dependent, in particular, on whether the printing ink or ink applied to the printing substrate is water-based or UV-curing. After intermediate drying, the printing substrate is fed, e.g. to a processing station 08 embodied as a coating unit 08. coating unit 08 applies, e.g. a dispersion coating to the printing substrate, with dispersion coatings consisting essentially of water and binders (resins), along with surfactants to stabilize these dispersions. A coating unit 08 for applying a dispersion coating to the printing substrate comprises either an anilox roller, a chamber doctor blade and a form roller (comparable to a flexographic printing couple), or a dipping roller and a form roller. Full-surface and/or partial coatings, for example, are applied using a printing form, preferably based on photopolymerization. For full surface coatings, special coating plates made of rubber may also be used. Downstream of coating unit 08 in the transport path of the printing substrate, a processing station 09 embodied, e.g. as a dryer 09 is arranged, said dryer 09 being configured for drying the printing substrate in question by irradiation with infrared radiation or with hot air. If the machine arrangement in question has a plurality of dryers 07; 09 along the transport path of the printing substrate, the dryer denoted by reference symbol 09 is preferably the last of this plurality of dryers 07; 09 in transport direction T of the printing substrate, in which case the intermediate dryer(s) 07 and the (final) dryer 09 may be structurally identical or may be configured differently from one another. If a printing substrate to be dried by ultraviolet radiation is fed to dryer 09, i.e. a printing substrate to which a printing ink or ink which is cured by UV-radiation, or a coating which is cured by UV-radiation, e.g. a gloss coating, is applied, this dryer 09 is equipped with a radiation source for generating ultraviolet radiation. Dispersion coatings allow more intense gloss and matte effects to be achieved than with classic oil-based varnish. Special optical effects can be achieved using effect pigments in the coating. Primer application unit 02, cold foil application unit 03 and coating unit 08 may be combined under the term coating unit 02; 03; 08.

After drying, the printing substrate is fed, e.g. to a processing station 11, which performs further mechanical processing of the printing substrate, e.g. punching or creasing, and/or the separation of parts, in particular the stripping of blanks from their linkage points in the preferably printed sheet. Each of the aforementioned further processing steps is carried out in or by a processing mechanism 46. Further mechanical processing is preferably carried out in cooperation with a cylinder that transports the respective sheet. Thereafter, or directly from dryer 09, the printing substrate travels to a delivery 12, which in each of the production lines shown in FIG. 1 embodied as an arrangement of processing stations 01; 02; 03; 04; 06; 07; 08; 09; 11; 12 is the last processing station 12. In delivery 12, the processed sheets are preferably stacked, e.g. on a pallet.

As is illustrated in FIGS. 2 to 9, the aforementioned sequence of processing stations 01; 02; 03; 04; 06; 07; 08; 09; 11; 12 arranged in each machine arrangement is merely exemplary and may be modified based upon the printed product to be produced.

Production lines illustrated by way of example in FIG. 1, which are used in particular for the production of packaging materials, each have a machine arrangement containing a selection from the aforementioned set of processing stations 01; 02; 03; 04; 06; 07; 08; 09; 11; 12. The following production lines are or at least can be formed, for example:

1. Sheet feeder 01; primer application unit 02; non-impact printing unit 06; intermediate dryer 07 with IR radiation source for dispersion coating; coating unit 08; dryer 09 with IR radiation source or hot air; delivery 12
2. Sheet feeder 01; primer application unit 02; non-impact printing unit 06; dryer 09 with IR radiation source or hot air; delivery 12
3. Sheet feeder 01; primer application unit 02; non-impact printing unit 06; intermediate dryer 07 with IR radiation source; coating unit 08 for dispersion coating and UV-curing coating; dryer 09 with IR radiation source or hot air and with UV radiation source; delivery 12
4. Sheet feeder 01; cold foil application unit 03; offset printing unit 04; non-impact printing unit 06; dryer 09 with IR radiation source or hot air; delivery 12
5. Sheet feeder 01; primer application unit 02; non-impact printing unit 06; intermediate dryer 07 with IR radiation source for dispersion coating; coating unit 08; dryer 09 with IR radiation source or hot air; mechanical further processing unit 11; delivery 12
6. Sheet feeder 01; offset printing unit 04; non-impact printing unit 06; intermediate dryer 07 with IR radiation source; mechanical further processing unit 11; delivery 12
7. Sheet feeder 01; non-impact printing unit 06; dryer 09 with IR radiation source or hot air; delivery 12
8. Sheet feeder 01; non-impact printing unit 06; intermediate dryer 07 with UV radiation source; dryer 09 with UV radiation source; delivery 12
9. Sheet feeder 01; non-impact printing unit 06; intermediate dryer 07 with UV radiation source; dryer 09 with UV radiation source; mechanical further processing unit 11; delivery 12
10. Sheet feeder 01; non-impact printing unit 06; intermediate dryer 07 with IR radiation source; offset printing unit 04; coating unit 08; dryer 09 with IR radiation source or hot air; delivery 12
11. Magazine feeder 01; primer application unit 02; non-impact printing unit 06; intermediate dryer 07 with IR radiation source; coating unit 08; dryer 09 with IR radiation source or hot air; delivery 12
12. Magazine feeder 01; primer application unit 02; non-impact printing unit 06; intermediate dryer 07 with IR radiation source; dryer 09 with IR radiation source or hot air; mechanical further processing unit 11; delivery 12
13. Magazine feeder 01; non-impact printing unit 06; intermediate dryer 07 with UV radiation source; coating unit 08; dryer 09 with UV radiation source; delivery 12

At least one of the processing stations 01; 02; 03; 04; 07; 08; 09; 11; 12 cooperating with the at least one non-impact printing unit 06 is selected for inclusion in the processing of the sheets based upon whether the printing ink to be applied to the sheet, in particular with the non-impact printing unit 06, is a water-based printing ink or ink, or as a UV-curing printing ink or ink. The respective machine arrangement is therefore configured to print each of the sheets with a water-based printing ink or with UV-curing printing ink.

Additional machine arrangements that will be described in detail in conjunction with FIGS. 27 and 28 and that include a selection from the set of processing stations 01; 02; 03; 04; 06; 07; 08; 09; 11; 12 described above provide production lines that have, e.g. essentially the following processing stations: sheet feeder 01; first primer application unit 02; first dryer 121; first non-impact printing unit 06; second dryer 122; second primer application unit 126; third dryer 123; second non-impact printing unit 127; fourth dryer 124; delivery 12.

One advantageous machine arrangement, mentioned here by way of example, comprises a plurality of processing stations for processing sheets, wherein a plurality of processing stations 01; 02; 03; 04; 06; 07; 08; 09; 11; 12 are arranged in succession in transport direction T of the sheets for the inline processing of these sheets, wherein at least one of these processing stations 06 is embodied as a non-impact printing unit 06, and wherein a first processing station 01 situated upstream of the non-impact printing unit 06 in transport direction T of the sheets is embodied as a sheet feeder 01 or a magazine feeder 01, wherein a processing station 08 located between the first processing station 01 and the non-impact printing unit 06 is embodied as a first coating unit 08 for applying a coating to each of the sheets, wherein between the first coating unit 08 and the non-impact printing unit 06 a first dryer 07 is located, wherein a first conveyor belt 17 is arranged for transporting the sheets from the first dryer 07 to the non-impact printing unit 06, wherein a second dryer 07 is located downstream of the non-impact printing unit 06 in transport direction T of the sheets, wherein a device for transferring the sheets coming from non-impact printing unit 06 to a second coating unit 08 is provided, wherein a third dryer 09 is located downstream of the second coating unit 08, and wherein a delivery 12 for the sheets is located downstream of the third dryer 09 in transport direction T of the sheets. A mechanical further processing unit 11 may also be arranged between the third dryer 09 and the delivery 12. Additionally, e.g. a coating unit 03 for applying a cold foil is located upstream of the non-impact printing unit 06 in transport direction T of the sheets. Non-impact printing unit 06 preferably has a plurality of individually controlled inkjet printers along the transport path of the sheets. In the operative zone of non-impact printing unit 06, the sheets are preferably each guided horizontally and lying flat on a transport device 22, wherein in each case, transport device 22 has a linear transport path or a curved transport path for the sheets, at least in the operative zone of non-impact printing unit 06, the curved transport path being formed by a concave or convex arcuate line lying in a vertical plane and having a radius within a range of 1 m to 10 m. In transport direction T of the sheets, upstream of non-impact printing unit 06, e.g. a transfer device is located, wherein the transfer device aligns each of the sheets, at least in terms of its axial register and/or its circumferential register, true to register relative to the print position of non-impact printing unit 06, the transfer device having, e.g. a suction drum 32 that holds each of the sheets by means of suction air. This machine arrangement is configured in particular for printing each of the sheets with a water-based printing ink or with a UV-curing printing ink. This machine arrangement is configured, in particular, for producing various packaging materials. The device used for transferring the sheets coming from non-impact printing unit 06 to the second coating unit 08 is embodied, e.g. as a rocking gripper 19 and a transfer drum 31 cooperating with rocking gripper 19.

Figure 2:
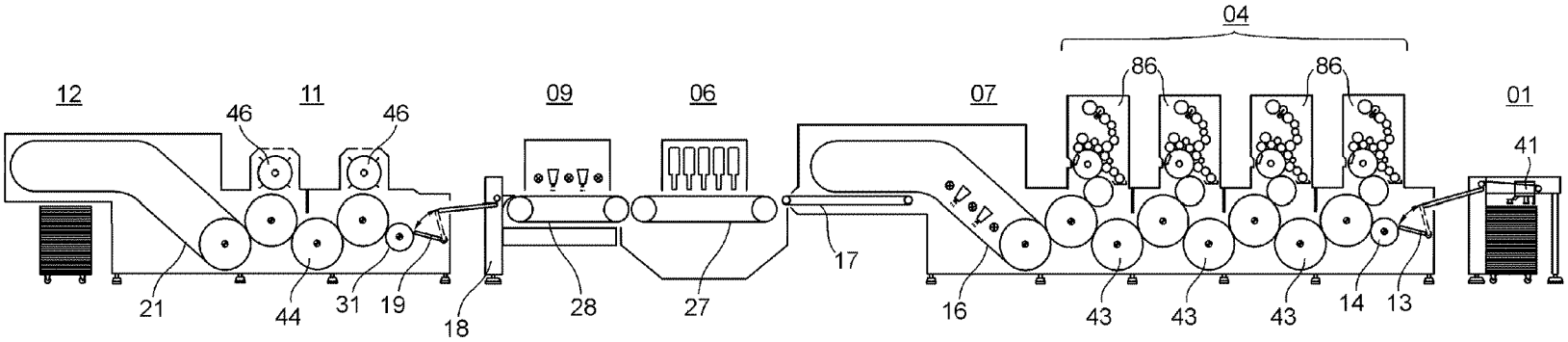
FIG. 2 a first machine arrangement having a plurality of different processing stations.

FIG. 2 shows an example of a machine arrangement having a plurality of processing stations 01; 02; 03; 04; 06; 07; 08; 09; 11; 12 according to the aforementioned production line No. 6. Sheets are picked up individually from a pile, e.g. by a suction head 41, in a sheet feeder 01, and are transferred in succession in a cycle of, e.g. 10,000 sheets per hour to an offset printing unit 04 which has, e.g. four printing couples 86 arranged in a row. To transfer the sheets from one of the printing couples 86 arranged in a row to the next, a rotary body is provided, in particular a cylinder, preferably a transfer drum 43, in each case arranged between two immediately adjacent printing couples 86. Offset printing unit 04 receives the sheets fed to it from sheet feeder 01, e.g. with a first rocking gripper 13 and passes the sheets on to a first transfer drum 14 of offset printing unit 04, after which the sheets are fed in a gripper closure in the offset printing unit 04 from one printing couple 86 to the next. In offset printing unit 04, the sheets are printed on at least one side. If a turning device is provided, the sheets may also be printed on both sides in offset printing unit 04, i.e. in a recto-verso printing process. After passing through processing station 04, embodied here, e.g. as offset printing unit 04, the sheet in question, preferably printed in four colors, is transferred by means of a first gripper system 16, in particular a first chain conveyor 16 and at least one first conveyor belt 17, to a non-impact printing unit 06, with the first gripper system 16 and the first conveyor belt 17 cooperating in the transfer of the sheets to non-impact printing unit 06, specifically in such a way that the first gripper system 16 delivers each of the sheets to the first conveyor belt 17, and the sheets are transferred from the first conveyor belt 17 to non-impact printing unit 06. Non-impact printing unit 06 preferably has a plurality of inkjet printers, e.g. five, arranged in a linear row, with each inkjet printer being individually controlled, in particular. The sheets, which have been provided with at least one static print image in offset printing unit 04 and with at least one varying or at least variable print image in non-impact printing unit 06, are then dried in a dryer 07 or intermediate dryer 07, preferably with an IR radiation source. After drying, the sheets are further processed in a mechanical further processing unit 11, e.g. by punching and/or creasing and/or the stripping of blanks from the respective sheet. Finally, the sheets, and/or the blanks separated from the sheets, are collected, in particular stacked, in a delivery 12. In the operative zone of the first gripper system 16 or of the first chain conveyor 16, a delivery 12, in particular a multi-pile delivery, can be provided along the transport path provided for the sheets. Likewise provided in transport direction T of the sheets, e.g. downstream of mechanical further processing unit 11, is a multi-pile delivery.

The sheets picked up from a pile in feeder 01, in particular in sheet feeder 01, are transported individually, spaced apart from one another, through offset printing unit 04 at a first transport speed. The sheets transferred from offset printing unit 04 to non-impact printing unit 06 are transported in this non-impact printing unit 06 at a second transport speed, the second transport speed used in non-impact printing unit 06 typically being slower than the first transport speed used in offset printing unit 04. To adapt the first transport speed used in offset printing unit 04 to the typically slower second transport speed used in non-impact printing unit 06, the sheet gap, for example, between immediately sequential sheets, i.e. the distance produced, e.g. as a result of a gripper channel width for the sheets transported in the gripper closure through offset printing unit 04, is preferably reduced during the transfer of these sheets from offset printing unit 04 to non-impact printing unit 06, with such a reduction in distance ranging, e.g. between 1% and 98% of the original distance. Immediately sequential sheets are thus also transported spaced apart from one another in non-impact printing unit 06, but typically with a smaller sheet gap or with a shorter distance than in offset printing unit 04, and consequently also at a slower second transport speed. This second transport speed is preferably maintained when sheets that have been printed in non-impact printing unit 06 are transported first to an intermediate dryer 07 or dryer 09 and from there, e.g. by means of a feed table 18, on to a mechanical further processing unit 11 and on to delivery 12. However, the sheets can also be brought from their second transport speed to a third transport speed, if required, e.g. by mechanical further processing unit 11, in which case the third transport speed is typically faster than the second transport speed and again corresponds, e.g. to the first transport speed used in offset printing unit 04. In mechanical further processing unit 11, e.g. a second rocking gripper 19 is provided, which picks up the sheets coming from intermediate dryer 07 or dryer 09 from feed table 18, and transfers these, e.g. to a second transfer drum 31, located in the region of mechanical further processing unit 11, after which the sheets are transported, e.g. by means of a gripper closure, through the region of mechanical further processing unit 11. In the region of mechanical further processing unit 11, which includes, e.g. a plurality of processing mechanisms 46 arranged in a row, a rotary body, in particular a cylinder, preferably a transfer drum 44, is provided, in each case arranged between two adjacent processing mechanisms 46, for the purpose of transferring the sheets from one of the processing mechanisms 46 arranged in a row to the next. One of processing mechanisms 46 is configured, e.g. as a punching mechanism, while another processing mechanism 46 is configured, e.g. as a creasing mechanism. The processing mechanism 46 in question is configured for carrying out the mechanical further processing of the sheets preferably in cooperation with a cylinder for transporting the respective sheets. Once they have been processed mechanically, the sheets and/or the blanks that have been separated from them are transported, e.g. by means of a second chain conveyor 21 to delivery 12, where they are collected, preferably stacked.

The sheets are transported from the output of offset printing unit 04 at least up to the output of intermediate dryer 07 or dryer 09, preferably on to the start of mechanical further processing unit 11, in each case by means of a multi-part transport device 22, i.e. consisting of a plurality of modules, in particular transport units, arranged one after the other in transport direction T of the sheets, wherein transport device 22 transports each of the sheets oriented lengthwise in transport direction T and preferably lying horizontally flat, at least in the operative zone of non-impact printing unit 06 situated between offset printing unit 04 and intermediate dryer 07 or dryer 09, along a linear transport path. The linear transport path and the flat horizontal transport are preferably continued during transport of the sheets through the intermediate dryer 07 or dryer 09 situated downstream of non-impact printing unit 06. If necessary, an intermediate dryer 07 or a dryer 09 may also be located between offset printing unit 04 and non-impact printing unit 06.

FIGS. 3 to 8 schematically illustrate additional machine arrangements by way of example, each including a plurality of processing stations 01; 02; 03; 04; 06; 07; 08; 09; 11; 12, in which the respective reference signs denote the processing stations 01; 02; 03; 04; 06; 07; 08; 09; 11; 12 described above, along with additional of these units.

Figure 3:
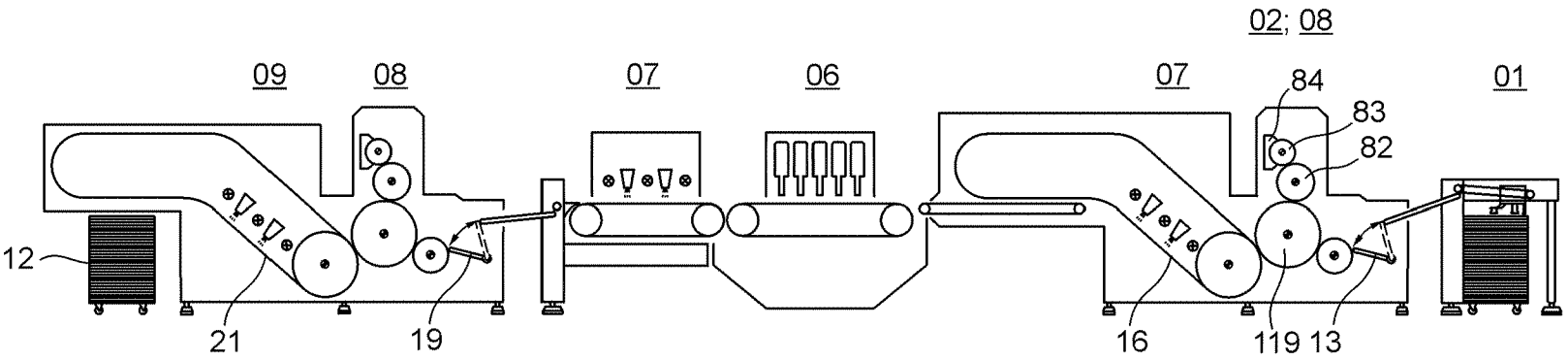
FIGS. 3 to 8 additional machine arrangements, each having a plurality of different processing stations.

FIG. 3 shows a machine arrangement having the following processing stations 01, 02; 03; 04; 06; 07; 08; 09; 11; 12 arranged one behind the other in transport direction T of the printing substrate: sheet feeder 01; primer application unit 02 or coating unit 08; intermediate dryer 07; non-impact printing unit 06; intermediate dryer 07; coating unit 08; dryer 09; delivery 12.

Figure 4:
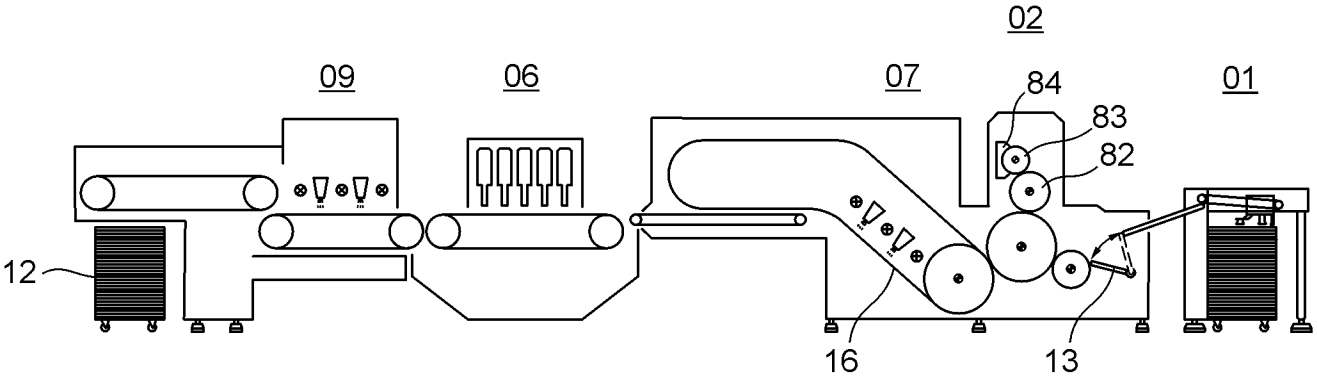

FIG. 4 shows a machine arrangement having the following processing stations 01; 02; 03; 04; 06; 07; 08; 09; 11; 12 arranged one behind the other in transport direction T of the printing substrate: sheet feeder 01; primer application unit 02; intermediate dryer 07; non-impact printing unit 06; dryer 09; delivery 12.

Figure 5:
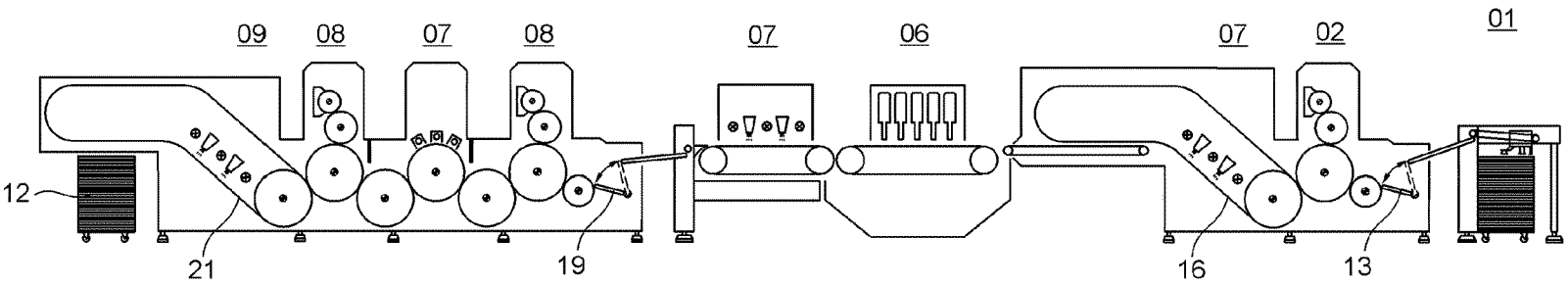

FIG. 5 shows a machine arrangement having the following processing stations 01, 02; 03; 04; 06; 07; 08; 09; 11; 12 arranged one behind the other in transport direction T of the printing substrate: sheet feeder 01; primer application unit 02; intermediate dryer 07; non-impact printing unit 06; intermediate dryer 07; coating unit 08; intermediate dryer 07; coating unit 08; dryer 09; delivery 12.

Figure 6:
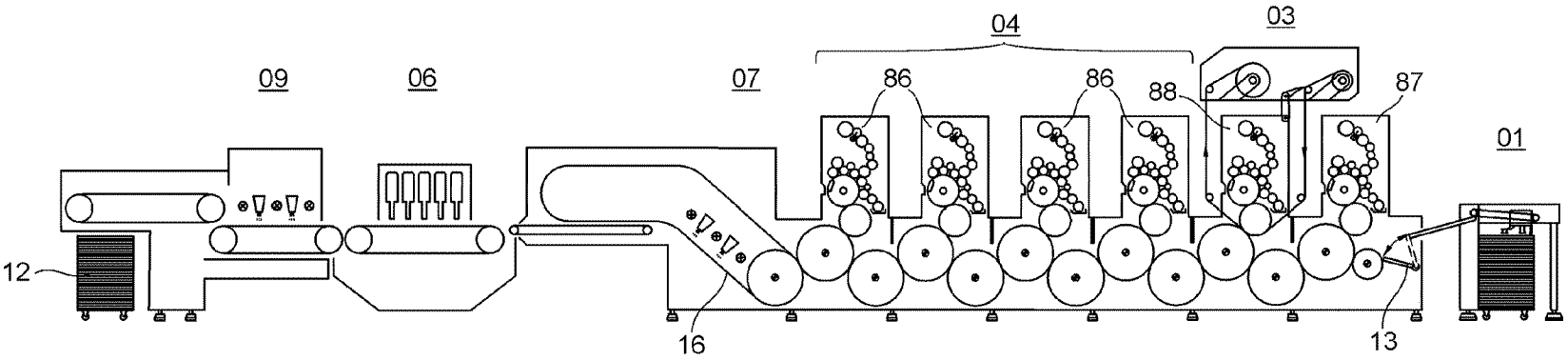

FIG. 6 shows a machine arrangement having the following processing stations 01, 02; 03; 04; 06; 07; 08; 09; 11; 12 arranged one behind the other in transport direction T of the printing substrate: sheet feeder 01; a first offset printing unit 04; cold foil application unit 03, four additional offset printing units 04 in a unit-based structure; intermediate dryer 07; non-impact printing unit 06; intermediate dryer 07; non-impact printing unit 06; dryer 09; delivery 12.

Figure 7:
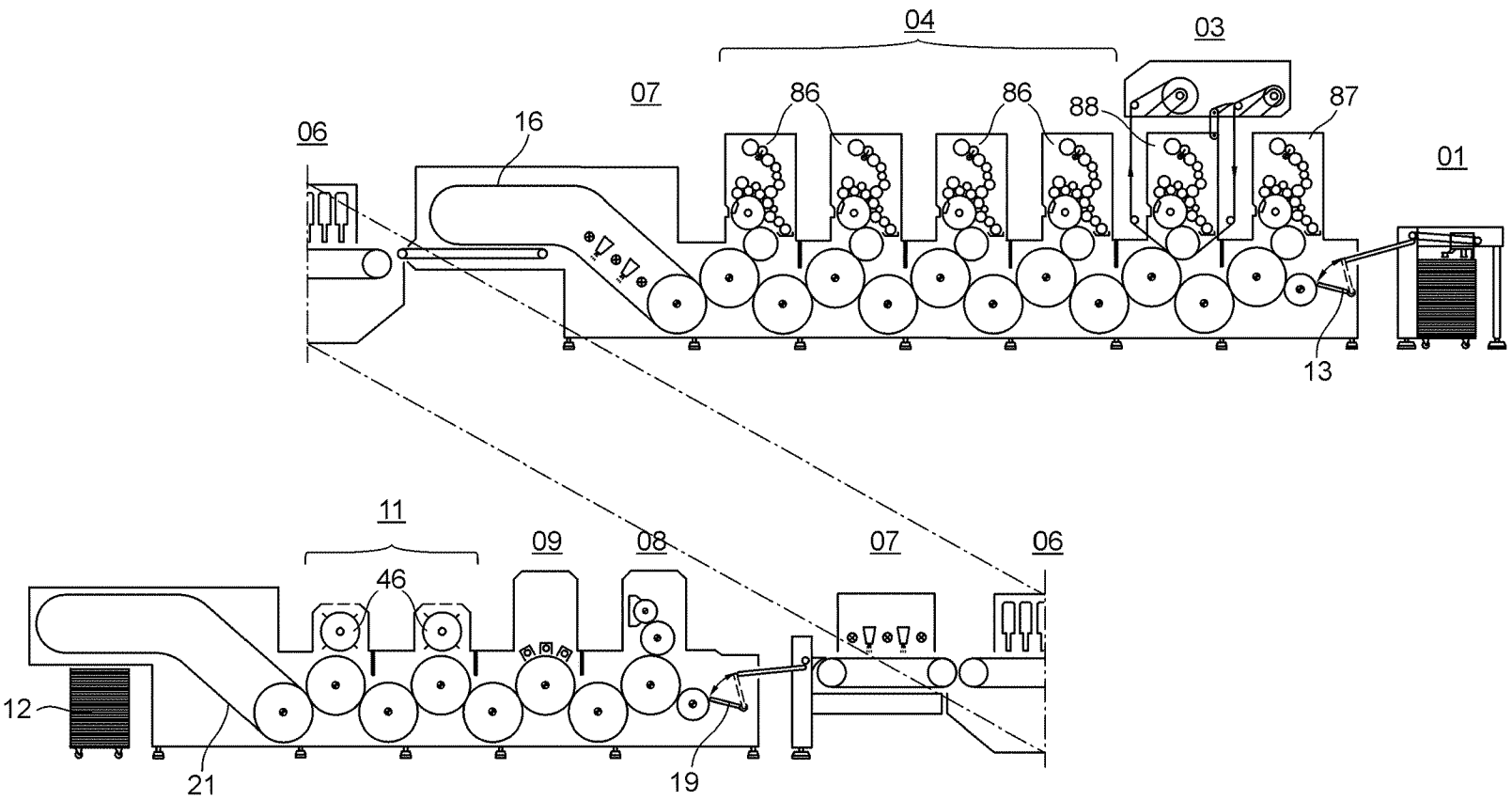

FIG. 7 shows a machine arrangement having the following processing stations 01, 02; 03; 04; 06; 07; 08; 09; 11; 12 arranged one behind the other in transport direction T of the printing substrate, with the machine arrangement being shown offset in the diagram due to its length: sheet feeder 01; a first offset printing unit 04; cold foil application unit 03; four additional offset printing units 04 in a unit-based structure; intermediate dryer 07; non-impact printing unit 06; intermediate dryer 07; coating unit 08; dryer 09, two mechanical further processing units 11 in a unit-based structure; delivery 12.

Figure 8:
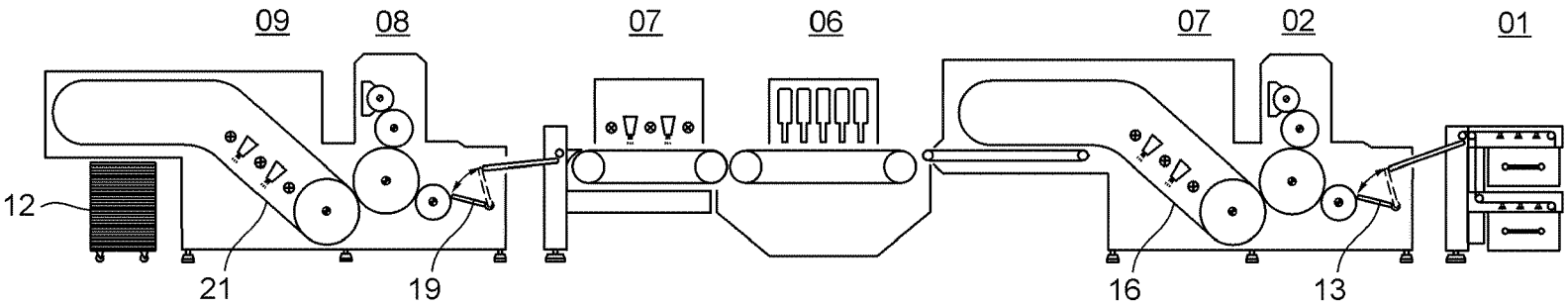
Figure 9:
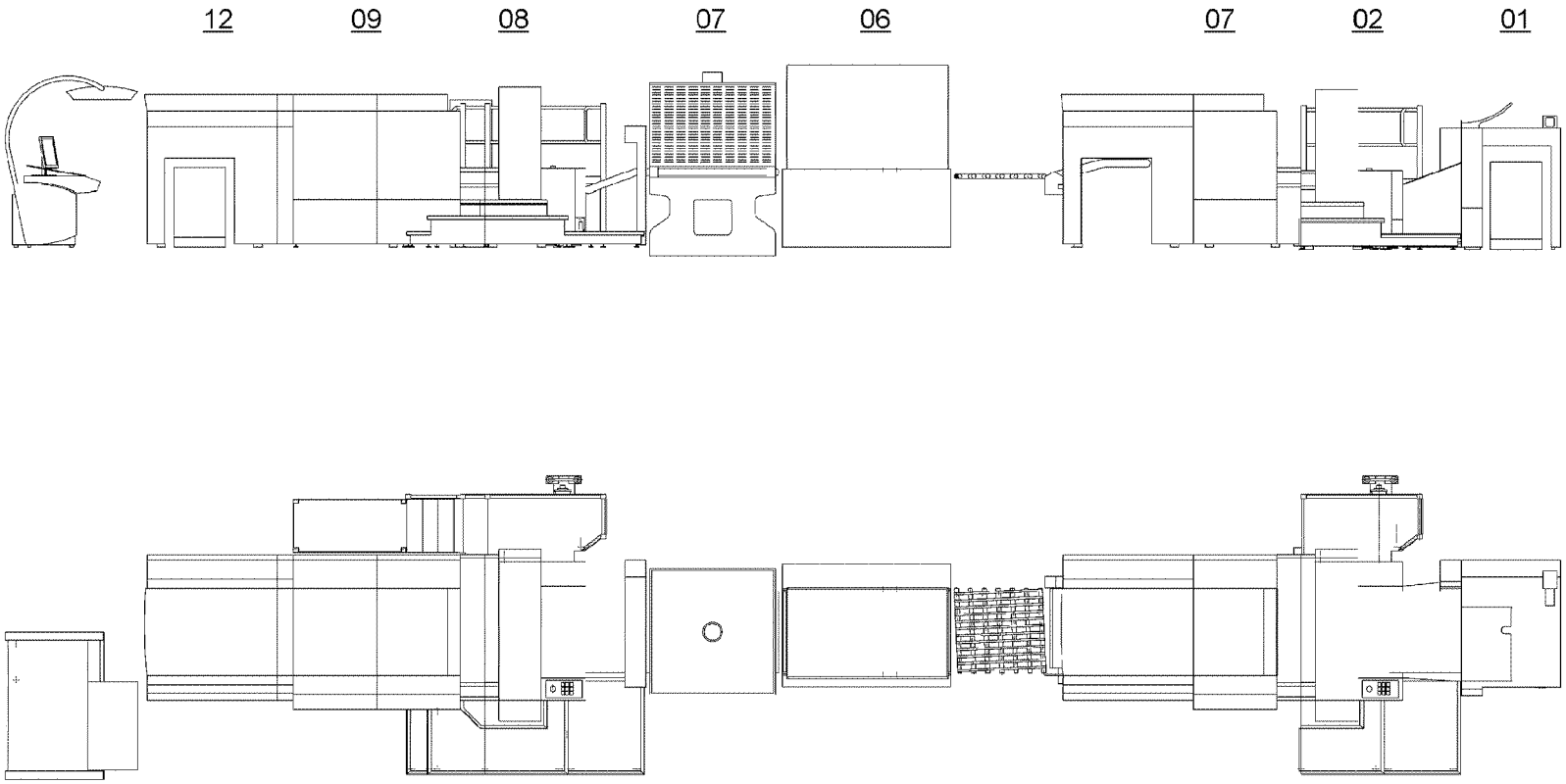
FIG. 9 the machine arrangement of FIG. 8 from a plan view and a side view.

FIG. 8 shows a machine arrangement having the following processing stations 01, 02; 03; 04; 06; 07; 08; 09; 11; 12 arranged one behind the other in transport direction T of the printing substrate: magazine feeder 01; primer application unit 02; intermediate dryer 07; non-impact printing unit 06; intermediate dryer 07; coating unit 08; dryer 09; delivery 12. FIG. 9 shows this specific machine arrangement from a plan view and from a side view.

Figure 10:
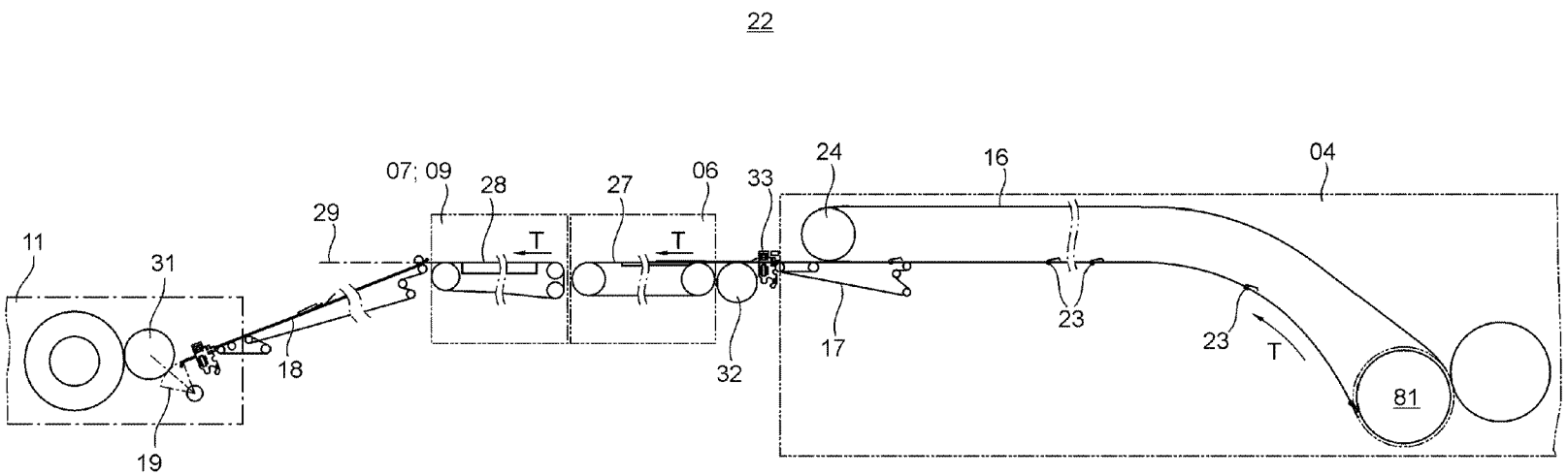
FIG. 10 a transport device comprising multiple parts.

FIG. 10 shows in even greater detail the aforementioned multi-part transport device 22, which is preferably provided for use in a machine arrangement that includes a plurality of processing stations 01; 02; 03; 04; 06; 07; 08; 09; 11; 12 for the processing of sheets. At the output of processing station 04, embodied, e.g. as offset printing unit 04, a gripper system 16, in particular a first chain conveyor 16 having at least one revolving chain, is provided, which has a plurality of gripper bars or preferably a plurality of gripper carriages 23, preferably spaced equidistant along its at least one revolving chain, wherein each of the sheets to be transported is preferably held at its front edge in transport direction T, i.e. at its leading edge, by one of the gripper carriages 23 and transported along the transport path defined by the path of the chain. For holding a sheet, each of the gripper carriages 23 is equipped with controlled or at least controllable holding means 79 (FIG. 15), in particular with grippers, e.g. each in the form of a clamping device which is controllable in terms of the clamping force exerted by it. The distance between successive gripper carriages 23 in the transport direction T of the sheets ranges, e.g. from 700 mm to 1,000 mm. The at least one chain of the first chain conveyor 16 revolves on a sprocket 24 located at the outlet of offset printing unit 04, in particular along a semicircular path thereon. A region in which the first chain conveyor 16 receives sheets from a processing station embodied, e.g. as an offset printing unit 04 forms a receiving region of said first chain conveyor 16, whereas a region in which the first chain conveyor 16 delivers sheets, e.g. to another transport device, in particular for transport to a processing station 06 embodied as a non-impact printing unit 06, forms a transfer region of said first chain conveyor 16. A first sprocket 81 located in the receiving region of the first chain conveyor 16 is preferably configured as a drive wheel which sets the at least one chain in motion, whereas the second sprocket 24 located at the outlet of offset printing unit 04, in particular in the transfer region of the first chain conveyor 16, is preferably configured as a deflecting wheel for deflecting the at least one chain. In a region extending approximately the length of one sheet, below the at least one arranged sprocket 24 located at the outlet of offset printing unit 04, in particular below the second sprocket 24 located in the transfer region of the first chain conveyor 16, at least one suction chamber 26 is provided for holding a sheet that is being transported, i.e. guided past, by one of the gripper carriages 23. Preferably, a plurality of individually controlled or at least individually controllable suction chambers 26 are arranged at said location in transport direction T of the sheets. As indicated by the reference to the aforementioned other transport device, in this region, below the at least one sprocket 24 located at the outlet of offset printing unit 04, e.g. at least one first conveyor belt 17 revolving in transport direction T of the sheets for receiving and for further transporting a sheet removed from the first chain conveyor 16 is provided, with each sheet received from this first conveyor belt 17 preferably being transported further in the direction of non-impact printing unit 06.

In the operative zone of the non-impact printing unit 06 located between offset printing unit 04 and intermediate dryer 07 or dryer 09, a second revolving conveyor belt 27 is preferably provided, on which the sheets are transported in succession, each preferably lying flat horizontally, along a linear transport path. The transfer device is arranged in particular between first conveyor belt 17 and second conveyor belt 27. Also preferably provided in the operative zone of intermediate dryer 07 or dryer 09 is a third revolving conveyor belt 28, on which the sheets received from non-impact printing unit 06 are transported in succession, each preferably lying flat horizontally, along a linear transport path. The third conveyor belt 28 transfers the sheet which has been transported through the intermediate dryer 07 or dryer 09 to feed table 18, from which the sheets are transported in succession, preferably to mechanical further processing unit 11. The first conveyor belt 17, the second conveyor belt 27 and the third conveyor belt 28 preferably transport the sheets within the same, e.g. horizontal transport plane 29, in particular configured as a flat surface. The transport device 22 for transporting sheets in a machine arrangement composed of processing stations, each for processing sheets, thus comprises at least three transport units, specifically the first gripper system 16 or the first chain conveyor 16, the first conveyor belt 17 and the second conveyor belt 27. The first chain conveyor 16 and the first conveyor belt 17 are arranged so as to cooperate for the purpose of transferring a sequence of sheets from a first processing station to a second processing station, preferably immediately following the first processing station in transport direction T of the sheets. The sequence of sheets is transferred from the first conveyor belt 17 to the second conveyor belt 27, which belongs to the next processing station. A third conveyor belt 28 is preferably also provided, in which case the sequence of sheets is transferred from the second conveyor belt 27 to the third conveyor belt 28, which belongs to a third processing station, preferably immediately downstream of the second processing station in transport direction T of the sheets. If the transport paths of the first conveyor belt 17 and/or of the second conveyor belt 27 or optionally of the third conveyor belt 28 are not aligned linearly and/or are not aligned horizontally, the conveyor belts 17; 27; 28 of transport device 22 each transport the sheets along a curved transport path, in particular along a concave or convex arcuate line, lying in a vertical plane and having a radius of at least 1 m, preferably having a radius ranging from 2 m to 10 m, in particular having a radius ranging from 3 m to 5 m. Each of conveyor belts 17; 27; 28 is preferably embodied as a suction belt conveyor, i.e. as a conveyor belt having at least one suction chamber 26 for suctioning a respective sheet during its transport. With the conveyor belts 17; 27; 28 that have a plurality of suction chambers 26 along the transport path provided for the sheets, these suction chambers 26 are preferably controllable individually and/or preferably independently of one another in terms of the action of their respective suction air. Along the curved transport path, a plurality of individually controlled non-impact printing units 06 are preferably arranged, each of the plurality of non-impact printing units 06 being embodied, e.g. as an inkjet printer. The conveyor belts 17; 27; 28 of transport device 22 each consist, e.g. of a plurality of parallel individual belts, arranged side by side orthogonally to the transport path intended for the sheets, and thus each extending lengthwise to the transport path intended for the sheets. In contrast to gripper system 16, a conveyor belt 17; 27; 28 is to be understood as a gripperless transport device, in which the conveyor belt 17; 27; 28 in question is configured as revolving continuously between at least two deflecting devices.

Figure 11:
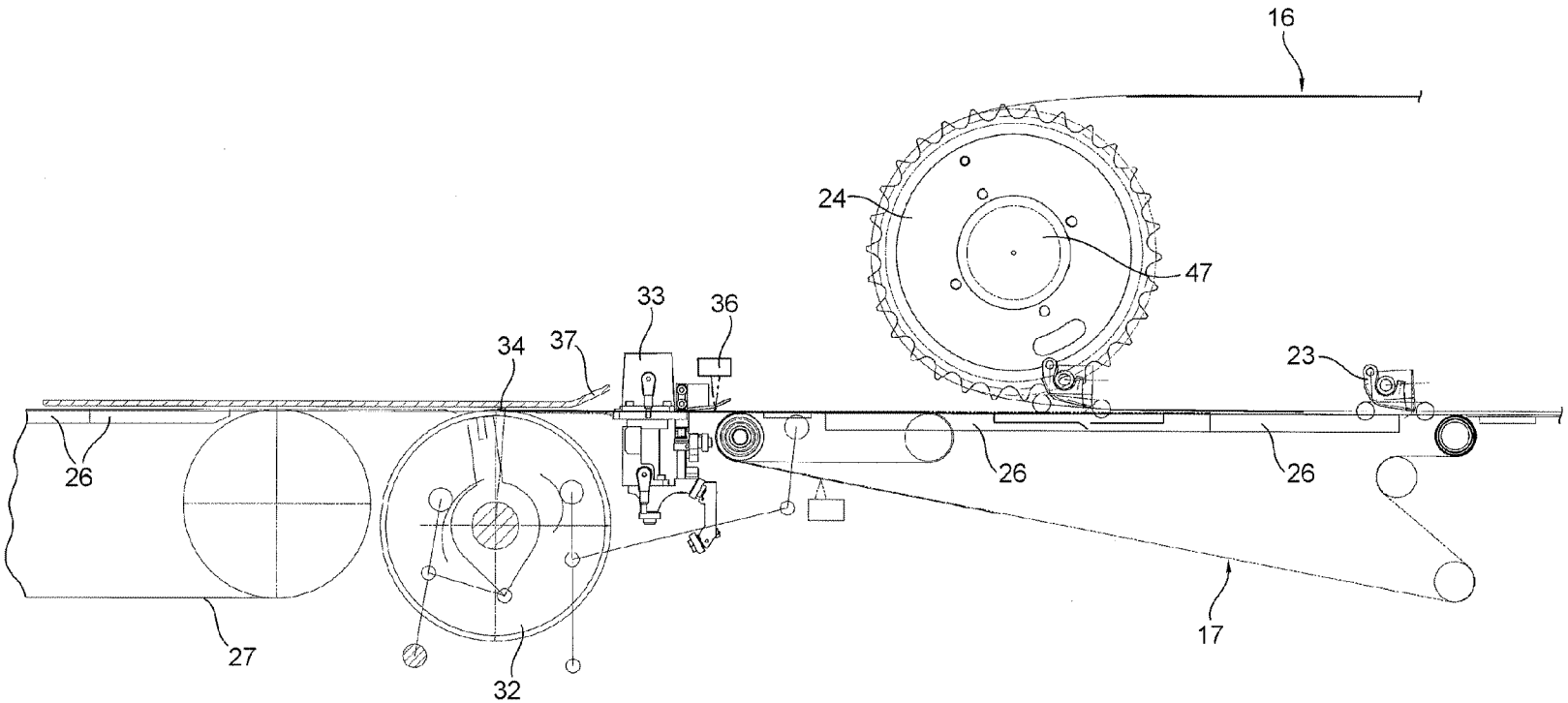
FIG. 11 an enlarged view of a first detail of FIG. 10.

FIG. 11 shows a cross-sectional enlargement of a number of details of the transport device 22 described above in reference to FIG. 10. In one particularly advantageous embodiment, in the region where the sheets are transferred from the first conveyor belt 17 to the second conveyor belt 27, a transfer device, preferably including a suction drum 32, is arranged orthogonally to transport direction T of the sheets. Suction drum 32 preferably consists of a plurality of suction rings 76, e.g. six, arranged parallel to one another on a common shaft 89. In one preferred embodiment of suction drum 32, suction air is or can be applied to each of the suction rings 76 thereof individually, which has the advantage that the effective width of suction drum 32, aligned axially along said suction drum 32, is adjusted or can be adjusted as needed, in particular based upon the format of the sheet being used. Suction drum 32 preferably has on its periphery at least one stop 34, protruding into the transport plane 29 of the sheets, wherein a stop surface of stop 34 in question extends in each case axially to suction drum 32 and preferably vertically to the preferably horizontal transport plane 29. Suction drum 32 has either one stop 34 which is continuous in the axial direction of the drum, and preferably has two stops 34 spaced apart in the axial direction of the drum. In order for the same suction drum 32 to be usable for sheets of multiple different format widths, on a suction drum 32 having a plurality of suction rings 76, at least one stop 34 is preferably arranged on each suction ring 76. Suction drum 32 is mounted so as to be rotatably and axially movable. Suction drum 32 has a first drive for its circumferential movement and a second drive for its axial movement, the circumferential movement and the axial movement being controlled independently of one another by a control unit. The circumferential movement and/or the axial movement of suction drum 32 are controlled by the control unit in response to a position signal, which is generated by a first sensor 33, situated upstream of suction drum 32 in transport direction T of the sheets, when said sensor detects the position of the next sheet to reach suction drum 32, and which is forwarded by said first sensor to the control unit. The task of suction drum 32 is to align sheets that are fed to it true to register, and to feed these sheets in their aligned state to another processing station, in particular to non-impact printing unit 06, so that the sheets can be further processed there. Thus, in the preferred embodiment, suction drum 32 aligns each of the sheets to be fed to the operative zone of non-impact printing unit 06, true to register relative to the print position of non-impact printing unit 06, e.g. using the at least one stop 34 protruding into transport plane 29 of the sheet in question and/or by an axial displacement of said suction drum 32 which is holding the sheet in question. A sheet gripped by suction drum 32, preferably by means of suction air, i.e. by means of a vacuum, is aligned by means of the axial movement of said suction drum 32, in particular laterally to its transport direction T, said movement being controlled based upon the position signal generated by the first sensor 33. Suction drum 32 grips an aligned sheet in particular by means of pulsed suction air, i.e. the suction air is switched on and off again rapidly by the control unit, e.g. in specific angular positions of suction drum 32 that are preferably dependent upon the transport speed and/or position of the sheets. An alignment in transport plane 29 of the leading edge of the sheet in question perpendicular to transport direction T is preferably achieved by said edge striking against the at least one stop 34 of suction drum 32. Optionally, at least one lateral stop is also provided, e.g. in the transfer device, against which a sheet to be aligned strikes with an edge extending parallel to its transport direction T. The first sensor 33 is embodied, e.g. as an optical sensor, in particular as a line sensor, preferably as a CCD line sensor. To generate the position signal, the first sensor 33 preferably detects an edge of the sheet in question, extending lengthwise along transport direction T of the sheet, or detects marks arranged on the sheet, in which case the marks are arranged within the printed image on said sheet or outside of the printed image in question. A second sensor 36, preferably situated upstream of the first sensor 33 in the transport direction T of the sheets, and preferably likewise connected to the control unit, detects, e.g. the leading edge and optionally also the number of sheets transported from the first conveyor belt 17 to the second conveyor belt 27. The second sensor 36 preferably detects a leading edge of each of the sheets in the transport direction T of the sheets and is used primarily for monitoring the arrival of sheets. The second sensor 36 is embodied, e.g. as an optical sensor, in particular as a reflex scanner or as a light scanner. In cooperation with suction drum 32, e.g. at least one guide element 37 is provided, extending in the direction of the operative zone of non-impact printing unit 06, i.e. in the direction of the second conveyor belt 27, preferably linearly, in particular lengthwise along the transport path of the sheets, the guide element 37 in question together with the lateral surface of suction drum 32 forming a gap, into which the sheets coming from the first conveyor belt 17 are inserted. In the region of the first conveyor belt 17 and optionally also in the region of the second conveyor belt 27, e.g. one or more suction chambers 26, each preferably being controllable, e.g. by the control unit, are provided. Suction chambers 26 may be part of the transport device 22. In one preferred embodiment, with the inclusion of at least one suction chamber 26 of the first conveyor belt 17, sheets are aligned laterally by the axial displacement of suction drum 32, in particular following alignment of the sheet in question along the at least one stop 34 and following a shutdown of the suction air in the last suction chamber 26 in transport direction T of the sheet in question. This lateral alignment of the sheet is temporally superimposed on the rotational movement of suction drum 32. Thus, the sheet to be transferred by suction drum 32 to a subsequent processing station 06; 07; 08; 09; 11; 12 does not remain idle in this transfer device at any time. Therefore, suction drum 32 aligns each of the sheets, at least in terms of their axial register and/or their circumferential register, true to register relative to a processing position of the processing station 01; 02; 03; 04; 06; 07; 08; 09; 11; 12 located downstream of suction drum 32.

With a machine arrangement having a plurality of processing stations for processing sheets, in which in transport direction T of the sheets a plurality of processing stations 01; 02; 03; 04; 06; 07; 08; 09; 11; 12 are arranged in succession for the inline processing of these sheets, wherein at least one of these processing stations 06 is embodied as a non-impact printing unit 06, e.g. a first alignment device is situated upstream of the first processing station 01; 02; 03; 04; 06; 07; 08; 09; 11; 12 in transport direction T of the sheets, said first alignment device aligning each of the sheets true to register, at least in terms of its axial register and/or in terms of its circumferential register, relative to a processing position of the first processing station 01; 02; 03; 04; 06; 07; 08; 09; 11; 12. Also situated between non-impact printing unit 06 and a processing station 01; 02; 03; 04; 07; 08; 09; 11; 12 located downstream of non-impact printing unit 06 in transport direction T of the sheets is, e.g. an additional alignment device, said additional alignment device aligning each of the sheets true to register, at least in terms of its axial register and/or in terms of its circumferential register, relative to a processing position of the processing station 01; 02; 03; 04; 07; 08; 09; 11; 12 located downstream of non-impact printing unit 06.

Suction drum 32, located in particular in the transfer device, is also used, e.g. to adjust the transport speed of the sheets to be transferred from offset printing unit 04 to non-impact printing unit 06. Since the second transport speed used in non-impact printing unit 06 is typically slower than the first transport speed used in offset printing unit 04, suction drum 32 first decelerates the sheets fed to it in succession at the first transport speed by offset printing unit 04 by the leading edge of each sheet first striking the at least one stop 34; if necessary, the suction drum then aligns the sheets, which are held by suction, at least laterally, i.e. in response to a corresponding position signal from the first sensor 33 that indicates a need for correction, by an axial movement of suction drum 32, which holds the sheet in question, and then accelerates or decelerates the gripped sheet by a rotation of said suction drum 32 to the second transport speed required in the non-impact printing unit 06, and the sheet in question is released by suction drum 32, e.g. when said sheet reaches the second transport speed, after which suction drum 32 is brought to its rotational and/or axial operating position required for it to grip the next sheet. Suction drum 32 thus preferably rotates, e.g. non-uniformly in each of its revolutions. Position information about the leading edge of the sheets, which is necessary for controlling the rotational position of suction drum 32, is provided by an angular position sensor 47, e.g. disposed on a sprocket 24, or alternatively by an angular position sensor of offset printing unit 04, in particular of the printing machine.

As has already been mentioned, the above-described machine arrangements, each of which has a plurality of processing stations 01; 02; 03; 04; 06; 07; 08; 09; 11; 12 for processing sheets and at least one transport device for transporting these sheets, are provided for processing sheets of different formats, i.e. of different lengths and/or widths. The typically rectangular sheets therefore differ, e.g. in terms of length, the length thereof extending in transport direction T of these sheets. To avoid any loss in the productivity of a machine arrangement using a processing station 02; 03; 04; 06; 07; 08; 09; 11; 12 embodied in particular as a non-impact printing unit 06 to which sheets are fed sequentially, with comparatively shorter sheets, i.e. with sheets of smaller format than larger format sheets that are otherwise processed in said machine arrangement, a method having the following steps is proposed:

A method for operating a transport device for feeding a plurality of sheets sequentially to a processing station 02; 03; 04; 06; 07; 08; 09; 11; 12, in which sheets of different lengths, each extending lengthwise in transport direction T of these sheets, are used for processing by means of the same processing station 02; 03; 04; 06; 07; 08; 09; 11; 12, wherein the sheets to be fed in succession to the processing station 02; 03; 04; 06; 07; 08; 09; 11; 12 are each transported by the transport device spaced apart, wherein the transport device impresses a transport speed onto each of the sheets to be transported, wherein the distance between immediately sequential sheets for sheets of different lengths extending in transport direction T of these sheets is kept constant by an adjustment in the transport speed to be impressed by the transport device onto the sheet in question, wherein the transport speed of the subsequent sheet in transport direction T is adjusted relative to the transport speed of the sheet immediately preceding it. In this method, the sheets to be fed in succession to the processing station 02; 03; 04; 06; 07; 08; 09; 11; 12 in question are each transported by the transport device, preferably at a minimal distance, but typically at a distance not equal to zero, in order to achieve and/or maintain a high level of productivity of the processing stations 02; 03; 04; 06; 07; 08; 09; 11; 12. The distance between successive sheets in transport direction T, i.e. between the trailing edge of a preceding sheet extending transversely to transport direction T and the leading edge of the sheet immediately following it, extending transversely to the direction of transport T, lies e.g. within a range of between 0.5 mm and 50 mm, and is preferably less than 10 mm. If a sheet of shorter length will be processed in the processing station 02; 03; 04; 06; 07; 08; 09; 11; 12 in question following a sheet of greater length, the shorter sheet is accelerated by the transport device by increasing its transport speed. Conversely, a sheet of greater length is slowed down by the transport device by decreasing its transport speed when the sheet of greater length will be processed in the processing station 02; 03; 04; 06; 07; 08; 09; 11; 12 in question following a sheet of shorter length. As a processing station 02; 03; 04; 06; 07; 08; 09; 11; 12, a non-impact printing unit 06 is preferably used, the productivity of which is generally greatest when the sheets to be printed by it are fed to it in succession at a constant minimum distance, regardless of their respective format. If a processing station 04 embodied, e.g. as an offset printing unit 04 is situated upstream of the non-impact printing unit 06 in the machine arrangement in question, sheets printed in the offset printing unit 04 are fed to the transport device at the transport speed corresponding to a production speed of this offset printing unit 04, regardless of their respective format, wherein this transport speed defined for these sheets by the offset printing unit 04 is to be adapted during their transport by the transport device to the transport speed corresponding to the processing speed of the non-impact printing unit 06. If these sheets will be fed at a constant distance from one another, regardless of their respective format, to non-impact printing unit 06, sheets of greater length are decelerated less than shorter sheets, but in any case, a reduction in the respective transport speeds may be necessary because the processing speed of non-impact printing unit 06 is typically slower than the production speed of offset printing unit 04.

The respective sheet is preferably held by the transport device in a force-locking manner, e.g. by suction air, during its transport. The respective transport speed is preferably impressed onto each sheet by suction rings 76 of a suction drum 32 engaging onto said sheet, or by at least one continuously revolving suction belt 52; 78. In the preferred embodiment, the transport speed to be impressed onto the sheet in question is set by a preferably electronic control unit, wherein the control unit sets the transport speed, in particular to maintain the constant distance between successive sheets, in a control loop, as described above e.g. in conjunction with the rotational position control of suction drum 32, or e.g. in conjunction with a control device to which, e.g. optical sensors 33; 36 are connected, as will be described in greater detail in the following.

If the machine arrangements described above, each of which has a plurality of processing stations 01; 02; 03; 04; 06; 07; 08; 09; 11; 12 for the processing of sheets and at least two transport devices for the transport of these sheets, are used for transporting and processing pliable sheets, i.e. sheets of low rigidity, in particular thin sheets that cannot transmit shear forces, so that shear forces acting on such a sheet cause the sheet to undulate, then it is difficult to feed this type of sheet to the processing station 02; 03; 04; 06; 07; 08; 09; 11; 12 in question in a target position designated for said processing station 02; 03; 04; 06; 07; 08; 09; 11; 12.

Figure 12:
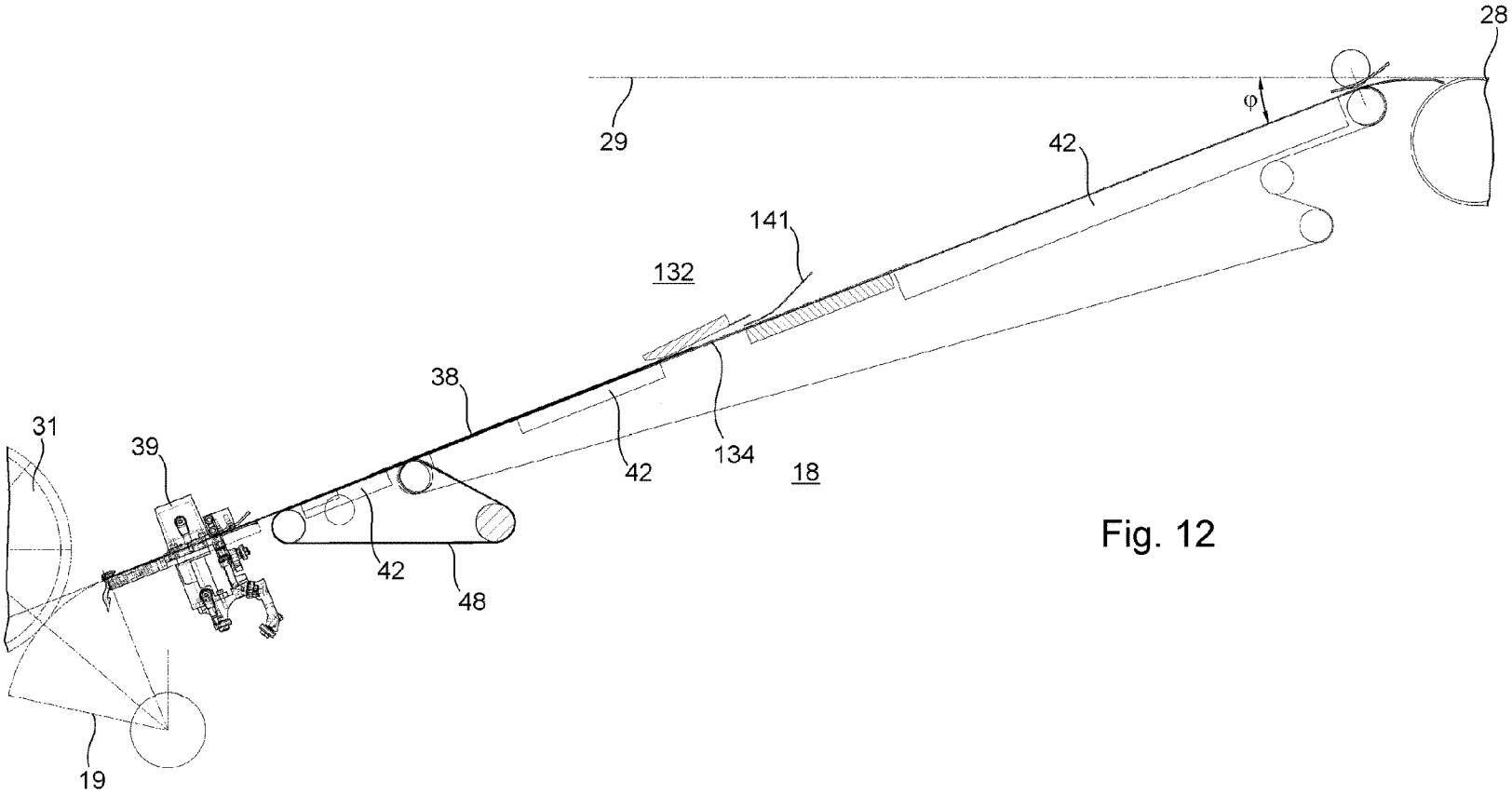
FIG. 12 an enlarged view of a second detail of FIG. 10.

Proposed, therefore, is a method for sequentially feeding a plurality of sheets into a processing station 02; 03; 04; 06; 07; 08; 09; 11; 12 for processing each of said sheets, in which a first transport device, located upstream of the processing station 02; 03; 04; 06; 07; 08; 09; 11; 12 in transport direction T of the sheets feeds each of the sheets to the processing station 02; 03; 04; 06; 07; 08; 09; 11; 12 at a first transport speed in a thrusting movement, wherein during the thrusting movement, the first transport device holds the respective sheet to be fed to said processing station 02; 03; 04; 06; 07; 08; 09; 11; 12 with at least one holding element, wherein the sheet in question fed to the processing station 02; 03; 04; 06; 07; 08; 09; 11; 12 is gripped by a second transport device associated with said processing station 02; 03; 04; 06; 07; 08; 09; 11; 12 and is transported in the gripped state at a second transport speed, wherein the first transport speed of the first transport device is slower than the second transport speed of the second transport device, wherein the holding element in question of the first transport device releases the sheet in question to be fed to the processing station 02; 03; 04; 06; 07; 08; 09; 11; 12 only after the second transport device has gripped said sheet which has been fed to the processing station 02; 03; 04; 06; 07; 08; 09; 11; 12 and has begun to transport said sheet. A non-impact printing unit 06 is preferably used as a processing station 02; 03; 04; 06; 07; 08; 09; 11; 12. The sheets are each transported in the first transport device and/or in the second transport device in particular in the same transport plane 29. A first, in particular continuously revolving conveyor belt 17 is used, for example, as the first transport device, and/or a second, in particular continuously revolving conveyor belt 27 is used as the second transport device, said conveyor belts 17; 27 each being embodied, e.g. as a suction belt. In an alternative embodiment of the holding elements, each of these is embodied as a suction ring 76 of a suction drum 32. A holding force is exerted by the relevant holding element of the first transport device onto the respective sheet to be fed to the processing station 02; 03; 04; 06; 07; 08; 09;

11; 12, said holding force being greater, at least briefly, than a tensile force simultaneously acting on said sheet, which is exerted by the second transport device. The first transport device preferably holds each sheet to be fed to the processing station 02; 03; 04; 06; 07; 08; 09; 11; 12 with the at least one holding element by means of a force-locking connection, e.g. by means of suction air. With the proposed method, the sheet to be fed to the processing station 02; 03; 04; 06; 07; 08; 09; 11; 12 is acted on by a tensile force and is thereby tautened despite the thrusting movement carried out by the first transport device. After the actual position of each of the sheets in the transport plane 29 has been checked, and if a deviation of the actual position from a target position intended for the sheet in question in the processing station 02; 03; 04; 06; 07; 08; 09; 11; 12 is detected, after the position of said sheet has been corrected, the sheets are preferably each transferred in the intended target position to the second transport device. FIG. 12 is an enlarged detail from FIG. 10 showing the transfer of sheets on feed table 18, in particular from the third conveyor belt 28 in the operative zone of intermediate dryer 07 or dryer 09 to the operative zone of mechanical further processing unit 11. Feed table 18 has, e.g. at least a fourth conveyor belt 38, which is preferably arranged inclined at an acute angle φ from the preferably horizontal transport plane 29. Also provided in conjunction with the fourth conveyor belt 38 is, e.g. a third sensor 39, which generates a position signal for each of the sheets being transported by the fourth conveyor belt 38, which it then sends to the control unit. It may be provided, for example, that a sheet to be fed to mechanical further processing unit 11 is brought from the second transport speed to the third transport speed by second rocking gripper 19 and second transfer drum 31, meaning that the sheet in question is accelerated, in particular, by the rotation of second transfer drum 31, controlled by the control unit. Also provided in the region of the fourth conveyor belt 38 are, e.g. one or more suction chambers 42, each of which is preferably controllable. In one preferred embodiment, at the transfer device for transferring the sheets, e.g. to mechanical processing device 11, these sheets are placed in an overlapping arrangement. In that case, the trailing region of a sheet being transported by the fourth conveyor belt 38 is lifted by means of pulsed blower air and is decelerated by the fourth conveyor belt 38 in conjunction with suction chamber 42. A subsequent sheet is then drawn underneath the sheet preceding it by the faster moving forward belt conveyor 48.

Therefore, preferably on the device for transferring the sheets, e.g. to mechanical further processing unit 11, a method for arranging sheets in an overlapping position in a transfer device located between a first processing station 01; 02; 03; 04; 06; 07; 08; 09; 11; 12 and a second processing station 01; 02; 03; 04; 06; 07; 08; 09; 11; 12, which follows the first processing station in transport direction T of the sheets, is carried out, in which the sheets to be overlapped are transported in succession in a transport plane 29, each lying individually, from the first processing station 01; 02; 03; 04; 06; 07; 08; 09; 11; 12 to the transfer device, and in which a trailing edge in transport direction T of each of the sheets coming from the first processing station 01; 02; 03; 04; 06; 07; 08; 09; 11; 12 is lifted relative to the transport plane 29 exclusively by means of blower air, and a subsequent sheet is pushed underneath the trailing edge of the sheet preceding it. The blower air preferably acts with at least 50% of its intensity in the direction of a surface normal in the transport plane 29 opposite the force of gravity. Advantageously, it is provided that additional blower air is blown opposite transport direction T of the sheets, substantially tangentially from above, at an acute angle of, e.g. 0° to 45° formed with the transport plane 29, i.e. said blower air is blown onto the surface of the sheets that faces away from transport plane 29 onto the sheets to be transported to the transfer device. In that case, the additional blower air directed opposite the transport direction T of the sheets emerges from a guide surface that forms a converging acute angle of, e.g. 0° to 45° with the transport plane 29 of the sheets, wherein nozzles, in particular, for emitting the blower air are arranged in the guide surface. The blower air acting opposite the force of gravity in the direction of the transport plane 29 is preferably pulsed by the control unit. Each sheet to be transported from the first processing station 01; 02; 03; 04; 06; 07; 08; 09; 11; 12 to the subsequent second processing station 01; 02; 03; 04; 06; 07; 08; 09; 11; 12 is held in transport plane 29 by means of suction air preferably acting in the leading half of the sheets in transport direction T. The suction air used to hold the sheets to be transported from the first processing station 01; 02; 03; 04; 06; 07; 08; 09; 11; 12 to the subsequent second processing station 01; 02; 03; 04; 06; 07; 08; 09; 11; 12 in transport plane 29 is preferably pulsed by the control unit. In the preferred embodiment, the effective width, directed orthogonally to the transport direction T of the sheets, of the blower air acting opposite the force of gravity, in the direction of transport plane 29, and/or the effective width of the additional blower air directed opposite the transport direction T of the sheets and/or the effective width of the suction air holding the sheet to be transported from the first processing station 01; 02; 03; 04; 06; 07; 08; 09; 11; 12 to the subsequent second processing station 01; 02; 03; 04; 06; 07; 08; 09; 11; 12 downstream in transport plane 29 is adjusted in each case dependent upon the width of the sheet directed orthogonally to the transport direction T of the sheets. In that case, the setting of the effective width of the blower air acting opposite the force of gravity in the direction of the transport plane 29, and the setting of the additional blower air directed opposite the transport direction T of the sheets and the setting of the suction air holding the sheets to be transported from the first processing station 01; 02; 03; 04; 06; 07; 08; 09; 11; 12 to the subsequent second processing station 01; 02; 03; 04; 06; 07; 08; 09; 11; 12 in transport plane 29 are each carried out by the control unit, coupled mechanically or electrically, e.g. coupled via mechanical gearing, by means of a single adjustment device. This adjustment device is controlled by the control unit, e.g. automatically, dependent upon the format of the specific sheets to be transported from the first processing station 01; 02; 03; 04; 06; 07; 08; 09; 11; 12 to the subsequent second processing station 01; 02; 03; 04; 06; 07; 08; 09; 11; 12.

For the overlapping arrangement of the sheet-type substrates, in particular the sheets 51, preferably each being embodied as a printed sheet, a device for overlapping sheets 51, also referred to in the following simply as overlapping device 132, is provided in the region, i.e. the operating region, of the transfer device located, in particular, in one of the above-described machine arrangements (FIGS. 1 to 9), in which the sheets 51, in particular coming from an offset, a flexographic or a non-impact printing unit 04; 06, are passed on, e.g. to mechanical processing device 11. A plurality of sheets 51 are fed individually in succession, i.e. spaced from one another, to overlapping device 132, on an infeed table 134, wherein infeed table 134 is embodied, e.g. as the feed table 18 located upstream of delivery 12 of sheets 51 in transport direction T of sheets 51 (FIG. 12), wherein sheets 51 are fed in succession to feed table 18, e.g. by means of conveyor belt 38 of overlapping device 132 and/or wherein the sheets 51 overlapped by overlapping device 132 are transferred from feed table 18, e.g. by means of a rocking gripper 19, e.g. to a transfer drum 31. Infeed table 134 has, e.g. one suction chamber 42, or a plurality of suction chambers 42, arranged one behind the other in transport direction T of the sheets 51, the pressure of which can be switched on and off individually and independently of one another, as is also illustrated, e.g. in FIG. 12.

Figure 30:
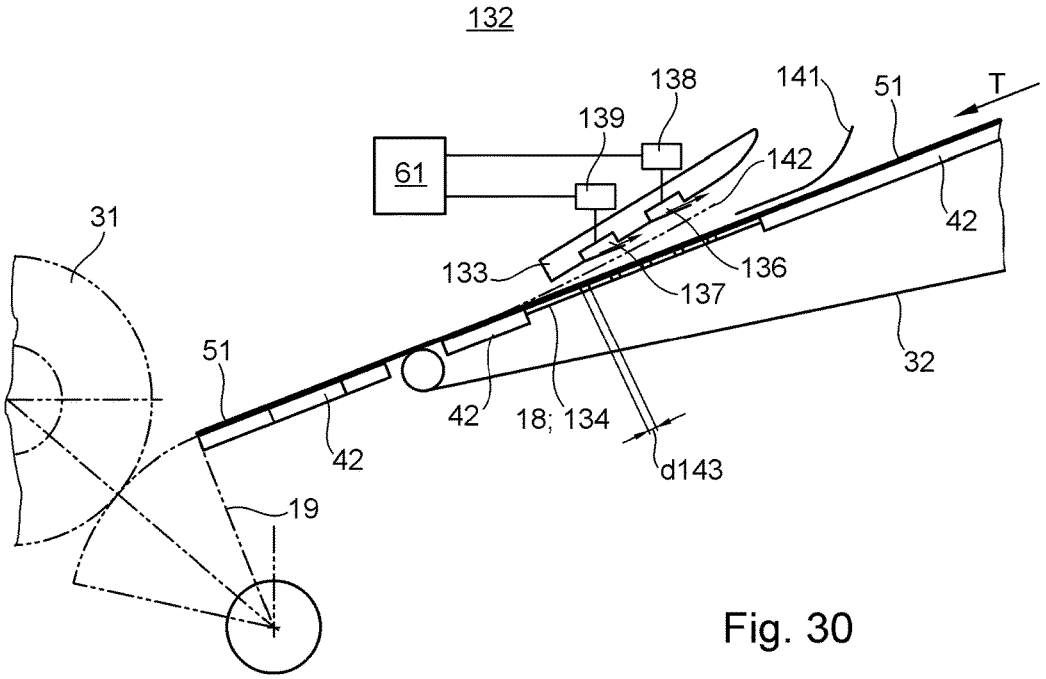
FIG. 30 an overlapping device.
Figure 31:
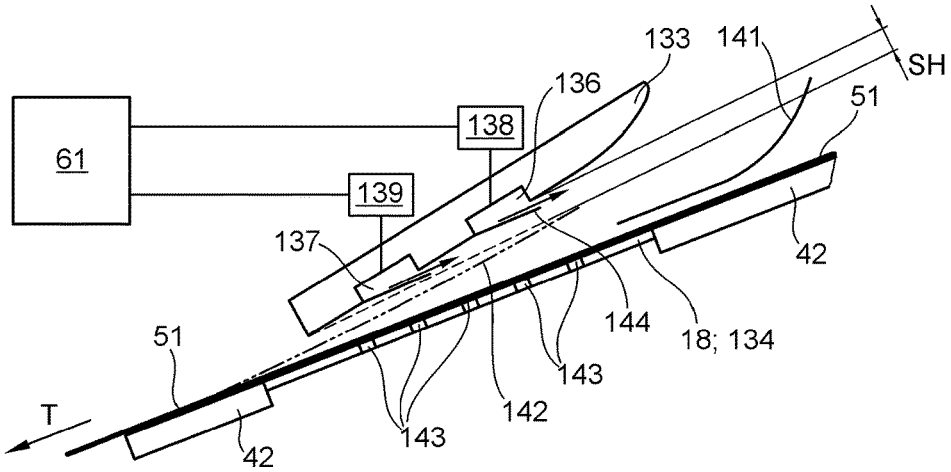
FIG. 31 an enlarged detail from FIG. 30.

Overlapping device 132 is illustrated by way of example in FIGS. 30 and 31. Above infeed table 134, overlapping device 132 has a box-shaped housing known as the blower module 133, preferably extending over the entire width b51 of the sheets 51, wherein a plurality of blower nozzles 136; 137 are arranged one behind the other in the blower module 133 in the transport direction T of the sheets 51 fed individually to overlapping device 132, on the side of said blower module that faces the infeed table 134. In the preferred embodiment, at least two rows, each containing a plurality of blower nozzles 136; 137 arranged side by side, i.e. blower nozzle rows, are arranged one behind the other in transport direction T of the sheets 51, and each transversely to the transport direction T of the sheets 51. The blowing direction of each of the blower nozzles 136; 137 is directed substantially parallel to infeed table 134, opposite the transport direction T of sheets 51, and is indicated in FIGS. 30 and 31 by directional arrows. The blowing direction of each of the blower nozzles 136; 137 is defined, e.g. by at least one guide surface 144 arranged and/or formed on the relevant blower nozzle 136; 137 and configured to channel the flow of blower air. Each guide surface 144 is formed on the side of blower module 133 that faces infeed table 18; 134, e.g. in the form of a ramp protruding outward from said blower module 133. Blower air streaming out of the respective blower nozzles 136; 137 is preferably controlled, e.g. in terms of time and/or intensity, by means of adjustable valves 138; 139, the valves 138; 139 being controlled or controllable, e.g. by a preferably digital control unit 61 that executes a program. The valves 138; 139 are activated, e.g. by control unit 61, in particular in a cycle, with the cycle duration and/or the cycle frequency preferably being adjusted or dependent upon the advance of the sheets 51 fed to overlapping device 132.

In the transport direction T of sheets 51, in a region between infeed table 18; 134 and the side of blower module 133 that faces said infeed table 18; 134, a baffle plate 141 is arranged upstream of the first blower nozzle 136 or the first blower nozzle row, said baffle plate 141 shielding the leading edge of a sheet 51 that immediately follows a sheet 51 that has been lifted by the blower air from at least one of blower nozzles 136; 137, against the suction effect induced by the blower nozzles 136; 137 arranged in blower module 133. The sheet 51 that has been lifted off of infeed table 18; 134 by at least one of the blower nozzles 136; 137 or blower nozzle rows channels the blower air streaming out of the at least one blower nozzle 136; 137 and conducts this blower air across the surface of baffle plate 141 that faces blower module 133. Baffle plate 141 preferably has a concave curvature at its end located in the blowing direction, which curvature gives the blower air a flow-off direction facing away from, i.e. directed away from, the infeed table 18; 134. Baffle plate 141 keeps the leading edge of the sheet 51 immediately following a sheet 51 that has been lifted by the blower air coming from at least one of blower nozzles 136; 137 from being influenced until the trailing end of the lifted sheet 51 exposes the blower nozzle 136 or row of blower nozzles first reached by said sheet 51 as a result of its own forward movement or advancement in transport direction T. To prevent the leading edge of the sheet 51 that immediately follows a sheet 51 that has been lifted by the blower air coming from at least one of blower nozzles 136; 137 from being lifted prematurely by the action of the blower nozzle 136; 137 or row of blower nozzles exposed by the trailing end of the sheet 51 preceding it, the blower air of the blower nozzle 136; 137 or row of blower nozzles in question is switched off by means of the associated valve 138; 139, based upon the forward movement or advancement of the sheet 51 currently lifted off of the infeed table 18; 134, which immediately precedes a sheet 51 located between baffle plate 141 and infeed table 18; 134. A sheet 51 that has been lifted by the blower nozzles 136; 137 or rows of blower nozzles is lifted above the infeed table 18; 134 as a result of the suction effect (Venturi effect) created by the respective blower air, at a specific floating height SH, e.g. measured as a distance from the side of the blower module 133 that faces the infeed table 18; 134, the floating height SH being dependent upon the intensity of the blower air and/or upon the weight of the sheet 51 in question and/or upon the transport speed of the sheet 51 in question. To prevent sheets 51, e.g. of heavy weight and/or high transport speeds, from vibrating and beginning to flutter as they are transported above the infeed table 18; 134, in the region between infeed table 18; 134 and the side of the blower module 133 that faces said infeed table 18; 134, a shield plate 142 that acts as a stop for the lifted sheet 51 is preferably provided, said shield plate 142, which is arranged, e.g. at an acute angle to the side of the blower module 133 that faces the infeed table 18; 134, being in the form of an air-permeable grate. The sheet 51 that has been lifted by the suction from the blower air and laid against the shield plate 142 is guided there in a smooth movement, i.e. without fluttering, in its transport direction T along said shield plate 142. In the infeed table 18; 134, at least in a region opposite the blower module 133, a plurality of holes 143 or openings 143 are preferably provided, through which air flows under the currently lifted sheet 51 for the purpose of pressure equalization. These holes 143 are configured, e.g. as circular, having a diameter d143 within the range of a few millimeters.

Figure 13:
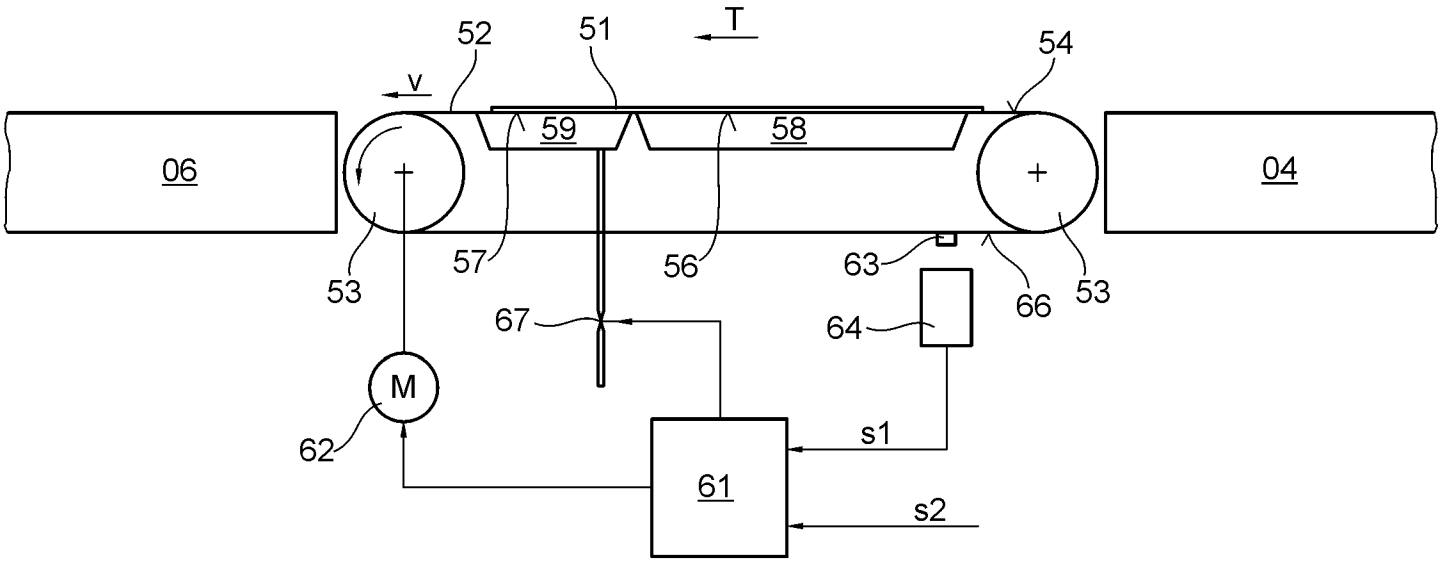
FIG. 13 a schematic diagram of a transport device for the sequential transport of individual sheet-type substrates.

FIG. 13 schematically illustrates in a simplified diagram and by way of example a transport device for the sequential transport of individual sheet-type substrates, each of these substrates preferably being embodied as a sheet 51, in particular as a printing sheet. This transport device is preferably located between two consecutive processing stations 01; 02; 03; 04; 06; 07; 08; 09; 11; 12 of a machine for processing sheets 51, wherein one of these processing stations 01; 02; 03; 04; 06; 07; 08; 09; 11; 12, e.g. the second processing station in transport direction T of the sheet 51 in question, is embodied in particular as a non-impact printing unit 06, preferably as at least one inkjet printing unit. The transport device described in reference to FIG. 13 is embodied as a module for transporting sheets 51, e.g. within one of the above-described production lines, and corresponds, e.g. to the above-described conveyor belt having reference number 17 or 27.

The transport device described with reference to FIG. 13 for the sequential transport of individual sheet-type substrates has at least one continuously revolving suction belt 52, the at least one suction belt 52 being disposed, e.g. between at least two deflecting rollers 53, arranged spaced apart from one another. The at least one suction belt 52 has two surface regions, configured differently from one another, one behind the other in the transport direction T of sheet 51, which is indicated by an arrow in FIG. 13, with surface 56 of one of these surface regions being configured as solid and surface 57 of the other of these surface regions being perforated. These two surface regions alternate along the circumference of suction belt 52, i.e. they are arranged alternating in the direction of revolution of the suction belt 52 in question and thus in the transport direction T of sheet 51. During its transport, sheet 51 to be transported is arranged lying flat, partly on solid surface 56 of the suction belt 52 in question and partly on perforated surface 07 of the same suction belt 52. In transport direction T of sheet 51 to be transported by the at least one suction belt 52, at least two suction chambers 58; 59 are arranged one behind the other, and the at least one suction belt 52 is moved relative to these at least two suction chambers 58; 59, which are arranged stationary in relation to the transport device. The at least one suction belt 52 slides, e.g. over a preferably table-shaped surface 69 of at least one of these suction chambers 58; 59. The first suction chamber 58 in transport direction T of sheet 51 to be transported is located in the region of a taut run 54 of the suction belt 52 in question, whereas the second suction chamber 59 in transport direction T of the sheet 51 to be transported is located either also in the region of taut run 54 of the suction belt 52 in question, downstream of the first suction chamber 58 in transport direction T of sheet 51 to be transported or downstream of the region of taut run 54 of the suction belt 52 in question, in transport direction T of the sheet 51 to be transported, i.e. downstream of the suction belt 52 in question in transport direction T of the sheet 51 to be transported. A run is a free, unsupported section of a running, preferably continuously revolving drawing element, the drawing element being embodied, e.g. as a chain, cable, band or belt, in particular as a toothed belt. If the drawing element is embodied as a chain, the at least one chain is guided, e.g. in a chain track. The load-bearing run is the side of the drawing element which is pulled and taut, whereas a slack run is the loose run which is not drawn and which sags.

FIG. 13 shows by way of example the first variant of the positioning of the second suction chamber 59. In this case, the first suction chamber 58 in transport direction T of sheet 51 typically has a much greater volume, in particular at least twice as great a volume as the second suction chamber 59 in transport direction T of sheet 51. During the transport of sheet 51, a vacuum pressure prevailing in the first suction chamber 58 in transport direction T of the sheet 51 to be transported is constantly present, and a vacuum pressure prevailing in the second suction chamber 59 in transport direction T of the sheet 51 in question is pulsed, i.e. this negative pressure is switched on and off alternately, each for an adjustable duration. The second suction chamber 59 in transport direction T of sheet 51 is therefore configured as relatively small in volume, to enable a vacuum pressure to be built up in it more quickly in light of the transport speed used for sheet 51, in particular of several thousand, e.g. 10,000 to 18,000 sheets 51 per hour, and to enable a higher pulse rate with respect to the pressure build-up and pressure release in the second suction chamber 59 to be achieved. During its transport, this sheet 51 is then suctioned onto the at least one revolving suction belt 52 when the perforated surface 57 of the suction belt 52 in question is in an operative connection with at least one of the suction chambers 58; 59, each of which is acted on by vacuum pressure. In a highly advantageous embodiment of this transport device, a pulsing of the vacuum pressure of the second suction chamber 59 in transport direction T of sheet 51 is synchronized with a passage over the perforated surface 57 of the suction belt 52 in question, covered by the sheet 51 to be transported.

The speed of revolution v of the suction belt 52 in question is adjusted by the preferably digital control unit 61, which executes a program, and which has a drive 62 that places this suction belt 52 in motion. Said control unit 61 preferably also controls or regulates the aforementioned synchronization of the vacuum pressure in the second suction chamber 59 in the transport direction T of sheet 51 with the passage over said chamber of the perforated surface 57 of this suction belt 52 which is covered by sheet 51, e.g. by means of a valve 67. The preferably controllable valve 67 is located, e.g. in a line that connects the second suction chamber 59 to a pump (not shown), e.g. controlled by control unit 61. The drive 62, preferably embodied as an electric motor, acts, e.g. on at least one of the deflecting rollers 53. The drive 62 for adjusting the speed of revolution v of the suction belt 52 in question is preferably controlled by control unit 61. Control unit 61 preferably sets a discontinuous speed of revolution v of the suction belt 52 in question, i.e. the speed of revolution v of the suction belt 52 in question is accelerated or decelerated in phases, in contrast to an otherwise uniform speed, by the control of drive 62.

In each case, at least one register mark 63 is provided at least at one point on the suction belt 52 in question. In conjunction with the transport device, a sensor 54 that detects the register mark 53 in question is provided and is connected to the control unit 61. The speed of revolution v of the suction belt 52 in question is adjusted by control unit 61, preferably dependent upon a difference, determined, e.g. by control unit 61, between a first signal s1 generated by sensor 64 and corresponding to an actual speed of revolution and a second signal s2 corresponding to a target speed of revolution. The second signal s2, which indicates the target speed of revolution of the revolving suction belt 52 in question, is tapped, e.g. from a higher-level machine controller (not shown). Sensor 64, which detects the register mark 63 in question, is arranged in particular in the region of a slack run 66 of the suction belt 52 in question. The sensor 64 that detects the register mark 63 in question is configured as a sensor 64 for detecting the register mark 63 in question, e.g. optically or inductively or capacitively or electromagnetically or ultrasonically. Register mark 63 is configured, corresponding to the respective embodiment of sensor 64, e.g. as an optical signal surface applied to the suction belt 52 in question, or as a magnetic strip on the suction belt 52 in question, or as a recess or perforation in the suction belt 52 in question, or as a body that is located in the suction belt 52 in question and emits a signal. The time at which the speed of revolution v of the suction belt 52 in question is regulated, which is carried out by control unit 61, is preferably synchronized with the passage of the perforated surface 57 of the suction belt 52 in question, which is covered by the sheet 51 to be transported.

In a further variant, the transport device for the sequential transport of individual sheet-type substrates or sheets 51 has at least one stationary suction chamber 58; 59 which has a preferably table-shaped surface 69 in the region of the taut run 54, in which case a single, in particular at least partially perforated continuously revolving suction belt 52 is preferably arranged moving, in particular sliding, across this surface 69 during transport of the sheet-type substrate in question, i.e. preferably a sheet 51, the suction chamber 58; 59 in question being covered by the table-shaped surface 69 in the region of the taut run 54 of the suction belt 52. This table-shaped surface 69 is implemented, e.g. as a tabletop. This suction belt 52 holding the sheet 51 in question during its transport is arranged in particular centered with respect to the width b51 of the sheets 51, oriented orthogonally to the transport direction T, and/or centered with respect to the width b69 of the table-shaped surface 69, oriented orthogonally to the transport direction T. The width b52 of the suction belt 52 oriented orthogonally to transport direction T is narrower than the width b51 of the sheets 51 in question to be transported, oriented orthogonally to the transport direction T and is also narrower than the width b69 of the table-shaped surface 69 oriented orthogonally to transport direction T. The width b52, oriented orthogonally to the transport direction T, of suction belt 52 is, e.g. only 5% to 50% of the width b51, oriented orthogonally to transport direction T, of the sheets 51 and/or the width b69, oriented orthogonally to transport direction T, of the table-shaped surface 69 so that during its transport, the sheet 51 in question does not rest on suction belt 52 with its full surface, in particular with its two lateral regions extending orthogonally to transport direction T.

Figure 14:
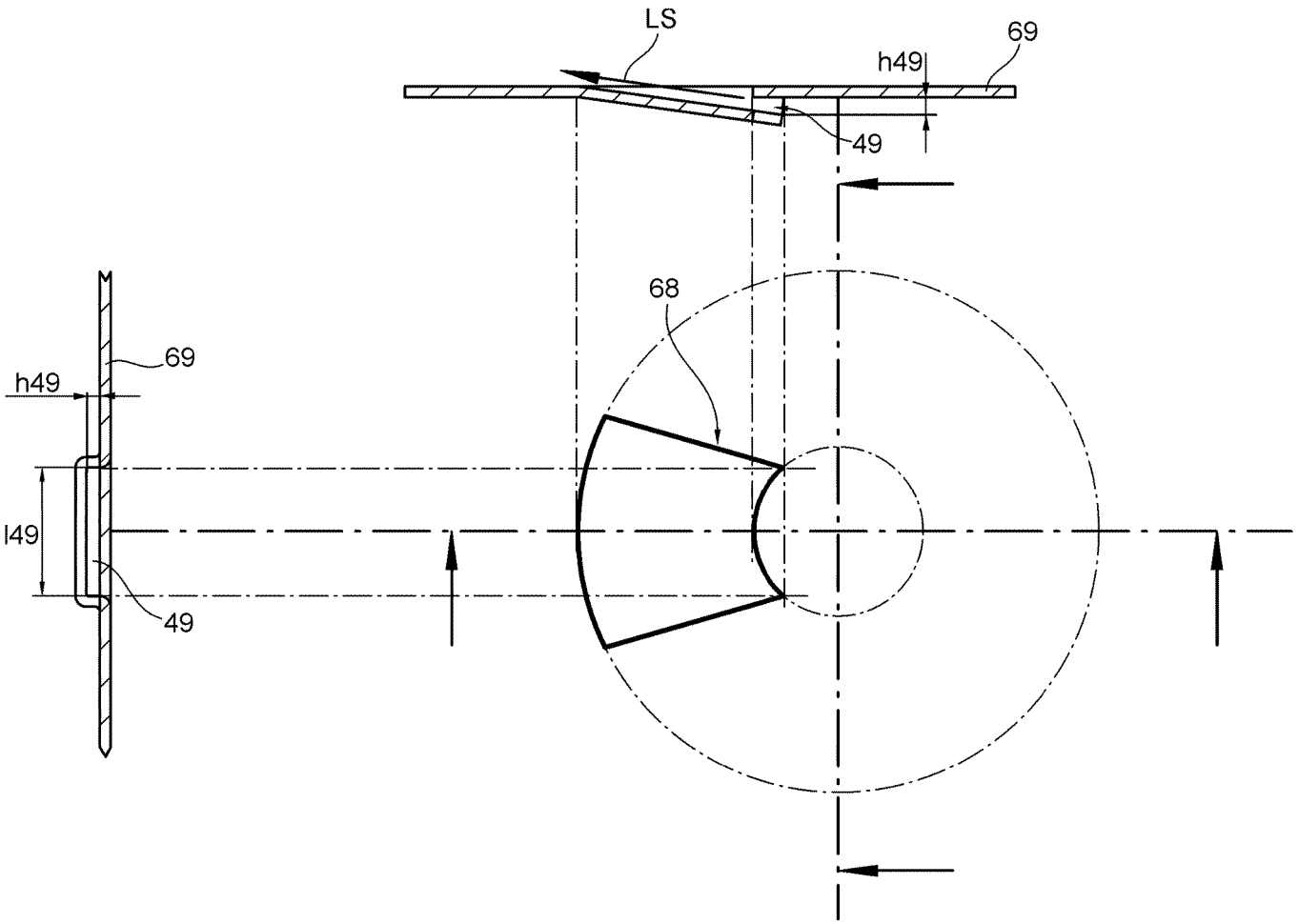
FIG. 14 a plan view of a single blow-suction nozzle.
Figure 15:
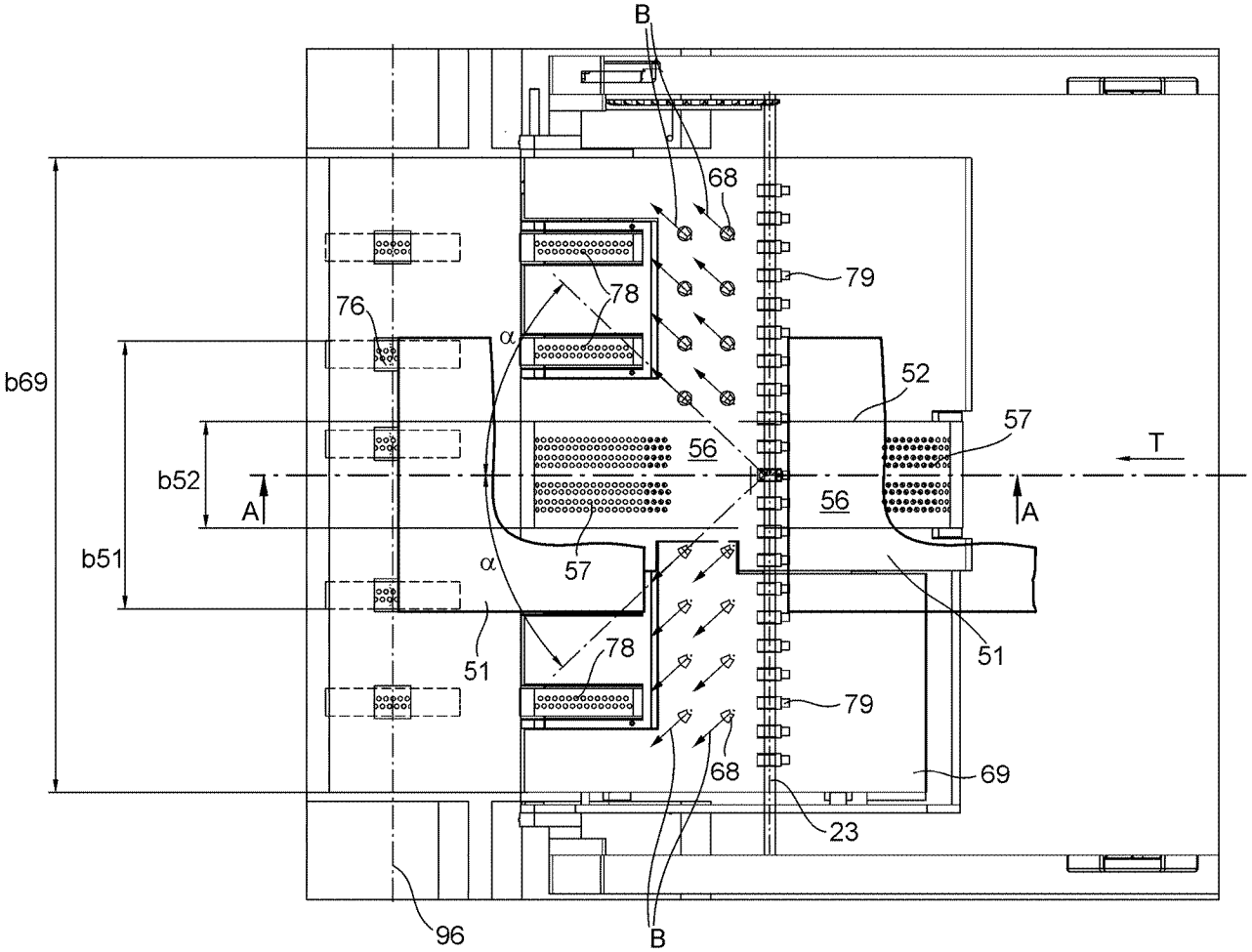
FIG. 15 a plan view of a transport device according to FIG. 11 or FIG. 13.
Figure 16:
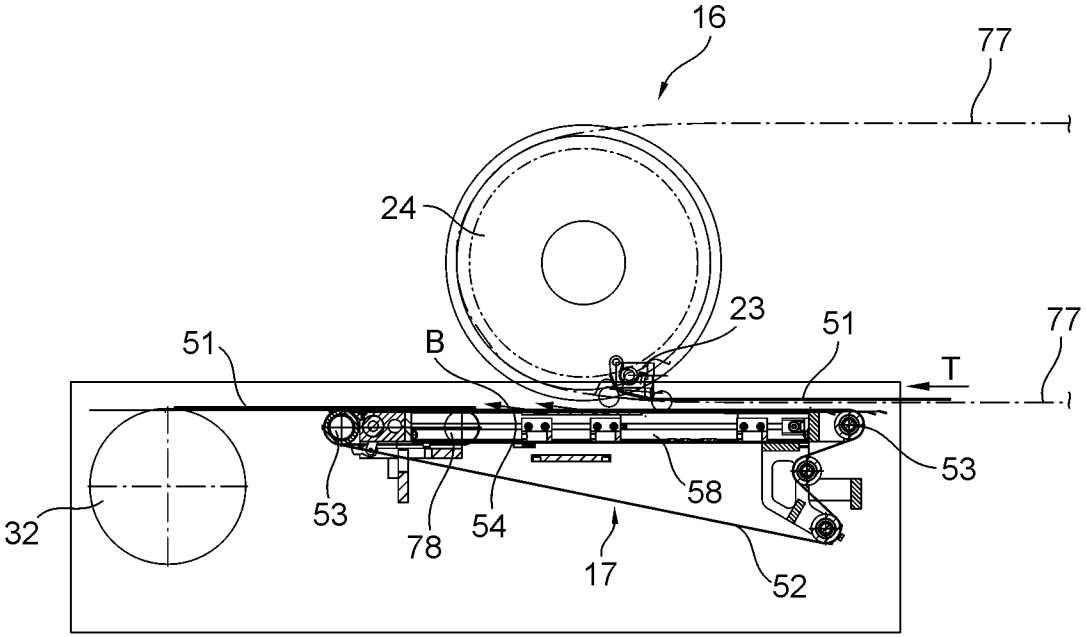
FIG. 16 a view from the side of the transport device shown in FIG. 15.

To allow the sheet 51 in question to slide with as little friction as possible during its transport across the table-shaped surface 69 that covers the at least one suction chamber 58; 59, at least one blow-suction nozzle 68 is positioned in at least two of the regions of the table-shaped surface 69 across which the suction belt 52 does not pass. The flow of air emerging from the respective blow-suction nozzle 68 preferably is or at least can be controlled, e.g. in terms of its intensity (i.e., in terms of its pressure and/or its flow rate) and/or its duration, wherein the blow-suction nozzle 68 in question allows air to flow against the underside of the sheet 51 in question during the transport thereof, whereby an air cushion is or at least can be created between the underside of the relevant sheet 51 to be transported and the table-shaped surface 69. In the preferred embodiment, each of the blow-suction nozzles 68 is configured as a Venturi nozzle, with the Venturi nozzle suctioning a lateral region of the relevant sheet 51 to be transported by applying vacuum pressure in the direction of the table-shaped surface 69. Each of the blow-suction nozzles 68 is preferably located in the table-shaped surface 69. FIG. 14 shows a plan view with two corresponding side views of one exemplary embodiment of the blow-suction nozzles 68, the blow-suction nozzle 68 shown being configured, e.g. in the form of a slot-shaped nozzle, wherein the opening 49 of this slot-shaped nozzle is preferably configured as a segment, e.g. rectangular in cross-section, of a preferably cylindrical or conical lateral surface, wherein the length l49 of this segment extending in or parallel to the table-shaped surface 69 is at least three times greater, preferably ten times greater than its height h49 perpendicular to the table-shaped surface 69, and wherein in the preferred embodiment, the length l49 of this opening 49 extends along an arc of an inner circumferential line of a circular ring. The height h49 of this opening 49 formed along an arc is approximately 1 mm and the length l49 is more than 10 mm, for example. The air flow LS emerging from blow-suction nozzles 68 is preferably deflected into a direction determined in particular by the shaping of a guide surface, e.g. configured in the form of a ramp, this guide surface being formed, e.g. by an outwardly widening section of the aforementioned circular ring. The blowing direction B of the blow-suction nozzles 68 is preferably directed obliquely outward, in each case in the transport direction T of the relevant sheet 51 to be transported, at an angle $\alpha$ proceeding from transport direction T and ranging from 30° to 60°, preferably at an angle $\alpha$ of 45°, as is indicated by way of example by directional arrows in FIG. 15. In the preferred embodiment, in particular in the table-shaped surface 69 that covers the at least one suction chamber 58; 59, a plurality of rows of blow-suction nozzles 68, in particular two, e.g. aligned parallel to one another and oriented toward each side of the suction belt 52 oriented orthogonally to the transport direction T, the blow-suction nozzles 68 being arranged uniformly or non-uniformly spaced from one another to generate a symmetrical or asymmetrical flow profile for the air flowing out of the blow-suction nozzles 68. The blow-suction nozzles 68 are arranged, e.g. in a transport device 17 that receives sheets 51 from a chain conveyor 16, in particular in a transfer region beneath the at least one sprocket 24 of chain conveyor 16 and upstream of an additional transport device, e.g. a suction drum 32, that follows the first in transport direction T of the sheets 51 to be transported (FIG. 11). FIGS. 15 and 16 show a preferred arrangement of the blow-suction nozzles 68 in the table-shaped surface 69, in each case with respect to the position of a gripper carriage 23 moved by chain conveyor 16, this position being in particular the position in which the gripper carriage 23 in question releases or transfers a sheet 51 transported by said gripper carriage to suction belt 52 for further transport.

The transport device having the center suction belt 52 and blow-suction nozzles 68 in the edge region for the sequential transport of individual sheet-type substrates can be used advantageously when the sheets 51 to be transported are surface-coated and these surface-coated sheets 51 still in their wet state are removed by means of the above-described transport device, e.g. by a chain conveyor 16. The proposed solution not only enables the elimination of additional suction belts 78 that would be arranged parallel to the centrally arranged suction belt 52, it also avoids those problems that could be solved by synchronizing these additional suction belts 78 to the centrally arranged suction belt 52.

Moreover, with the blow-suction nozzles 68, the leading edge of each of the sheets 51, after being released by the gripper carriage 23 in question, is moved from the level of a gripper striking plane to a floating plane just above the table-shaped surface 69, i.e. a few millimeters, and the respective leading edge of the sheet 51 in question released by the gripper remains at the level of the table-shaped surface 69. Without the blow-suction nozzles 68, when sheets 51 are being transported at a high speed, e.g. of more than 10,000 sheets per hour, there is a risk that the released leading edge of the sheets 51 in question, or when sheets 51 are being transported in an overlapped arrangement, the leading edge of said sheets that has been thrust free, may be lifted up by a blade of air and raised again. In addition, with pliable sheets 51 or substrates, with which internal transverse forces are transmitted to only a limited extent from the center belt to the outer edge regions of the substrate in question, the conveyance component of each of these outer edge regions is supported by the air friction caused by the air flow LS.

Figure 17:
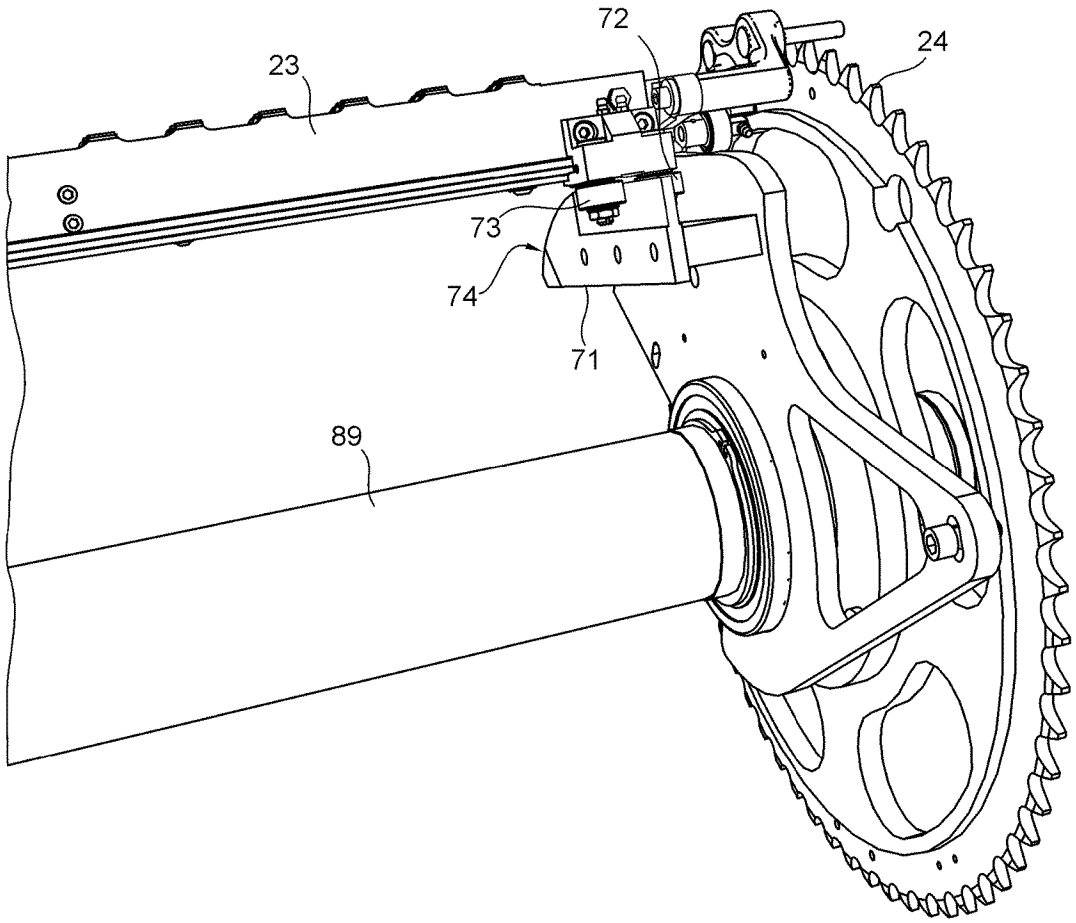
FIG. 17 a detail of the illustration of a chain conveyor.

FIG. 17 shows a detail of a perspective representation of a chain conveyor 16. This chain conveyor 16 is located, e.g. in a machine arrangement having a plurality of processing stations 01; 02; 03; 04; 06; 07; 08; 09; 11; 12 each for processing sheet-type substrates 51, preferably at the rear end of a processing station 02; 04, embodied as a primer application unit 02 or as an offset printing unit 04, in transport direction T of the sheet-type substrates 51 that are guided through the machine arrangement, wherein the chain conveyor 16 transports sheet-type substrates 51 processed in the preceding processing station 02; 04 individually in sequential transport to a subsequent processing station 06, wherein this subsequent processing station 06 is embodied, e.g. as a non-impact printing unit 06, and wherein the sheet-type substrates 51 processed in the preceding processing station 02; 04 are or are intended to be subjected to further processing in the subsequent processing station 06. The offset printing unit 04 is preferably embodied as a sheet-fed offset printing machine and/or the non-impact printing unit 06 is preferably embodied, e.g. as at least one inkjet printing unit. In such a machine arrangement, the problem exists that sheet-type substrates 51 that have been processed in the preceding processing station 02; 04, e.g. embodied as an offset printing unit 04, must be fed with high positioning precision to the subsequent processing station 06, embodied, e.g. as a non-impact printing unit 06, for further processing true to register, however this is not possible using a conventional chain conveyor 16 due to the chain clearances that are required, along with potential variations in the elongation of the at least one chain. With this machine arrangement, e.g. one of the production lines described in reference to FIG. 1 is realized.

Figure 18:
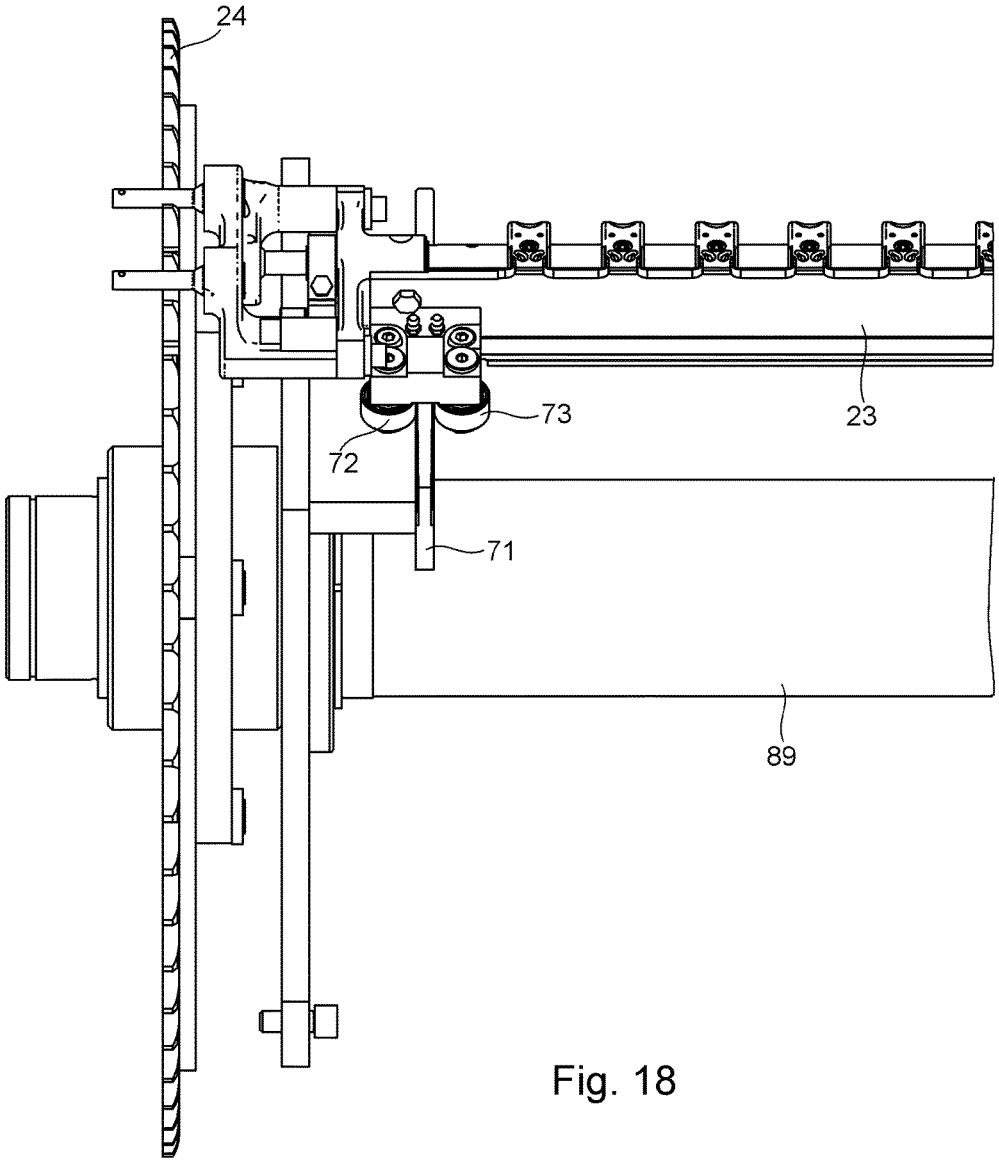
FIG. 18 a plan view of the assembly shown in FIG. 15.
Figure 19:
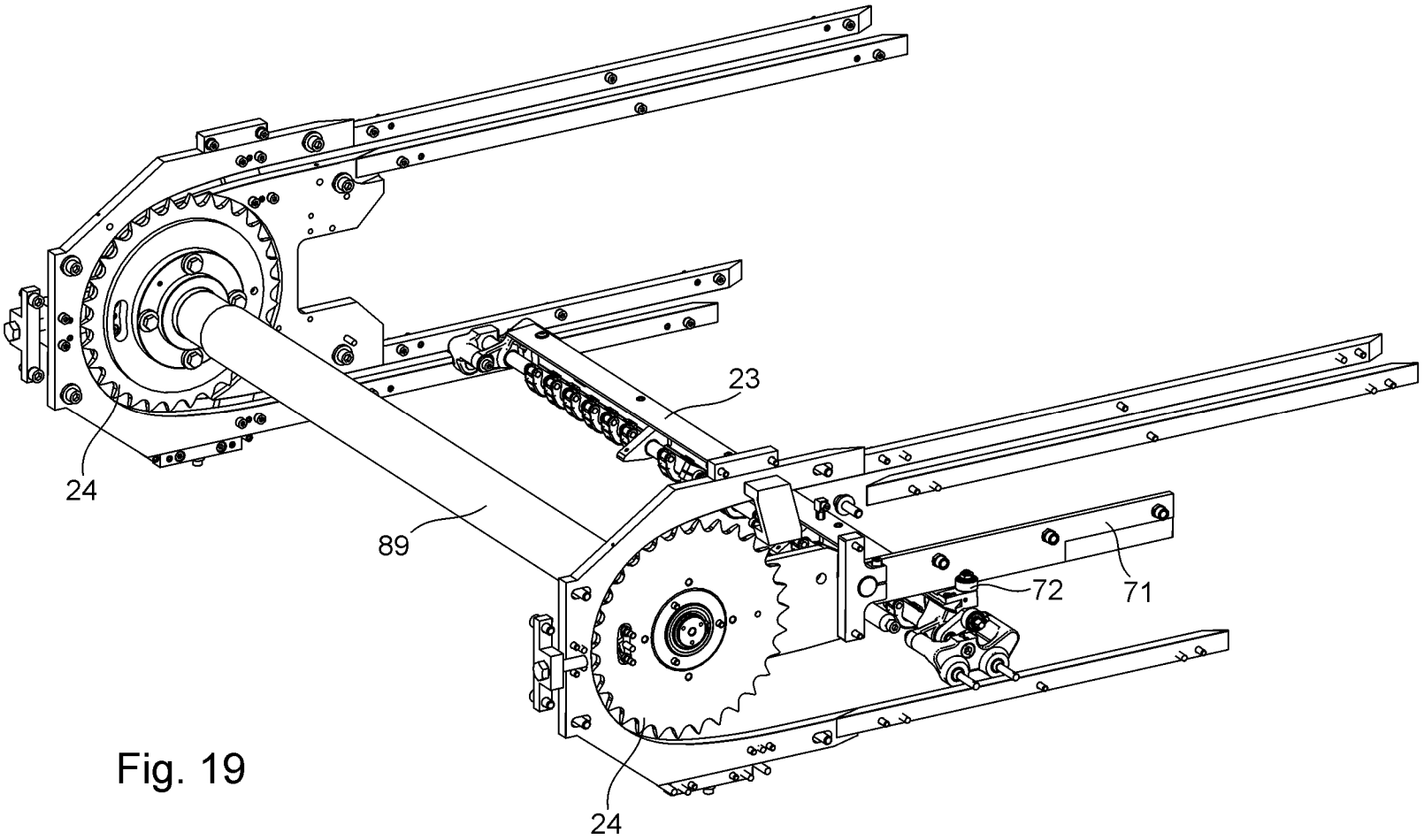
FIG. 19 another perspective view of the chain conveyor shown in FIGS. 15 and 16.

With a chain conveyor 16, the sheet-type substrates 51 are each transported individually by a gripper carriage 23 moved along a movement path (FIGS. 10 and 11), the respective gripper carriage 23 typically being guided along two chain tracks 77 spaced from one another and extending parallel to one another. The substrate 51 in question to be transported is held, in particular at an edge extending lengthwise along the gripper carriage 23 in question, i.e. at the leading edge of said substrate 51, by at least one holding means 79 located on said gripper carriage 23, i.e. by the at least one gripper. The gripper carriage 23 in question is guided in the receiving region located at a specific position along its movement path in which the gripper carriage 23 in question receives the respective substrate 51 to be transported, and/or in the transfer region, located at a specific position along its movement path, in which the gripper carriage 23 in question delivers the transported substrate 51 in each case in particular to the other transport device, e.g. in each case by means of at least one guide element 71 located between the spaced chain tracks 77, along the movement path of the gripper carriage 23 in question, wherein the other transport device cooperating with the chain conveyor 16 is embodied, in particular, as a conveyor belt 17 (FIG. 11). To stabilize the gripper carriage 23 moved along its movement path transversely to said movement path, it is proposed that the at least one guide element 71 in the receiving region or in the transfer region be arranged fixed, in each case between the spaced-apart chain tracks 77, and for the gripper carriage 23 guided along the spaced-apart chain tracks 77 to be secured by means of the guide element 71 transversely to the movement path. This securing is preferably carried out by arranging a roller pair having two rollers 72; 73 that are thrown onto one another, each with its respective rolling surface, on the respective gripper carriage 23, the guide element 71 in question being guided, at least in the receiving region or in the transfer region, through a nip between the respective rolling surfaces of the two rollers 72; 73 of the roller pair in question. The at least one guide element 71 is preferably embodied as a rigid rail and/or has a wedge-shaped run-up 74. The guide element 71 in question is integrally formed, for example, and extends, e.g. from the receiving region to the transfer region of chain conveyor 16. The running surfaces of the rollers 72; 73 of the roller pair in question, which are thrown onto one another, roll, e.g. along both sides of the guide element 71, embodied, e.g. as a rail (FIGS. 17 to 19). Along the chain tracks 77, in particular continuously revolving conveyor chains are arranged, each of these conveyor chains being driven by at least one sprocket 81. The sprocket 24; 81 of one chain track 77, preferably located at one end of the chain conveyor 16 either in the receiving region or in the transfer region, and the sprocket 24; 81 of the other chain track 77, located at the same end of chain conveyor 16 in the same region are preferably connected to one another, in particular rigidly, by a common shaft 89. The guide element 71 in question laterally secures the respective gripper carriage 23 which is guided along the spaced-apart chain tracks 77, preferably in cooperation with the roller pair, i.e. blocking the degree of freedom of said gripper carriage directed transversely to the movement path. The lateral positioning of the substrates 51 is improved by aligning said gripper carriage 23 by means of a guide element 71, both in the receiving region, in which each of the substrates 51 is received by one of the gripper carriages 23, and in the transfer region, in which the substrates 51 transported by chain conveyor 16 are transferred from the respective gripper carriage 23 to the conveyor belt 17 (FIG. 10). These guide elements 71 are embodied either as two individual guide elements 71 that are separated from one another or as one integral guide element 71.

In conjunction with the machine arrangements described above, the following method can advantageously be used for operating a transport device for feeding individual sheet-type substrates 51 sequentially to a processing station 02; 03; 04; 06; 07; 08; 09; 11; 12, in which, by means of a monitoring device that cooperates with the transport device, the actual position of each substrate 51 in its transport plane 29 is determined mechanically before said substrate reaches the processing station 02; 03; 04; 06; 07; 08; 09; 11; 12, and is compared automatically with a target position intended for the substrate 51 in question in said processing station 02; 03; 04; 06; 07; 08; 09; 11; 12. If the actual position deviates from the target position, the substrate 51 in question is aligned by a transport element of the transport device, the movement of which is controlled by the control device, such that the substrate 51 in question assumes its target position intended for this processing station 02; 03; 04; 06; 07; 08; 09; 11; 12 before it reaches said processing station 02; 03; 04; 06; 07; 08; 09; 11; 12. In a highly advantageous variant, the substrate 51 in question is thereby aligned solely by the transport element, in each case in the transport plane 29, both in transport direction T and transversely thereto and about a fulcrum lying in the transport plane 29. This means that, in this variant for operating the transport device, no mechanical stops, in particular, are involved in the alignment of the substrate 51 in question. The processing station 02; 03; 04; 06; 07; 08; 09; 11; 12 to which the substrate 51 in question is fed and is aligned with respect to its target position is preferably embodied as a non-impact printing device. The substrate 51 in question is preferably held by the transport element in a force-locking connection, e.g. by means of suction air, or by clamping, and is aligned in this operating state, held by the transport element, with respect to the target position intended for this substrate 51 in the processing station 02; 03; 04; 06; 07; 08; 09; 11; 12. A suction drum 32 or a suction belt 52; 78 is used, in particular, as the transport element. The transport element transports each of the substrates 51 individually. The monitoring device includes, e.g. the control unit and at least one of the, e.g. optical sensors 33; 36 connected to it, each of the sensors 33; 36 being embodied, e.g. as a lateral edge sensor and/or as a leading edge sensor, for detecting the actual position of the substrate 51 in question. The target position, with respect to which the substrate 51 in question is to be aligned, is or will be stored in the control unit and/or, e.g. stored, preferably such that it can be modified, e.g. by means of a program. The transport element is driven by a first drive which moves the substrate 51 in question in its transport direction T, and by a second drive which moves the substrate 51 in question transversely to its transport direction T, and by a third drive which rotates the substrate 51 in question about the fulcrum located in the transport plane 29, with these drives, each of which is embodied, e.g. as a motor, in particular as a preferably electric servomotor, each being controlled by the monitoring device, i.e. by the control unit thereof. The transport element is driven by its three drives, in particular simultaneously. The substrate 51 in question is fed by the transport device at a transport speed that is not equal to zero to the processing station 02; 03; 04; 06; 07; 08; 09; 11; 12, and in the event of a deviation of the actual position from the target position, the substrate is preferably aligned while maintaining this transport speed. If the transport element is embodied as a suction belt 52; 78, the transport speed at which the substrate 51 in question is fed to the processing station 02; 03; 04; 06; 07; 08; 09; 11; 12 in question corresponds, e.g. to the speed of revolution v of said suction belt 52; 78.

Figure 20:
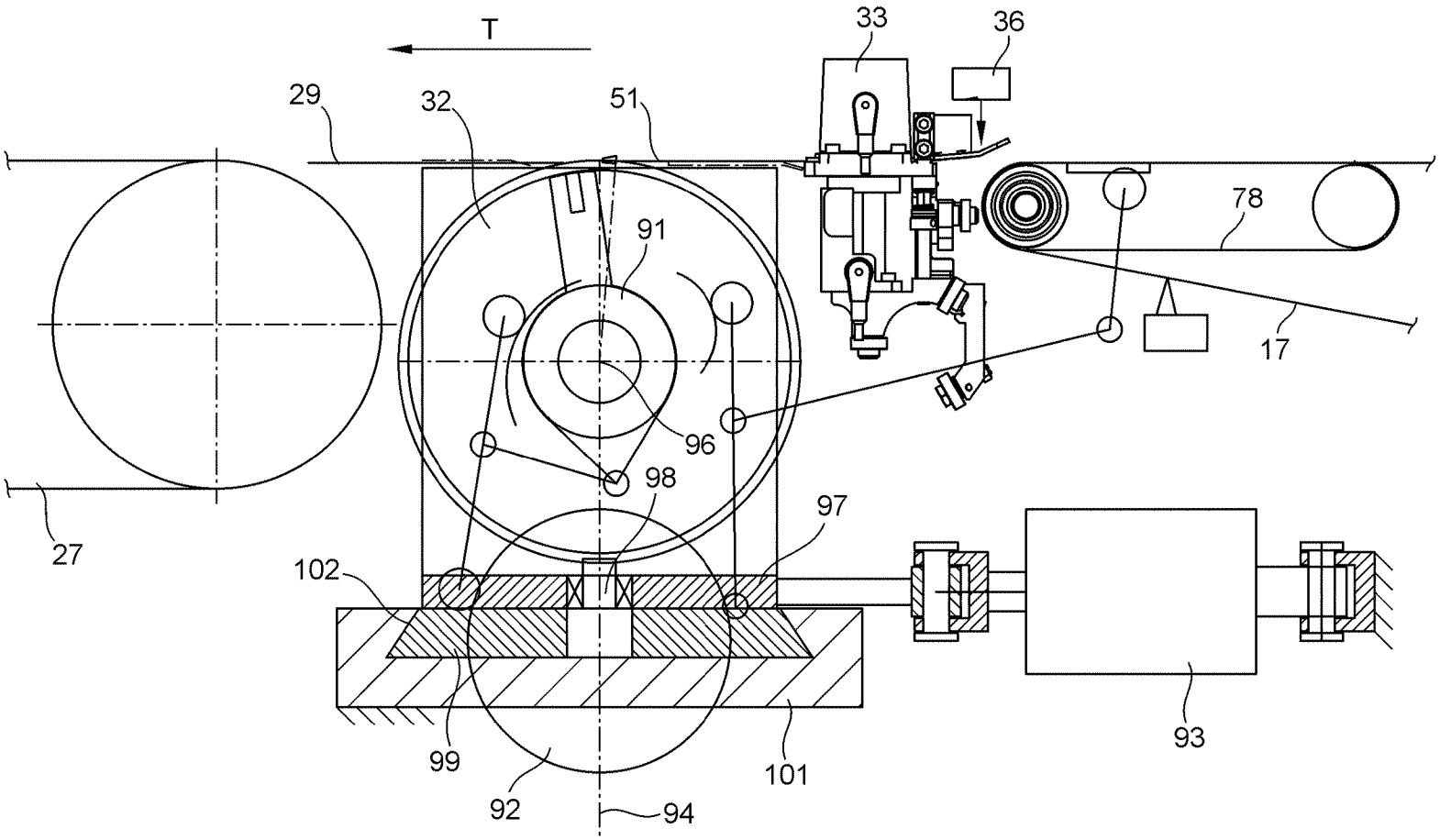
FIG. 20 a further embodiment of the transport device based on a detail enlargement from FIG. 11.
Figure 21:
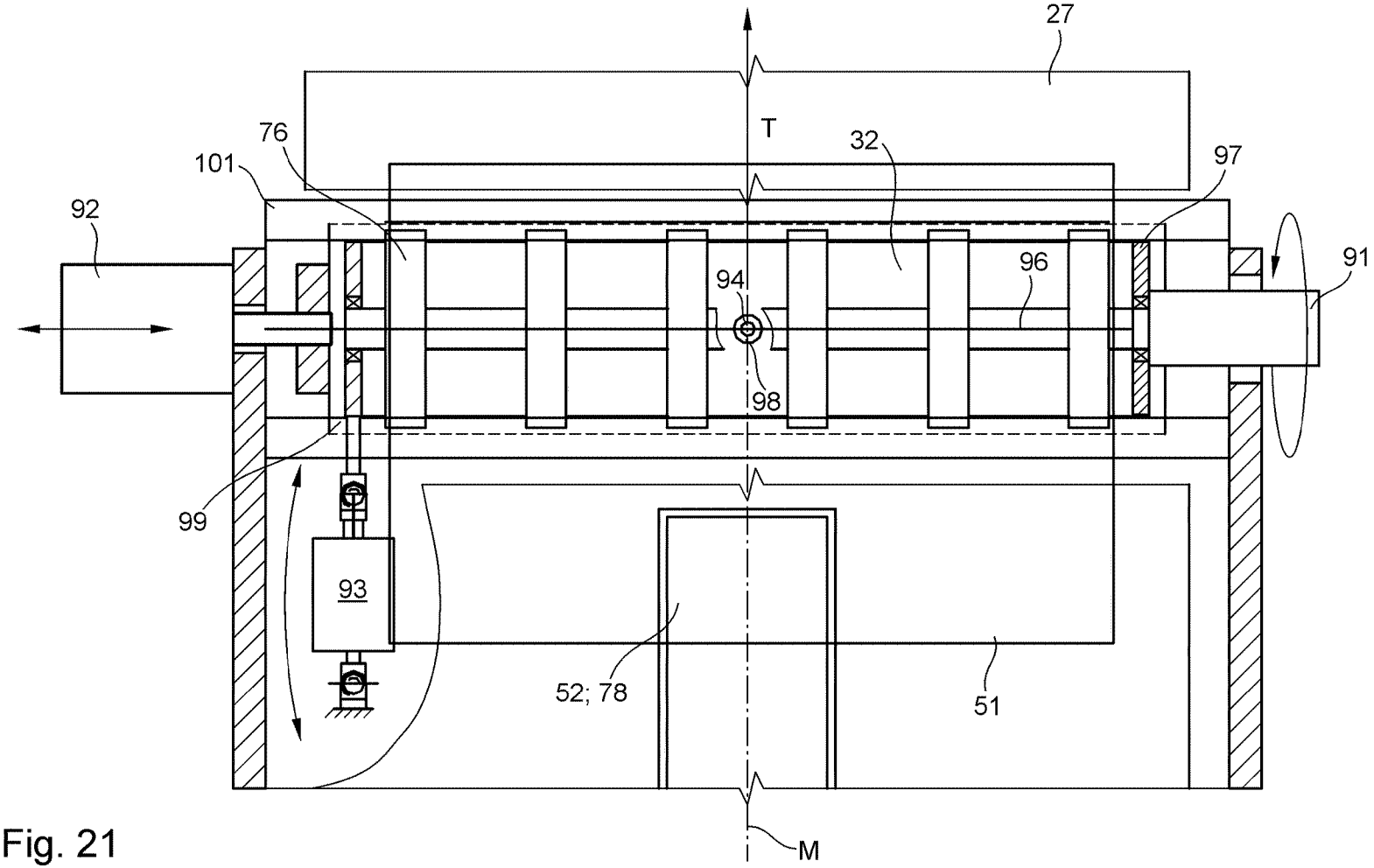
FIG. 21 a plan view of the transport device of FIG. 20.

One exemplary embodiment for carrying out the aforementioned method for operating a transport device for the sequential feeding of individual sheet-type substrates 51 to a processing station 02; 03; 04; 06; 07; 08; 09; 11; 12 is shown in FIGS. 20 and 21; in this example, a suction drum 32 is used as the transport element. FIG. 20 shows an enlarged detail of FIG. 11, however in this further exemplary embodiment of the transport device, in contrast to the embodiment of the transport device shown in FIG. 11, no stop 34 formed on suction drum 32 is provided. Individually transported substrates 51, in particular sheets, are each guided by means of a suction belt 78 upstream of suction drum 32 in transport direction T, first to suction drum 32 and from suction drum 32 to another conveyor belt 27, said conveyor belt 27 then feeding the substrate 51 in question in particular to a non-impact printing unit 06. The substrate 51 held in a force-locking connection by suction drum 32 by means of suction air is thereby aligned solely by said suction drum 32 in transport plane 29, both in transport direction T and transversely thereto, and also about a fulcrum lying in the transport plane 29 with respect to the target position intended for the substrate 51 in question in the non-impact printing unit 06. For this purpose, suction drum 32 has a first drive 91 for its circumferential movement and a second drive 92 for its axial movement and a third drive 93 for a pivoting movement of the rotational axis 96 of the suction drum 32, executed or at least executable about a pivot axis 94 standing perpendicular to the transport plane 29, each of these three drives 91; 92; 93 being embodied, e.g. as a preferably electric servomotor. Suction drum 32 is mounted with its first drive 91, e.g. in a first frame 97, this first frame 97 in turn being rotatably arranged, e.g. on a pivot joint 98 located at the machine center M, wherein the pivot joint 98 is connected to a second frame 99. The rotational movement or pivoting movement of the rotational axis 96 of suction drum 32 executed about the pivot axis 94 standing perpendicular to the transport plane 29 is carried out by means of the third drive 93 which, when actuated remotely from the machine center M, acts on the first frame 97 and thereby effects a diagonal alignment of the substrate 51 held by suction drum 32. The second frame 99 supporting the first frame 97 is in turn arranged in or on a third frame 101, the second frame 99 being movable, in particular displaceable, in or on the third frame 101 transversely to the transport direction T of the substrate 51 in question when the second drive 92 is actuated. For this purpose, the second frame 99 is guided linearly in or on the third frame 101 in a, e.g. prismatic guide element 102. FIG. 21 again shows the transport device illustrated in FIG. 20 in a plan view, with the alignment of the substrate 51, both in its transport direction and transversely thereto, and also about a rotational angle lying in the transport plane 29, which alignment is executed or at least executable by means of suction drum 32, being indicated in each case by a double arrow.

A further method for operating a device for transporting sheet-type substrates 51 likewise uses a transport element for conveying the substrate 51 in question in its transport plane 29, wherein the transport element feeds the substrate 51 in question true to register to a processing station 02; 03; 04; 06; 07; 08; 09; 11; 12 downstream of the transport element in the transport direction T of the substrate 51 in question, this processing station 02; 03; 04; 06; 07; 08; 09; 11; 12 being embodied, e.g. as a non-impact printing unit 06. A suction drum 32 having a plurality of suction rings 76 arranged side by side axially and each embodied as a holding element, or an arrangement of multiple suction belts 52; 78, each revolving lengthwise relative to the transport direction T of the substrate 51 in question and arranged side by side transversely to the transport direction T of the substrate 51 in question, is used as the transport element. The transport element for transporting the substrate 51 in question therefore always uses a plurality of holding elements arranged spaced from one another transversely to its transport direction T, the substrate 51 in question being held in a force-locking connection by at least two of these holding elements in each case up to an output position with respect to the transport plane 29. The output positions of all of the holding elements for holding the substrate 51 in question in a force-locking connection are all located on the same straight line 103. The transport element is used to adjust the diagonal register of the substrate 51 in question. The diagonal register of the substrate 51 in question is adjusted by adjusting a rotational angle β of this straight line 103 about a pivot axis 94 which is perpendicular to the transport plane 29, wherein the rotational angle β of this straight line 103 is adjusted, according to the diagonal register of the relevant substrate 51 to be adjusted, by means of an actuation, triggered by a control unit, of a single mechanical coupling element, which acts simultaneously on all the holding elements holding the substrate 51 in question in a force-locking connection, whereby the respective output position of at least one of the holding elements holding the relevant substrate in a force-locking connection is adjusted by means of the mechanical coupling element acting on the holding element in question. The holding elements that hold the substrate 51 in question in a force-locking connection each impress a transport speed onto the substrate 51 in question that differs from holding element to holding element, wherein the transport speed impressed by the respective holding element onto the substrate 51 in question is dependent in each case on the output position set for the respective holding element. As a mechanical coupling element, e.g. a linear gear element with rocker arms and/or with geared mechanical linkages is used, with each of the holding elements that holds the substrate 51 in question in a force-locking connection being assigned either a rocker arm or a geared mechanical linkage.

The proposed method for operating a device for transporting sheet-type substrates has the advantage that, for adjusting the diagonal register in the transport device, an oblique positioning of the transport element in question does not occur and therefore, a lateral register and/or axial register of the substrate in question that have, e.g. already been adjusted, cannot be adversely affected by the adjustment of the diagonal register. Instead, between the holding elements of the transport element that are involved in the adjustment of the diagonal register, a differential speed which is dependent upon the respective position of the holding element in question is adjusted by actuating a single adjustment drive, thereby aligning the substrate in question according to the desired diagonal register. The use of only a single actuating drive for adjusting the diagonal register has the advantage that a synchronization of different drives, each acting on one of the holding elements, or the adjustment of these to match one another is not required, thereby eliminating a source of error and enabling a highly precise adjustment of the diagonal register.

In one preferred embodiment of this method, the actual position, in its transport plane 29, of the substrate 51 to be fed true to register to the processing station 02; 03; 04; 06; 07; 08; 09; 11; 12 is determined by means of a monitoring device connected to the control unit before said substrate reaches the transport element, and is compared with a target position intended for the substrate 51 in question in the processing station 02; 03; 04; 06; 07; 08; 09; 11; 12, and in the case of a deviation of the actual position from the target position, the control unit controls a drive 93 for adjusting the mechanical coupling element such that when all of the holding elements holding the substrate in question in a force-locking connection reach their respective output positions, the substrate 51 in question assumes its intended target position with respect to the diagonal register in the processing station 02; 03; 04; 06; 07; 08; 09; 11; 12.

Figure 22:
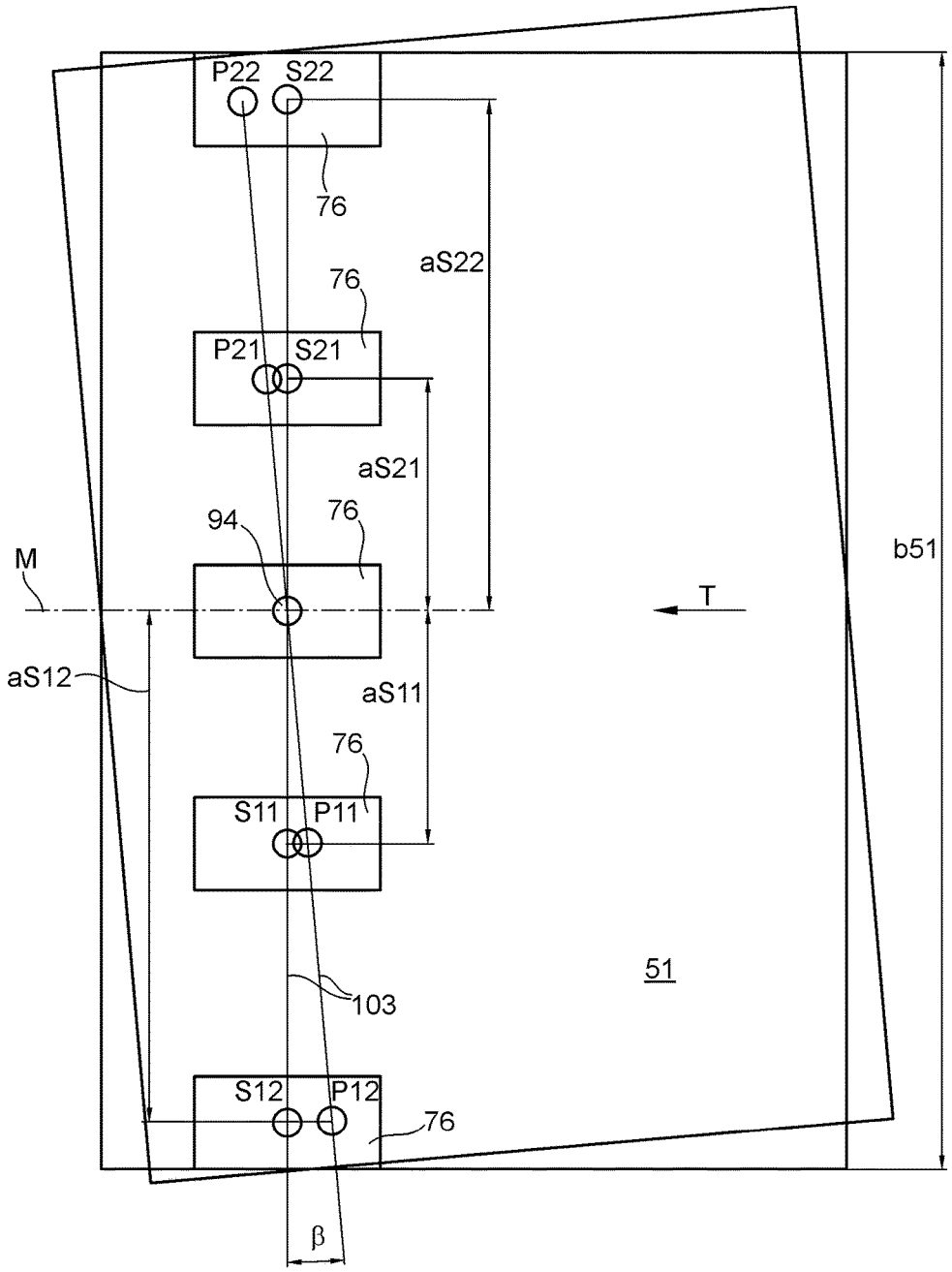
FIG. 22 a sheet-type substrate to be aligned in the diagonal register.

One exemplary embodiment for carrying out the latter method for operating a device for transporting sheet-type substrates 51 will now be explained in reference to FIGS. 22 to 26. FIG. 22 shows a plan view of a sheet-type substrate 51, in particular a sheet 51, having a width b51 oriented transversely to its transport direction T. Transversely to its transport direction T, a plurality of holding elements are provided, e.g. five, e.g. in the form of suction rings 76, arranged side by side, of a suction drum 32, each of these holding elements holding the substrate 51 in question in its transport plane 29 in a force-locking connection, in particular by vacuum pressure. One of this plurality of holding elements is positioned, e.g. at the machine center M, and in the illustrated example, two additional holding elements are arranged to both the right and the left of the machine center M. On the left side in transport direction T of the substrate 51 in question, one of the holding elements closer to the machine center M is positioned at a distance aS11 from the machine center, and one of the holding elements farther away from the machine center M is positioned at a distance aS12 from the machine center; on the right side of the substrate 51 in question in transport direction T, one of the holding elements closer to the machine center M is positioned at a distance aS21 from the machine center, and one of holding elements farther away from the machine center M is positioned at a distance aS22 from the machine center. The respective rotational planes of all the holding elements holding the substrate 51 in question in a force-locking connection are each arranged parallel to the others and lengthwise along the transport direction T of the substrate 51 in question. The substrate 51 in question is held during its transport by at least two of these holding elements in a force-locking connection, in each case up to an output position relative to the transport plane 29, with the output positions of all of the holding elements holding the substrate 51 in question in a force-locking connection being located on the same straight line 103. In the actual position of the substrate 51 in question, the respective output positions of all of the holding elements holding this substrate 51 in a force-locking connection are denoted in the present example by the reference signs P11; P12; P21; P22, whereas in the target position of the substrate 51 in question, the respective output positions of all of the holding elements holding said substrate 51 in a force-locking connection are denoted in the present example by the reference signs S11; S12; S21; S22. To adjust the diagonal register of the substrate 51 in question and thereby bring the substrate 51 in question from its actual position to its target position, at least with respect to its angular position, the substrate in question 51 is rotated by a rotational angle β about a pivot axis 94 standing perpendicular to the transport plane 29, which is accomplished by rotating the straight line 103 about this rotational angle β, which is in turn achieved by adjusting the output position of at least one of the holding elements holding the substrate 51 in a force-locking connection by means of the mechanical coupling element acting on the holding element in question. The rotational angle β is typically within the range of only a few degrees, e.g. between greater than zero and less than 30°, in particular less than 10°. The pivot axis 94 standing perpendicular to the transport plane 29 is preferably located at the machine center M. In that case, the output position of the holding element located at the machine center M remains unchanged, whereas, by means of the mechanical coupling element acting on the holding elements jointly, the output positions of the holding elements located to the right of the machine center M in the illustrated example are each adjusted to run at a higher speed with respect to their speed of revolution v, and the output positions of the holding elements located to the left of the machine center M are each adjusted to run at a lower speed with respect to their speed of revolution v. The holding elements holding the substrate 51 in question in a force-locking connection and adjusted in terms of their speed of revolution v each impress a transport speed that differs from holding element to holding element onto the substrate 51 in question during the execution of the position correction, wherein the transport speed impressed by the respective holding element onto the substrate 51 in question is dependent in each case on the output position S11; S12; S21; S22 adjusted for the respective holding element, i.e. corresponding to the target position of the substrate 51 in question.

Figure 23:
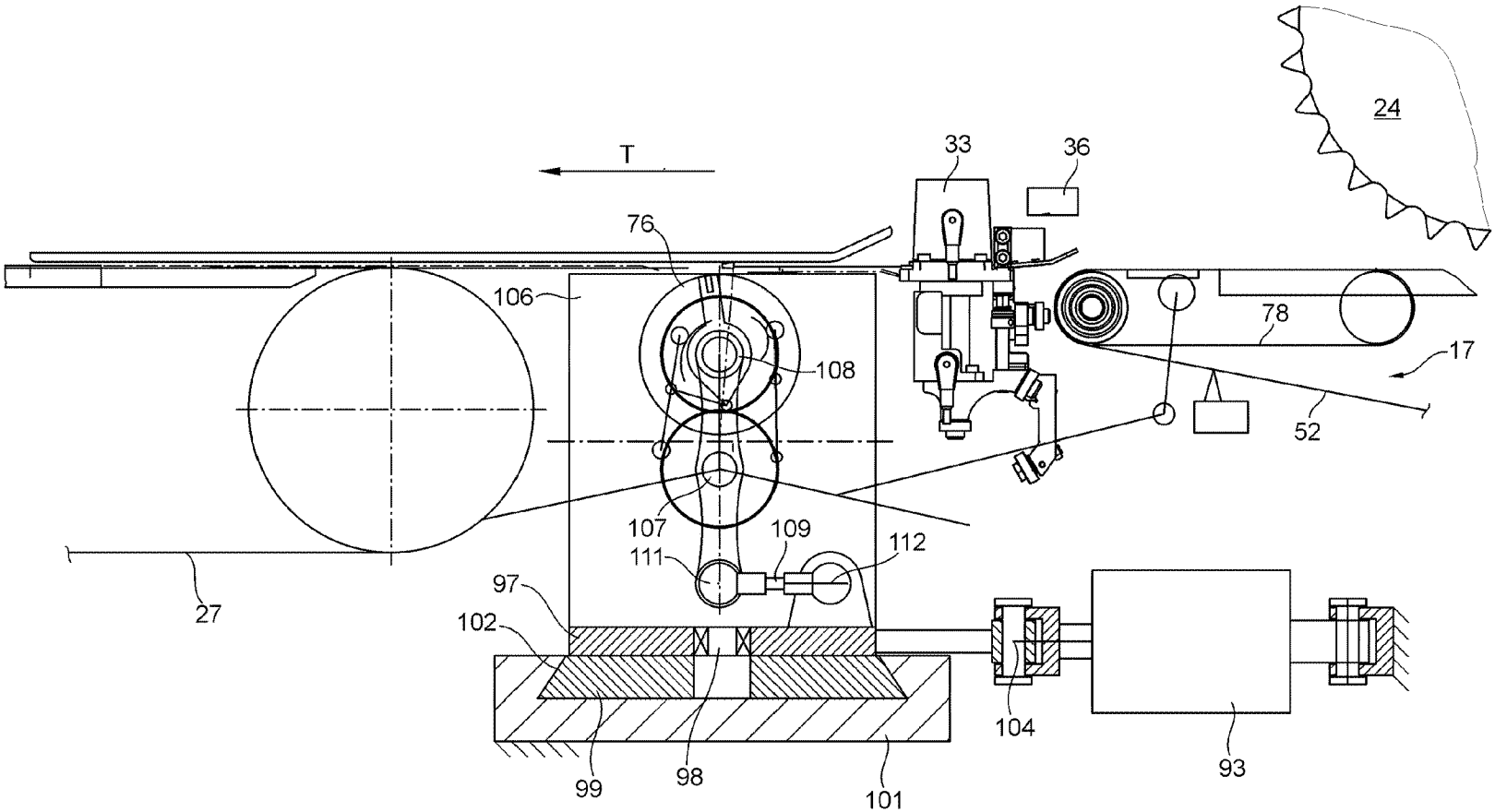
FIG. 23 a view from the side of a transport device having a mechanical coupling element which has a rocker arm.
Figure 24:
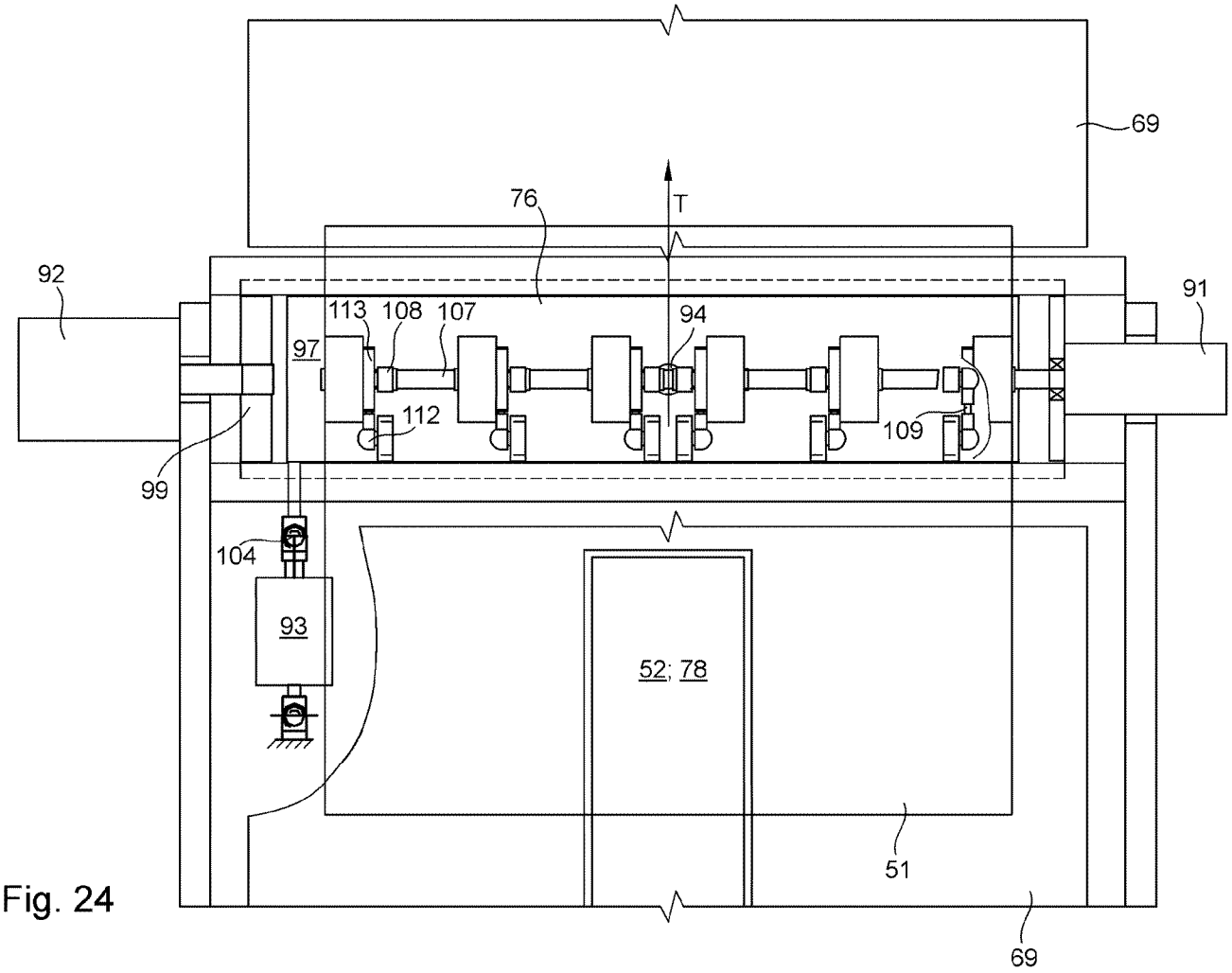
FIG. 24 a plan view of the transport device shown in FIG. 23.
Figure 25:
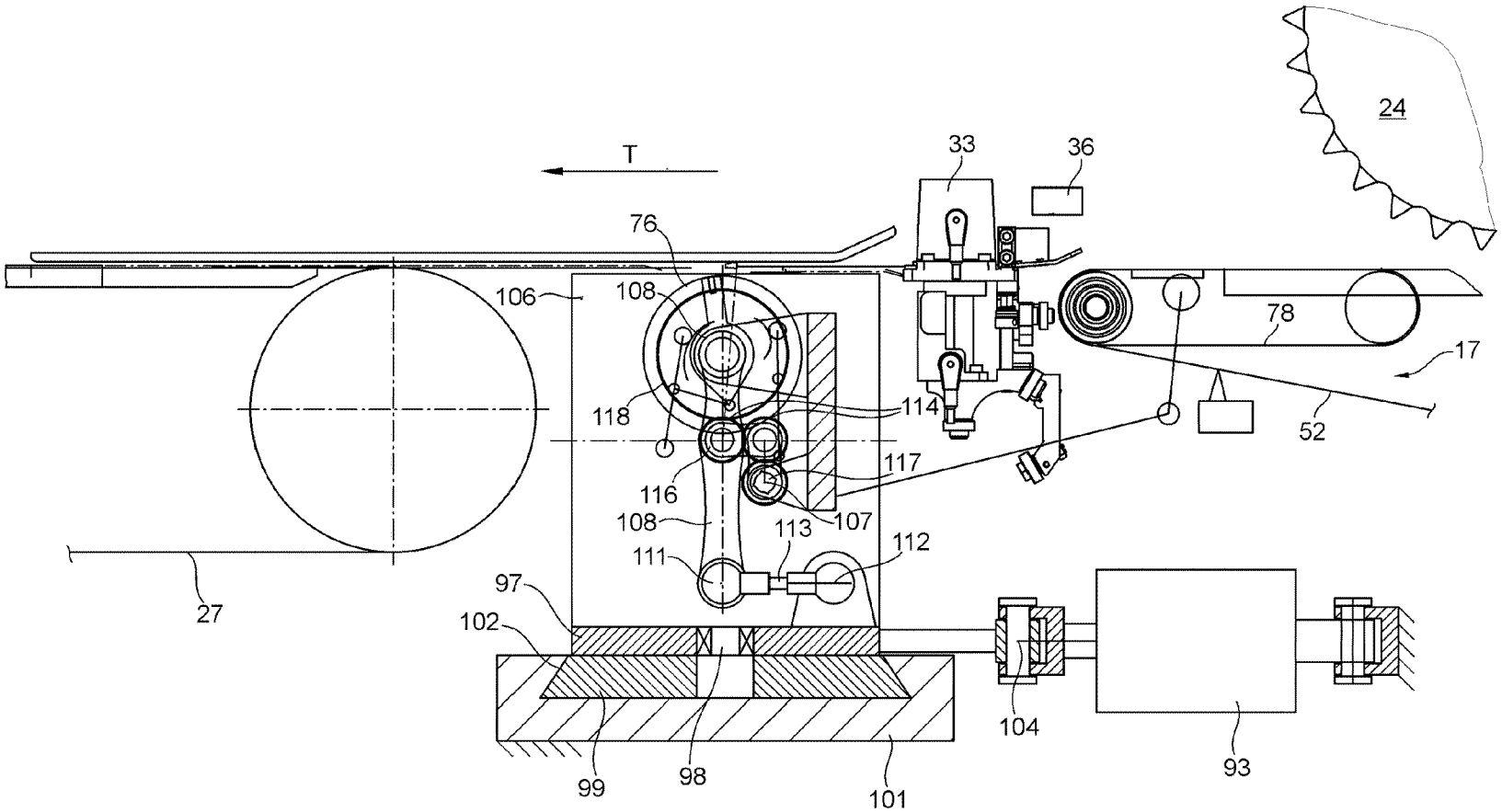
FIG. 25 a view from the side of a transport device having a mechanical coupling element which has a geared mechanical linkage.
Figure 26:
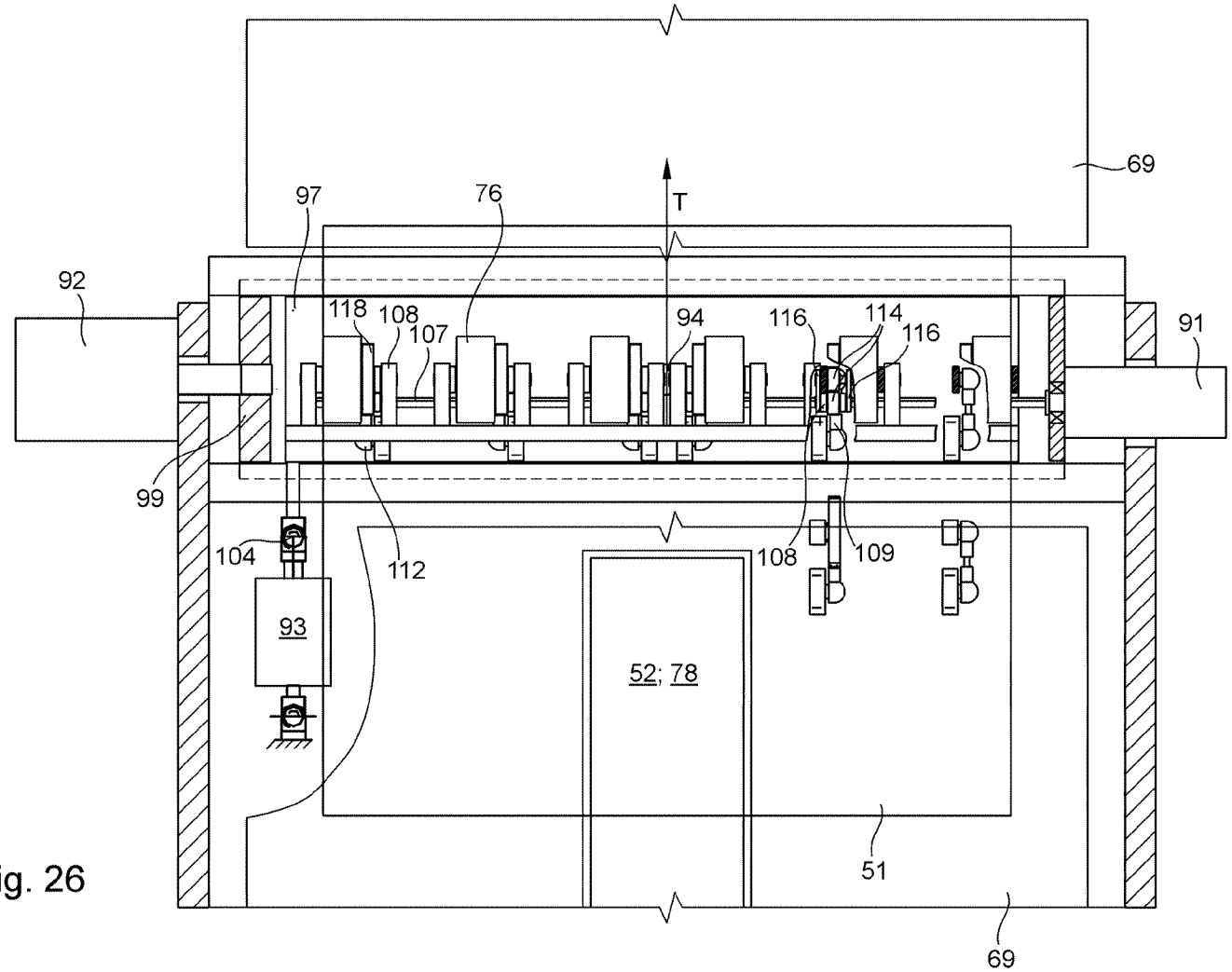
FIG. 26 a plan view of the transport device shown in FIG. 25.

FIGS. 23 and 24 show an embodiment of the mechanical coupling element, e.g. in the form of a linear gear element with rocker arms. FIGS. 25 and 26 show an embodiment of the mechanical coupling element, e.g. in the form of a linear gear element with geared mechanical linkages. Thus, each of the holding elements that hold the substrate 51 in question in a force-locking connection is assigned either a rocker arm according to FIGS. 23 and 24 or a geared mechanical linkage according to FIGS. 25 and 26. Similarly to the arrangement shown in FIG. 20, the suction drum 32 shown in FIGS. 23 to 26 is mounted, e.g. in a first frame 97, this first frame 97 in turn being arranged rotatably, e.g. on a pivot joint 98 located at the machine center M, and the pivot joint 98 being connected to a second frame 99. The second frame 99 supporting the first frame 97 is in turn arranged in or on a third frame 101. In the exemplary embodiments shown in FIGS. 23 to 26, the first frame 97 forms the mechanical coupling element acting on the holding elements in question, wherein the drive 93 embodied in particular as a preferably electric servo motor is provided for executing the rotational movement of the mechanical coupling element about the pivot axis 94 standing perpendicular to the transport plane 29. When actuated by the control unit, drive 93 preferably acts via a joint 104 on the first frame 97, which forms the mechanical coupling element. The second frame 99 has at least two diametrically opposed frame walls 106, in which frame walls 106 a drive shaft 107 extending parallel to the suction drum 32 is mounted, e.g. rotatably at both ends. On drive shaft 107, a plurality of rocker arms 108 are preferably arranged, each of said rocker arms 108 being operatively connected to one of the holding elements, each embodied, e.g. as a suction ring 76. Each of the rocker arms 108 in question is connected for conjoint rotation to the drive shaft 107, so that the drive shaft 107 forms a point of articulation fixed to the frame for each of the rocker arms 108 in question. Each of the rocker arms 108 in question, driven by drive shaft 107, thus acts with one of its ends, e.g. its upper end, optionally via a drive pinion 113, on one of the holding elements. Each of these rocker arms 108 is connected at its other end, e.g. its lower end, to the first frame 97, preferably via a coupling 109 mounted on additional joints 111; 112 each embodied, e.g. as a ball joint, in such a way that the angular position of the rocker arm 108 connected to the drive shaft 107 is or at least can be adjusted in each case by drive 93.

The variant of the embodiment according to FIGS. 25 and 26 is very similar to the variant of the embodiment according to FIGS. 23 and 24, therefore, identical components are identified by the same reference signs. The variant of the embodiment according to FIGS. 25 and 26 differs from the variant of the embodiment according to FIGS. 23 and 24 in that a pair of coupling gears 114 is provided, which gears are coupled to one another via a gear coupler 116, wherein a drive pinion 117 introduces torque into the pair of coupling gears 114 and an output pinion 118 transmits the torque introduced into the pair of coupling gears 114 to the holding element in question for the purpose of adjusting the angular position thereof. The pair of coupling gears 114 together with drive pinion 117 and output pinion 118 thus form a geared mechanical linkage.

Figure 27:
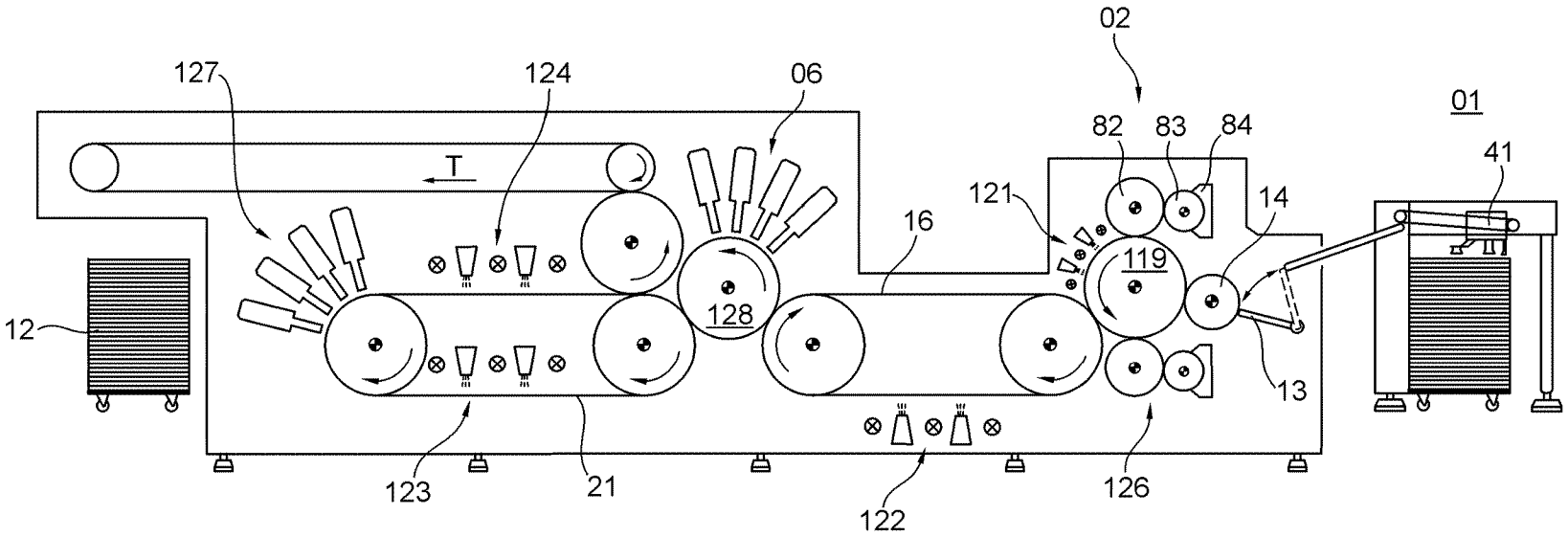
FIG. 27 a machine arrangement for two-sided sequential processing of a plurality of sheet-type substrates.

FIG. 27 shows a further machine arrangement having a plurality of typically different processing stations for the sequential processing of a plurality of sheet-type substrates. The flat substrates, each having a front side and a reverse side, are gripped in a feeder 01, e.g. by a suction head 41 and are transferred individually by means of a rocking gripper 13 to a transfer drum 14 and from there to a rotating impression cylinder 119, said impression cylinder 119 accommodating on its lateral surface at least one of these substrates or more, e.g. two or three substrates arranged one behind the other in the circumferential direction. Each of the substrates to be transported is held on the lateral surface of impression cylinder 119 by means of at least one holding element embodied, e.g. as a gripper. Pliable and/or thin substrates, in particular, having a thickness of, e.g. up to 0.1 mm or a maximum of 0.2 mm, may also be held on the lateral surface of impression cylinder 119, e.g. by means of suction air, wherein the support of such a substrate on the lateral surface of impression cylinder 119, in particular along the edges of said substrate, is supported, e.g. by blower air directed in particular radially onto the lateral surface of impression cylinder 119. Thrown onto impression cylinder 119, in its direction of rotation, which is indicated in FIG. 27 by a directional arrow, starting with the transfer drum 14 which is thrown onto said impression cylinder 119, are first a first primer application unit 02 for priming the front side, and downstream of this first primer application unit 02, a second primer application unit 126 for priming the reverse side of the same sheet-type substrate, wherein the second primer application unit 126 primes the reverse side of the substrate in question, e.g. indirectly, in particular by a reverse transfer of the primer, which has been applied to the lateral surface of impression cylinder 119 by this second primer application unit 126, from said lateral surface to the reverse side of the substrate in question. The front side and/or the reverse side of the substrate in question may be primed over its full surface or over a portion of its surface, as needed. Impression cylinder 119 transfers a substrate that has been primed on both sides to a first, in particular continuously revolving transport device having at least one drawing element, e.g. to a first chain conveyor 16, and the first chain conveyor 16 transports this substrate to a first non-impact printing unit 06, said first non-impact printing unit 06 at least partially printing the front side of the substrate in question. The first non-impact printing unit 06 transfers the substrate, which has been printed on the front side, to a second, in particular continuously revolving transport device, having at least one drawing element, e.g. to a second chain conveyor 21, wherein this second chain conveyor 21 receives the substrate in question, e.g. in the region of its first sprocket 81 (FIG. 10). In the region of the second sprocket 24 of this second chain conveyor 21, for example, a second non-impact printing unit 127 is located, said second non-impact printing unit 127 at least partially printing the reverse side of the substrate, the front side of which has already been printed. The first non-impact printing unit 06 and the second non-impact printing unit 127 are thus arranged sequentially at different positions along the transport path of the sheet-type substrate in question in transport direction T of the substrate in question. The substrate in question, which has now been printed on both sides, is then deposited, e.g. onto a pile in a delivery 12.

Figure 28:
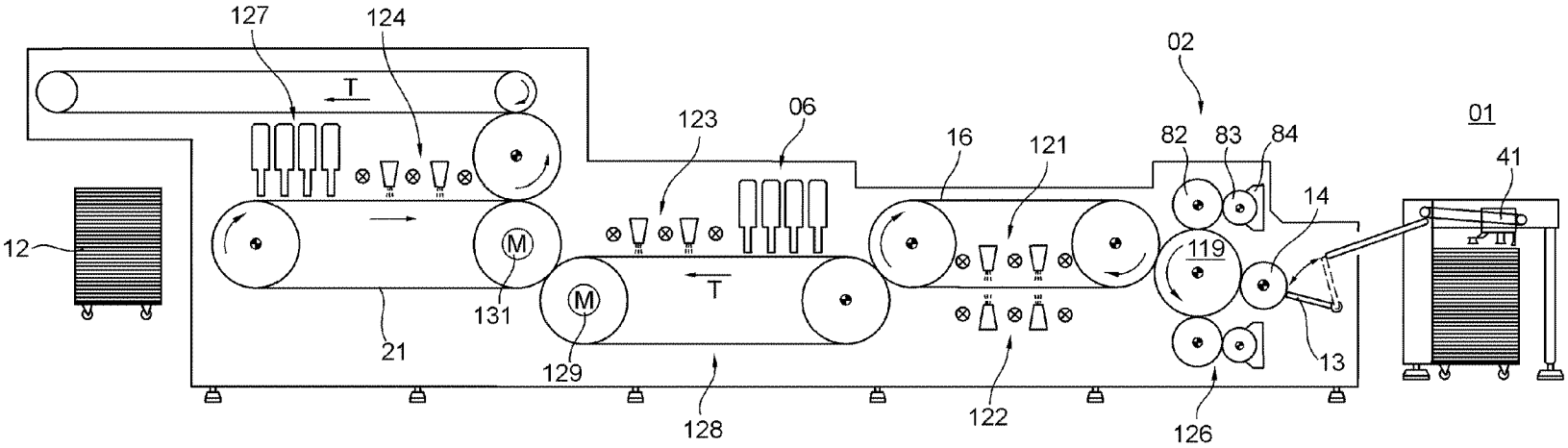
FIG. 28 a further machine arrangement for two-sided sequential processing of a plurality of sheet-type substrates.

The machine arrangement shown in FIG. 27 or 28 for processing both sides of the substrate in question has a plurality of dryers 121; 122; 123; 124, preferably four, specifically a first dryer 121 for drying the primer applied to the front side of the substrate in question and a second dryer 122 for drying the primer applied to the reverse side of the substrate in question. Also provided are a third dryer 123 for drying the substrate in question that has been printed on the front side by the first non-impact printing unit 06 and a fourth dryer 124 for drying the substrate in question that has been printed on the reverse side by the second non-impact printing unit 127. The dryers 121; 122; 123; 124 configured, e.g. as identical in configuration, are configured for drying the substrate in question, e.g. by irradiation of the same with infrared or ultraviolet radiation, the type of radiation being dependent upon whether the printing ink or ink applied to the substrate in question is water based or UV-curing. Transport direction T of the substrate in question being transported through the machine arrangement is indicated in FIG. 27 by arrows. The first non-impact printing unit 06 and the second non-impact printing unit 127 are each embodied, e.g. as at least one inkjet printing unit. In the operative zone of the first non-impact printing unit 06, a third transport device 128 is positioned, which receives the substrate in question, primed on both sides, from the first transport device having at least one drawing element, transports it to the second transport device having at least one drawing element, and delivers it to this second transport device. The third transport device 128 for transporting the substrate in question within the operative zone of the first non-impact printing unit 06 is embodied, e.g. as a transport cylinder (FIG. 27) or as an in particular continuously revolving conveyor belt (FIG. 28), wherein in the case of the transport cylinder, the preferably multiple inkjet printing units of the first non-impact printing unit 06 are each arranged radially to this transport cylinder, and in the case of the conveyor belt, the preferably multiple inkjet printing units of the first non-impact printing unit 06 are arranged, in particular, horizontally side by side, parallel to this conveyor belt. The conveyor belt is embodied, e.g. as a suction belt 52 having at least one suction chamber 58; 59 (FIG. 13).

The third transport device 128 for transporting the substrate in question within the operative zone of the first non-impact printing unit 06 and the second transport device, having at least one drawing element, for transporting the substrate in question within the operative zone of the second non-impact printing device 127 preferably each have an independent drive 129; 131, each of these independent drives 129; 131 being embodied, e.g. as a preferably electrically driven motor, the respective speed and/or angular position of which is or at least can be controlled, wherein these independent drives 129; 131 that influence the respective movement behavior of the transport devices in question synchronize or at least are capable of synchronizing the printing of the substrate in question on the front thereof by the first non-impact printing unit 06 and on the reverse side thereof by the second non-impact printing unit 127.

In one preferred embodiment, the first dryer 121 for drying the primer applied to the front side of the substrate in question is located, e.g. in the region of the impression cylinder 119 (FIG. 27) or in the region of a run, in particular of the taut run, of the first transport device having at least one drawing element (FIG. 28). The second dryer 122 for drying the primer applied to the reverse side of the substrate in question is preferably located in the region of a run, in particular of the taut run of the first transport device having at least one drawing element. The third dryer 123 for drying the substrate in question, the front side of which has been printed by the first non-impact printing unit 06, is located, e.g. in the region of the run disposed upstream of the second non-impact printing unit 127 in the transport direction T of the substrate in question, in particular the taut run, of the second transport device having at least one drawing element, or is located in the region of the third transport device 128, which is in turn located in the operative zone of the first non-impact printing unit 06 and cooperates therewith. The fourth dryer 124 for drying the substrate in question, the reverse side of which has been printed by the second non-impact printing unit 127, is positioned, e.g. in the region of the run of the second transport device having at least one drawing element, which run is located downstream of the second non-impact printing unit 127 in the transport direction T of the substrate in question. If one of the dryers 121; 122; 123; 124 is located in a run of one of the transport devices, the length of the drying distance thereof determines the minimum length of the run in question. The first transport device for receiving substrates from impression cylinder 119 and having at least one drawing element, and the second transport device for transporting substrates within the operative zone of the second non-impact printing unit 127 and having at least one drawing element each transport the substrates by means of gripper carriages 23, these gripper carriages 23 following one another with preferably fixed, in particular equidistant spacing, and each of these gripper carriages 23 being equipped with controlled or at least controllable holding means 79 (FIG. 15) for holding a substrate, in particular with grippers. Each of these gripper carriages 23 is moved by the relevant at least one drawing element of the transport device in question in transport direction T of the substrate in question. Each of the gripper carriages 23 is driven in transport direction T of the substrate in question, e.g. by a precision drive, the precision drive in question being configured, e.g. in the form of a linear drive system, wherein the precision drive in question positions the gripper carriage 23 in question and thus the substrate in question, held by the gripper carriage 23 in question, in particular in a force-locking connection, with an accuracy of less than ±1 mm, preferably of less than ±0.5 mm, in particular of less than ±0.1 mm, at a position specified along the transport path, e.g. with respect to one of the non-impact printing units 06; 127.

In one particularly advantageous embodiment of the transport device in question having gripper carriages 23, a plurality of belts are preferably arranged between immediately sequential gripper carriages 23, at least lengthwise along the transport direction T of the substrate in question, the substrate in question held by the gripper carriage 23 in question being supported with at least a part of its surface on said belts preferably arranged parallel to one another, for the purpose of stabilizing said substrate during transport. Belts arranged between sequential gripper carriages 23 along the transport direction T of the substrate in question are arranged, in particular, spring-loaded, or are made of a flexible material.

In a further preferred embodiment, gripper carriages 23 are guided, at least within the operative zone of the first non-impact printing unit 06 and/or within the operative zone of the second non-impact printing unit 127, by means of at least one guide element 71 arranged along the path of movement of the gripper carriage 23 in question, for the purpose of stabilizing their respective movement paths (FIGS. 17 to 19). In addition, for guidance that maintains registration and/or is true to register, in particular or at least within the operative zone of the first non-impact printing unit 06 and/or within the operative zone of the second non-impact printing unit 127, in each case e.g. a catcher mechanism for the gripper carriage 23 in question is provided, said catcher mechanism including, e.g. at least one fork, which is or at least can be moved in transport direction T of the substrate in question, wherein the gripper carriage 23 in question is held, e.g. at its two ends located transversely to transport direction T of the gripper carriage 23 in question, in the respective fork, and the movement path of said gripper carriage is guided by said fork in particular so as to maintain registration and/or register. Further, for the alignment of the substrate in question so as to maintain registration and/or register, in particular or at least in or immediately upstream of the operative zone of the first non-impact printing unit 06 and/or in or immediately upstream of the operative zone of the second non-impact printing unit 127, an adjustment device, in particular a lateral positioning device, is provided. The substrate in question is aligned so as to maintain registration and/or register, e.g. with the aid of sensors 33; 36 for sensing said substrate, as described in conjunction with FIG. 11, for example.

The machine arrangement illustrated in FIG. 27 or 28 can also be described as a machine arrangement for the sequential processing of a plurality of sheet-type substrates, each having a front side and a reverse side, wherein a first non-impact printing unit 06 and a second non-impact printing unit 127, along with a first primer application unit 02 and a second primer application unit 126 are provided, wherein the first primer application unit 02 is positioned for priming the front side of the sheet-type substrate and the second primer application unit 126 is positioned for priming the reverse side of the same sheet-type substrate, and wherein the first non-impact printing unit 06 is positioned for printing the front side of said substrate, which has been primed by the first primer application unit 02, and the second non-impact printing unit 127 is positioned for printing the reverse side of said substrate, which has been primed by the second primer application unit 126. In this case, a first dryer 121 for drying the primer applied to the front side of the substrate in question is provided upstream of the first non-impact printing unit 06 in transport direction T of the substrate in question, and a second dryer 122 for drying the primer applied to the reverse side of the substrate in question is provided upstream of the second non-impact printing unit 127 in the transport direction T of the substrate in question, and a third dryer 123 for drying the substrate in question, the front side of which has been printed by the first non-impact printing unit 06, is provided downstream of the first non-impact printing unit 06 in the transport direction T of the substrate in question, and a fourth dryer 124 for drying the substrate in question, the reverse side of which has been printed by the second non-impact printing device unit 127, is provided downstream of the second non-impact printing unit 127 in the transport direction T of the substrate in question. The second primer application unit 126 may alternatively be located upstream or downstream of the second non-impact printing unit 127 in transport direction T of the substrate in question. The first dryer 121 for drying the primer applied to the front side of the substrate in question and/or the second dryer 122 for drying the primer applied to the reverse side of the substrate in question, and/or the third dryer 123 for drying the substrate in question which has been printed on the front side by the first non-impact printing unit 06 and/or the fourth dryer 124 for drying the substrate in question which has been printed on the reverse side by the second non-impact printing unit 127 are each embodied, e.g. as a dryer for drying the primed and/or printed substrate in question by hot air and/or by irradiation with infrared or ultraviolet radiation, the dryer 121; 122; 123; 124 for drying the primed and/or printed substrate in question by irradiation with infrared or ultraviolet radiation preferably being embodied as an LED dryer, i.e. as a dryer that uses semiconductor diodes. In addition, at least one transport device for transporting the substrate in question is provided, this transport device being embodied as a transport cylinder or as a revolving conveyor belt or as a chain conveyor. In this case, the at least one transport device for transporting the substrate in question has at least one holding element, the at least one holding element being configured to hold the substrate in question by a force-locking connection or by a form-locking connection.

Figure 29:
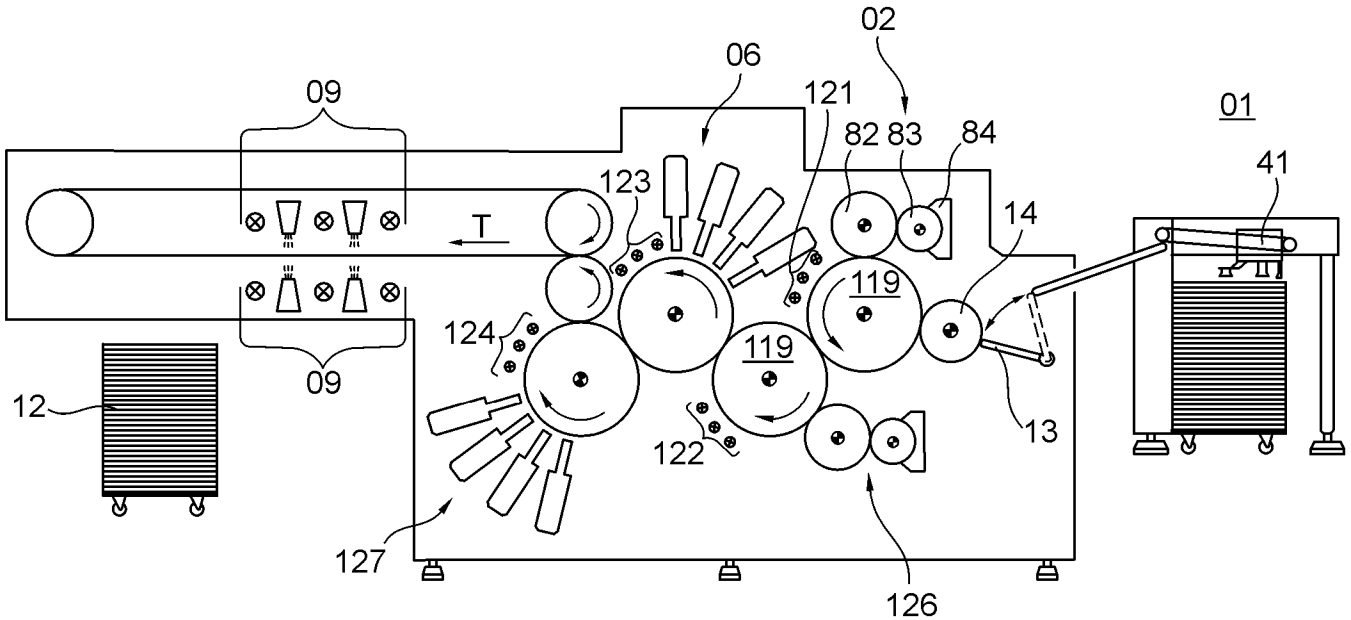
FIG. 29 yet another machine arrangement for two-sided sequential processing of a plurality of sheet-type substrates.

FIG. 29 shows yet another advantageous machine arrangement for the sequential processing of a plurality of sheet-type substrates, each having a front side and a reverse side. This machine arrangement, which is preferably embodied as a printing machine, in particular as a sheet-fed printing machine, has at least one first printing cylinder and one second printing cylinder. Arranged along the periphery of the first printing cylinder are at least one first non-impact printing unit 06 for printing the front side of the substrate in question and one dryer 123, disposed downstream of the first non-impact printing unit 06 in the direction of rotation of the first printing cylinder and intended for drying the front side of the substrate in question which has been printed by the first non-impact printing unit 06, and arranged along the periphery of the second printing cylinder are at least one second non-impact printing unit 127 for printing the reverse side of the substrate in question, and in the direction of rotation of the second printing cylinder, downstream of the second non-impact printing unit 127, a dryer 124 for drying the reverse side of the substrate in question, which has been printed by the second non-impact printing unit 127. The first non-impact printing unit 06 and the second non-impact printing unit 127 are each embodied, e.g. as at least one inkjet printing unit. The first non-impact printing unit 06 and/or the second non-impact printing unit 127 each print with multiple printing inks, for example, e.g. four, in particular yellow, magenta, cyan and black printing inks, with a dedicated inkjet printing unit preferably being provided for each of these printing inks with respect to the non-impact printing unit in question 06; 127.

In the machine arrangement according to FIG. 29, the first printing cylinder and the second printing cylinder are arranged forming a common roller nip, the first printing cylinder in this common roller nip transferring the substrate in question, which has been printed and dried on the front side, directly to the second printing cylinder. In addition, in the preferred embodiment of this machine arrangement, a first primer application unit 02 and a second primer application unit 126 are provided, the first primer application unit 02 being positioned for priming the front side of the sheet-type substrate and the second primer application unit 126 being positioned for priming the reverse side of the same sheet-type substrate, and the first non-impact printing unit 06 being positioned for printing the front side of said substrate, which has been primed by the first primer application unit 02, and the second non-impact printing unit 127 being positioned for printing the reverse side of said substrate, which has been primed by the second primer application unit 126. The first primer application unit 02 and the second primer application unit 126 each have, e.g. an impression cylinder 119, these two impression cylinders 119 being arranged forming a common roller nip, wherein the impression cylinder 119 which has the first primer application unit 02 transfers the substrate in question directly to the impression cylinder 119 which has the second primer application unit 126 in this common roller nip. The impression cylinder 119 which has the second primer application unit 126 and the first printing cylinder which has the first non-impact printing unit 06 are arranged forming a common roller nip, in which the impression cylinder 119 which has the second primer application unit 126 transfers the substrate in question directly to the first printing cylinder which has the first non-impact printing unit 06.

On the periphery of the impression cylinder 119 which has the first primer application unit 02, e.g. a dryer 121 is positioned, typically immediately downstream of the first primer application unit 02, for drying the front side of the substrate in question which has been primed by said first primer application unit 02, and/or on the periphery of the impression cylinder 119 which has the second primer application unit 126, e.g. a dryer 122 is positioned, typically immediately downstream of the second primer application unit 126, for drying the reverse side of the substrate in question which has been primed by said second primer application unit 126. The dryer 121 for drying the primer applied to the front side of the substrate in question and/or the dryer 122 for drying the primer applied to the reverse side of the substrate in question, and/or the dryer 123 for drying the substrate in question which has been printed on the front side by the first non-impact printing unit 06 and/or the dryer 124 for drying the substrate in question which has been printed on the reverse side by the second non-impact printing unit 127 are each embodied as a dryer for drying the primed and/or printed substrate in question using hot air and/or by irradiation with infrared or ultraviolet radiation. In one particularly preferred embodiment, the dryer 121; 122; 123; 124 for drying the primed and/or printed substrate in question by irradiation with infrared or ultraviolet radiation is embodied as an LED dryer, i.e. as a dryer that uses semiconductor diodes to generate the infrared or ultraviolet radiation.

Moreover, in the machine arrangement shown in FIG. 29, the first printing cylinder and the second printing cylinder and the impression cylinder 119 which has the first primer application unit 02 and the impression cylinder 119 which has the second primer application unit 126 are each preferably connected to one another in a single drive train formed of gears, i.e. in a gear train, and are driven jointly in their respective rotation by a single drive, said drive preferably being embodied in particular as a speed-controlled and/or position-controlled electric motor. The first printing cylinder and the second printing cylinder and the impression cylinder 119 which has the first primer application unit 02 and the impression cylinder 119 which has the second primer application unit 126 are each embodied, e.g. as multiple-sized, i.e. on the lateral surface of each, e.g. two or three or four substrates are or at least can be arranged one behind the other in the circumferential direction. Each of the substrates to be transported is held in a force-locking and/or a form-locking connection on the lateral surface of the first printing cylinder and/or the second printing cylinder and/or the impression cylinder 119 which has the first primer application unit 02 and/or the impression cylinder 119 which has the second primer application unit 126, in each case by means of at least one holding element embodied, e.g. as a gripper. Pliable and/or thin substrates, in particular, having a thickness of, e.g. up to 0.1 mm or a maximum of 0.2 mm, can be held in a force-locking connection, e.g. by means of suction air, on the lateral surface of the cylinder in question, wherein the support of such a substrate on the lateral surface of the cylinder in question, in particular along the edges of said substrate, is supported, e.g. by blower air directed in particular radially onto the lateral surface of the cylinder in question.

After being transported through the second printing cylinder, the substrate in question, which has been printed on both sides, is then preferably transported by means of a transport device, e.g. to a delivery 12, and is deposited onto a pile in delivery 12. The transport device connected downstream of the second printing cylinder is embodied, e.g. as a chain conveyor, and as the substrate in question is being transported through this transport device, before being deposited in delivery 12, the substrate is dried again, preferably on both sides, by at least one dryer 09. In some production lines, the plan may be to print the substrate in question, which has been printed on the front side by the first non-impact printing unit 06 and/or has been printed on the reverse side by the second non-impact printing unit 127, on one or both sides with additional printing inks, in particular special colors, and/or, e.g. to finish it by an application of varnish. In this latter case, at least one additional, e.g. a third printing cylinder or preferably at least one additional cylinder pair, composed of a third printing cylinder and a fourth printing cylinder, is provided downstream of the second printing cylinder and upstream of the transport device for transporting the substrate in question to delivery 12, on which at least one additional, e.g. third and/or fourth printing cylinder, one additional printing unit, in particular one additional non-impact printing unit, or at least one varnishing unit 08 is arranged in a manner similar to the arrangement associated with the first printing cylinder and/or the second printing cylinder, in each case optionally with an additional dryer. All of these juxtaposed printing cylinders then form a continuous transport path for the substrate in question in the machine arrangement in question, in which this substrate is then transferred from one printing cylinder to the next. The substrate in question can be processed, in particular printed, on both sides, without the need for a turning device for the substrate in this machine arrangement. The proposed machine arrangement is thus highly compact and inexpensive.

The machine arrangement shown in FIG. 29 is particularly advantageous for use in conjunction with UV-curing inks, e.g. for printing packaging materials for foods or cosmetics.

While preferred embodiments of a device for overlapping sheets, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A device for overlapping sheets comprising:

an infeed table, a plurality of sheets to be overlapped being guided, in succession, and spaced one from the other, on the infeed table in a direction of sheet transport;

at least one blower module, the at least one blower module being positioned above the infeed table, the plurality of sheets on the infeed table being guided, in succession, into a region between the at least one blower module and the infeed table;

at least first and second blower nozzle rows in the at least one blower module, each of the at least first and second blower nozzle rows being positioned in the blower module, on a side of the blower module facing the infeed table, and each having a blowing direction oriented parallel to the infeed table and opposite to the direction of sheet transport, the at least first and second blower nozzle rows being arranged one behind the other in the direction of sheet transport;

a shield plate positioned in the region between the infeed table and the side of the blower module facing the infeed table, the shield plate being adapted to engage sheets lifted off the infeed table by the at least one blower module; and a plurality of openings in the infeed table, in at least the region of the infeed table between the at least one blower module and the infeed table, and through which plurality of openings air can flow underneath a sheet being lifted off the infeed table.

2. The device according to claim 1, wherein the at least first and second blower nozzle rows, each contain a plurality of blower nozzles arranged side by side, are each blower nozzle row extending transversely to the direction of sheet transport.

3. The device according to claim 2, characterized in that a blowing direction of each of the plurality of blower nozzles is defined by at least one guide surface that channels a flow of the blower air from each of the plurality of blower nozzles.

4. The device according to claim 2, wherein a flow of blower air flowing out of each of the plurality of blower nozzles is controlled, in terms of at least one of time and intensity, by adjustable valves, and wherein the adjustable valves are controlled by a control unit.

5. The device according to claim 4, wherein the adjustable valves are activated by the control unit in a cycle, and wherein one of a cycle duration and a cycle frequency is adjusted dependent upon an advance of the plurality of sheets to be overlapped.

6. The device according to claim 1, wherein in the transport direction of the sheets, in the region between the infeed table and the side of the blower module facing the infeed table, a baffle plate is arranged upstream of the first blower nozzle row, and wherein the baffle plate shields a leading edge of a succeeding sheet, which immediately follows a sheet that has been lifted by blower air coming from the at least first blower nozzle row against a suction effect induced by the blower module.

7. The device according to claim 6, wherein the baffle plate has a concave curvature at its end located upstream from the blower module in a blowing direction of the blower air, and wherein this concave curvature gives the blower air a flow-off direction facing away from the infeed table.

8. The device according to claim 1, wherein a sheet that has been lifted by the blower module by a suction effect generated by blower air from the blower module, is lifted above the infeed table at a floating height, which floating height is measured by a distance from the side of the blower module that faces the infeed table, and wherein the floating height is dependent upon one of the intensity of the blower air and upon a weight of the sheet, and upon a transport speed of the sheet.

9. The device according to claim 1, wherein the shield plate is arranged at an acute angle with respect to the side of the blower module that faces the infeed table.

10. The device according to claim 1, wherein the shield plate is configured as a grate.

11. The device according to claim 1, wherein each of the plurality of openings provided in the infeed table is configured as being circular, and with a diameter of a few millimeters.

12. The device according to claim 1, wherein the infeed table arranged upstream of a delivery for the sheets in the direction of sheet transport.

13. The device according to claim 1, wherein the device for overlapping sheets is arranged in a region of a transfer device, at which transfer device sheets coming from an upstream processing station are passed on to a downstream processing station.

14. The device according to claim 13, one of wherein the upstream processing station is embodied as a printing unit and the downstream processing station is embodied as a mechanical processing unit.

* * * * *